US005611018A

United States Patent [19]

Tanaka et al.

[11] Patent Number: 5,611,018

[45] Date of Patent: Mar. 11, 1997

[54] SYSTEM FOR CONTROLLING VOICE SPEED OF AN INPUT SIGNAL

[75] Inventors: Hiroshi Tanaka; Masayuki Iida; Masanori Miyatake, all of Yawata; Shozo Sugishita, Hirakata; Teruo Hoshi, Otashi, all of Japan

[73] Assignee: Sanyo Electric Co., Ltd., Moriguchi, Japan

[21] Appl. No.: 305,607

[22] Filed: Sep. 14, 1994

[30] Foreign Application Priority Data

| | | | |
|---|---|---|---|
| Sep. 18, 1993 | [JP] | Japan | 5-255040 |
| Oct. 19, 1993 | [JP] | Japan | 5-286051 |
| Oct. 19, 1993 | [JP] | Japan | 5-286052 |
| Oct. 22, 1993 | [JP] | Japan | 5-265001 |
| Nov. 17, 1993 | [JP] | Japan | 5-312580 |
| May 24, 1994 | [JP] | Japan | 6-109873 |
| May 24, 1994 | [JP] | Japan | 6-109874 |
| May 24, 1994 | [JP] | Japan | 6-109876 |

[51] Int. Cl.[6] ..... G10L 3/02

[52] U.S. Cl. ..... 395/2.24; 395/2.2; 395/2.17; 395/2.76

[58] Field of Search ..... 395/2.2, 2.23, 395/2.24, 2.17, 2.67, 2.76, 2.87; 381/34–40, 51

[56] References Cited

U.S. PATENT DOCUMENTS

| | | | |
|---|---|---|---|
| 5,189,702 | 2/1993 | Sakurai et al. | 381/51 |
| 5,305,420 | 4/1994 | Nakamura et al. | 395/2.17 |

FOREIGN PATENT DOCUMENTS

| | | | |
|---|---|---|---|
| 0294832 | 4/1990 | Japan | G10L 5/00 |
| 3-205656 | 9/1991 | Japan | G10L 3/02 |
| 5-73089 | 3/1993 | Japan | G10L 3/02 |
| 5-257490 | 10/1993 | Japan | G10L 3/00 |
| 6266381 | 9/1994 | Japan | G10L 3/00 |

OTHER PUBLICATIONS

Technical Report of IEICE SP92–54, "A Development of Portable DSP System for Speech Processing", Nejime et al, Sep. 1992.

Research Institute of Applied Electricity, Hokkaido University, "Applications of Digital Technique to the Aid for the Hearing Impaired", by Tohru Ifukube, 1991; vol. 47, No. 10, pp. 760–765, from Journal of Acoustical Society of Japan.

Neijime et al. "Evaluation of speech–rate conversion method by hearing–impaired listeners", pp. 25–31. Published in The Institute of Electronics Information and Communication Engineers, Technical Report of ICEE, SP92–150: 1993, 03.

*Primary Examiner*—Kee M. Tung

*Attorney, Agent, or Firm*—Beveridge, DeGrandi, Weilacher & Young, LLP

[57] ABSTRACT

In a voice speed converting system according to the present invention, an input sound signal is subjected to voice speed conversion processing by a voice speed conversion processing device. Output from the voice speed conversion processing device is written to a ring memory. Data written to the ring memory are read out at a predetermined speed. The amount of stored data in the ring memory is calculated on the basis of a write signal and a read signal for the ring memory by stored data amount calculating device. The voice speed converting device includes a section judging device that judges which of a voice section and a silence section corresponds to the input sound signal. The input sound signal is subjected to compression and expansion processing or deletion processing, in response to an output of the section judging device and an output of the stored data amount calculating device by a signal processing device.

28 Claims, 29 Drawing Sheets

STARTING POINT OF WRITING

STARTING POINT OF READING

POINT A

POINT B

POINT C

POINT D

TmS=StS+Tmin
POINT S

TmT=StT+Tmin
POINT T

POINT U

SYSTEM FOR CONTROLLING VOICE SPEED OF AN INPUT SIGNAL

BACKGROUND OF THE INVENTION

1. Field of the Invention

The present invention relates generally to a voice speed converting system for converting the voice speed of a sound signal, and more particularly, to a voice speed converting system utilized for an image and voice reproducing device for hearing voice at high speed or at low speed such as a laser disk or a VTR, a hearing aid system for converting a sound signal broadcasted to hearing-impaired listeners into a slow and easy voice to hear, a language learning machine for converting a voice in a foreign language spoken at native speed into a slow and easy voice to hear, and the like.

2. Description of the Prior Art

Examples of conventional techniques for converting the voice speed include an analog type time-scale expansion and compression technique. In a voice speed converting method using the analog type time-scale expansion and compression technique, however, simple thinning processing or repeated insertion processing of voice waveforms is only performed. Therefore, joints of a sound are discontinuous, whereby the quality of sound is deteriorated.

Examples of the time-scale expansion and compression technique in which a good quality of sound is obtained include a technique for detecting the pitch cycle of voice by digital signal processing and thinning or inserting a pitch portion by the detected pitch cycle or in integral multiples of the pitch cycle. In a voice speed converting method using this digital type time-scale expansion and compression technique, however, a sound signal is compressed or expanded at a uniform rate of compression or expansion irrespective of a silence section and a voice section in the sound signal. Accordingly, the reproduction speed in the voice section is too high at the time of reproducing a VTR at twice the speed, at the time of reproducing voice in a foreign language by a language learning machine, and the like so that voice cannot be easily caught.

In order to solve the above described problems, a voice speed converting method for discriminating between a silence section and a voice section in a sound signal, deleting the silence section, and expanding the voice section by the pitch cycle has been already developed. Such a method is disclosed in the following documents A and B.

Document A: TECHNICAL REPORT OF IEICE, SP92-56, HC92-33 (1992-09) entitled "A METHOD OF ABSORBING TEMPORAL ENLARGEMENT OF SPEECH LENGTHS IN THE VOICE SPEED CONVERTING SYSTEM FOR ELDERLY", issued by THE INSTITUTE OF ELECTRONICS, INFORMATION AND COMMUNICATION ENGINEERS.

Document B: TECHNICAL REPORT OF IEICE, SP92-150 (1993-03) entitled "EVALUATION OF SPEECH-RATE CONVERSION METHOD BY HEARING-IMPAIRED LISTENERS", issued by THE INSTITUTE OF ELECTRONICS, INFORMATION AND COMMUNICATION ENGINEERS.

According to this method, the reproduction speed in the voice section can be reduced, thereby making it easy to hear the voice. In this method, however, there are the following problems.

In a first conventional system disclosed in the document A, the processing load is large, whereby a high-speed operation is required, to increase power consumption. In a second conventional system disclosed in the document B, the deviation between video and voice becomes too great, which makes it difficult to grasp the contents, and the capacity of a memory for storing sound signals becomes tremendous, which increases costs.

SUMMARY OF THE INVENTION

An object of the present invention is to provide a voice speed converting system in which the processing load can be reduced, the deviation between video and voice can be reduced, and the capacity of a memory for storing sound signals is not tremendous.

Another object of the present invention is to provide a voice speed converting system capable of making the sound reproduction speed in a voice section in an input signal lower than the set reproduction speed while making a sound dropped portion in the voice section as small as possible.

In a first voice speed converting system according to the present invention, an input sound signal is subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means. The amount of stored data in the ring memory means a value obtained by subtracting the total number of words composing the data read out of the ring memory from the total number of words composing the data written into the ring memory.

In the voice speed conversion processing means, section judging means judges which of a voice section and a silence section corresponds to the input sound signal. The input sound signal is subjected to compression and expansion processing or deletion processing in response to an output of the section judging means and an output of the stored data amount calculating means by signal processing means.

In a second voice speed converting system according to the present invention, an inputted analog sound signal is sampled at a sampling frequency corresponding to the set factor of the reproduction speed by analog-to-digital (A/D) converting means. A sound signal outputted from the A/D converting means is inputted to a frame memory. Every time a required number of sound signals are inputted to the frame memory, the sound signals are subjected to voice speed conversion processing by voice speed conversion processing means. An output of the voice speed conversion processing means is written to a ring memory. Data written to the ring memory is read out on the basis of a read signal having a frequency equal to a sampling frequency at the time of reproduction at the standard speed. The amount of stored data in the ring memory is calculated on the basis of a write signal and the read signal for the ring memory by stored data amount calculating means.

In the voice speed conversion processing means, section judging means judges which of a voice section and a silence section corresponds to input voice corresponding to a required number of sound signals inputted to the frame memory. The required number of sound signals are subjected to compression and expansion processing or deletion processing in response to an output of the section judging means and an output of the stored data amount calculating means by signal processing means.

In a third voice speed converting system according to the present invention, an inputted digital sound signal is written to a frame memory at a speed corresponding to the set factor of the reproduction speed. Every time a required number of sound signals are inputted to the frame memory, the sound signals are subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

In the voice speed conversion processing means, section judging means judges which of a voice section and a silence section corresponds to input voice corresponding to the required number of sound signals inputted to the frame memory. The required number of sound signals are subjected to compression and expansion processing or deletion processing in response to an output of the section judging means and an output of the stored data amount calculating means by signal processing means.

The above described ring memory is a memory having a ring structure. The ring structure is a structure in which items in a chained list are so linked that a pointer of the last item points to the first item.

The following is an example of the signal processing means used in the first to third voice speed converting systems according to the present invention. It is judged which of first to sixth modes indicated by the following items (a) to (f) corresponds to the present state on the basis of the output of the section judging means and the output of the stored data amount calculating means:

(a) First mode: a mode in which the input sound signal corresponds to the voice section and the ring memory is not in a state immediately before overflow, (b) Second mode: a mode in which the input sound signal corresponds to the voice section and the ring memory is in a state immediately before overflow, (c) Third mode: a mode in which the input sound signal corresponds to the silence section and the continuation length of the silence section is less than a predetermined value, and the ring memory is not in a state immediately before overflow, (d) Fourth mode: a mode in which the input sound signal corresponds to the silence section and the continuation length of the silence section is less than a predetermined value, and the ring memory is in a state immediately before overflow, (e) Fifth mode: a mode in which the input sound signal corresponds to the silence section and the continuation length of the silence section is not less than a predetermined value, and the ring memory is not in a state immediately before underflow, and (f) Sixth mode: a mode in which the input sound signal corresponds to the silence section and the continuation length of the silence section is not less than a predetermined value, and the ring memory is in a state immediately before underflow.

When it is judged that the present state corresponds to the first mode or the third mode, the sound signal is subjected to the compression and expansion processing at a compression rate of more than 1/n, where n is the set factor of the reproduction speed, by first processing means.

When it is judged that the present state corresponds to the second mode or the fourth mode, the sound signal is deleted until the ring memory enters the state immediately before underflow by second processing means.

When it is judged that the present state corresponds to the fifth mode, the sound signal corresponding to the silence section is deleted by third processing means.

When it is judged that the present state corresponds to the sixth mode, the compression and expansion processing is performed at a compression rate of $1/n\pm\alpha$ ($\alpha$ is a value which is not less than 0 nor more than 1), where n is the set factor of the reproduction speed, by fourth processing means.

Examples of the above described first processing means include means for performing the compression and expansion processing by the pitch cycle or in integral multiples of the pitch cycle or means for performing the compression and expansion processing by the fixed frame length, for example, a PICOLA (Pointer-Interval Control Overlap and Add) method using control of the amount of movement of a pointer and a TDHS (Time Domain Harmonic Scaling) method.

Examples of the above described section judging means include means comprising means for calculating an average power value of the required number of sound signals inputted to the frame memory and judging means for judging whether a voice section or a silence section corresponds to the input voice on the basis of the calculated average power value and a predetermined threshold value. The above described threshold value may be adjusted depending on the amount of stored data in the ring memory.

Examples of the above described section judging means include means comprising means for calculating an accumulated power value of the required number of sound signals inputted to the frame memory and judging means for judging which of the voice section and the silence section corresponds to the input voice on the basis of the calculated accumulated power value and a predetermined threshold value. The above described threshold value may be adjusted depending on the amount of stored data in the ring memory.

Examples of the above described section judging means include means comprising means for calculating an average amplitude value of the required number of sound signals inputted to the frame memory and judging means for judging which of the voice section and the silence section corresponds to the input voice on the basis of the calculated average amplitude value and a predetermined threshold value. The above described threshold value may be adjusted depending on the amount of stored data in the ring memory.

Examples of the above described section judging means include means comprising means for calculating an accumulated amplitude value of the required number of sound signals inputted to the frame memory and judging means for judging which of the voice section and the silence section corresponds to the input voice on the basis of the calculated accumulated amplitude value and a predetermined threshold value. The above described threshold value may be adjusted depending on the amount of stored data in the ring memory.

Examples of the above described section judging means include means comprising detecting means for detecting the periodicity of the required number of sound signals inputted to the frame memory and judging means for judging which of the voice section and the silence section corresponds to the input voice on the basis of the detected periodity.

Examples of the above described section judging means include means comprising calculating means for calculating power spectrums corresponding to predetermined one or a plurality of frequency bands of the required number of sound signals inputted to the frame memory and judging means for judging which of the voice section and the silence section corresponds to the input voice on the basis of the calculated power spectrums and a predetermined threshold value. The above described threshold value may be adjusted depending on the amount of stored data in the ring memory.

In a fourth voice speed converting system according to the present invention, an input sound signal is subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

In the voice speed conversion processing means, section judging means judges which of a voice section and a silence section corresponds to the input sound signal. The input sound signal is subjected to compression and expansion processing or deletion processing in response to an output of the section judging means and an output of the stored data amount calculating means by signal processing means. In the signal processing means, when the input sound signal corresponds to the voice section and the ring memory is not in a state immediately before overflow, the compression and expansion processing is performed at a compression rate determined depending on the amount of change per unit time of the amount of stored data in the ring memory which is a compression rate of not less than 1/n, where n is the set factor of the reproduction speed.

In a fifth voice speed converting system according to the present invention, an inputted analog sound signal is sampled at a sampling frequency corresponding to the set factor of the reproduction speed by A/D converting means. A sound signal outputted from the A/D converting means is inputted to a frame memory. Every time a required number of sound signals are inputted to the frame memory, the sound signals are subjected to voice speed conversion processing by voice speed conversion processing means. An output of the voice speed conversion processing means is written to a ring memory. Data written to the ring memory is read out on the basis of a read signal having a frequency equal to a sampling frequency at the time of reproduction at the standard speed. The amount of stored data in the ring memory is calculated on the basis of a write signal and the read signal for the ring memory by stored data amount calculating means.

In the voice speed conversion processing means, section judging means judges which of a voice section and a silence section corresponds to input voice corresponding to the required number of sound signals inputted to the frame memory. The required number of sound signals are subjected to compression and expansion processing or deletion processing in response to an output of the section judging means and an output of the stored data amount calculating means by signal processing means. In the signal processing means, when the input voice corresponds to the voice section and the ring memory is not in a state immediately before overflow, the compression and expansion processing is performed at a compression rate determined depending (based) on the amount of change per unit time of the amount of stored data in the ring memory which is a compression rate of not less than 1/n, where n is the set factor of the reproduction speed.

In a sixth voice speed converting system according to the present invention, an inputted digital sound signal is written to a frame memory at a speed corresponding to the set factor of the reproduction speed. Every time a required number of sound signals are inputted to the frame memory, the sound signals are subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

In the voice speed conversion processing means, section judging means judges which of a voice section and a silence section corresponds to input voice corresponding to the required number of sound signals inputted to the frame memory. The required number of sound signals are subjected to compression and expansion processing or deletion processing in response to an output of the section judging means and an output of the stored data amount calculating means by signal processing means. In the signal processing means, when the input voice corresponds to the voice section and the ring memory is not in a state immediately before overflow, the compression and expansion processing is performed at a compression rate determined depending on the amount of change per unit time of the amount of stored data in the ring memory which is a compression rate of not less than 1/n, where n is the set factor of the reproduction speed.

The following is an example of the signal processing means used in the fourth to sixth voice speed converting systems according to the present invention. It is judged which of the first to sixth modes indicated by the foregoing items (a) to (f) corresponds to the present state on the basis of the output of the section judging means and the output of the stored data amount calculating means.

When it is judged that the present state corresponds to the first mode or the third mode, the compression and expansion processing is performed at a compression rate determined depending on the amount of change per unit time of the amount of stored data in the ring memory which is a compression rate of not less than 1/n, where n is the set factor of the reproduction speed, by first processing means.

When it is judged that the present state corresponds to the second mode or the fourth mode, the sound signal is deleted until the ring memory enters the state immediately before underflow by second processing means.

When it is judged that the present state corresponds to the fifth mode, the sound signal corresponding to the silence section is deleted by third processing means.

When it is judged that the present state corresponds to the sixth mode, the compression and expansion processing is performed at a compression rate of $1/n \pm \alpha$ ($\alpha$ is a value which is not less than 0 nor more than 1), where n is the set factor of the reproduction speed, by fourth processing means.

The foregoing various means can be used as the section judging means used in the fourth to sixth voice speed converting systems according to the present invention.

In a seventh voice speed converting system according to the present invention, an input sound signal is subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

In the voice speed conversion processing means, section judging means judges which of a voice section and a silence section corresponds to the input sound signal. The input sound signal is subjected to compression and expansion processing or deletion processing in response to an output of the section judging means and an output of the stored data amount calculating means by signal processing means. In the signal processing means, when the input sound signal corresponds to the voice section and the ring memory is not in a state immediately before overflow, the compression and expansion processing is performed at a compression rate determined depending on the type of program executed set by an operator which is a compression rate of not less than 1/n, where n is the set factor of the reproduction speed.

In an eighth voice speed converting system according to the present invention, an inputted analog sound signal is sampled at a sampling frequency corresponding to the set factor of the reproduction speed by A/D converting means. A sound signal outputted from the A/D converting means is inputted to a frame memory. Every time a required number of sound signals are inputted to the frame memory, the sound signals are subjected to voice speed conversion processing by voice speed conversion processing means. An output of the voice speed conversion processing means is written to a ring memory. Data written to the ring memory is read out on the basis of a read signal having a frequency equal to a sampling frequency at the time of reproduction at the standard speed. The amount of stored data in the ring memory is calculated on the basis of a write signal and the read signal for the ring memory by stored data amount calculating means.

In the voice speed conversion processing means, section judging means judges which of a voice section and a silence section corresponds to input voice corresponding to the required number of sound signals inputted to the frame memory. The required number of sound signals are subjected to compression and expansion processing or deletion processing in response to an output of the section judging means and an output of the stored data amount calculating means by signal processing means. In the signal processing means, when the input voice corresponds to the voice section and the ring memory is not in a state immediately before overflow, the compression and expansion processing is performed at a compression rate determined depending on the type of program set by an operator which is a compression rate of not less than 1/n, where n is the set factor of the reproduction speed.

In a ninth voice speed converting system according to the present invention, an inputted digital sound signal is written to a frame memory at a speed corresponding to the set factor of the reproduction speed. Every time a required number of sound signals are inputted to the frame memory, the sound signals are subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

In the voice speed conversion processing means, section judging means judges which of a voice section and a silence section corresponds to input voice corresponding to the required number of sound signals inputted to the frame memory. The required number of sound signals are subjected to compression and expansion processing or deletion processing in response to an output of the section judging means and an output of the stored data amount calculating means by signal processing means. In the signal processing means, when the input voice corresponds to the voice section and the ring memory is not in a state immediately before overflow, the compression and expansion processing is performed at a compression rate determined depending on the type of program set by an operator which is a compression rate of not less than 1/n, where n is the set factor of the reproduction speed.

The following is an example of the signal processing means used in the seventh to ninth voice speed converting systems according to the present invention. It is judged which of the first to sixth modes indicated by the foregoing items (a) to (f) corresponds to the present state on the basis of the output of the section judging means and the output of the stored data amount calculating means.

When it is judged that the present state corresponds to the first mode or the third mode, the compression and expansion processing is performed at a compression rate determined depending on the type of program set by an operator which is a compression rate of not less than 1/n, where n is the set factor of the reproduction speed, by first processing means.

When it is judged that the present state corresponds to the second mode or the fourth mode, the sound signal is deleted until the ring memory enters the state immediately before underflow by second processing means.

When it is judged that the present state corresponds to the fifth mode, the sound signal corresponding to the silence section is deleted by third processing means.

When it is judged that the present state corresponds to the sixth mode, the compression and expansion processing is performed at a compression rate of $1/n \pm \alpha$ ($\alpha$ is a value which is not less than 0 nor more than 1), where n is the set factor of the reproduction speed, by fourth processing means.

The foregoing various means can be used as the section judging means used in the seventh to ninth voice speed converting systems according to the present invention.

In a tenth voice speed converting system according to the present invention, an input sound signal is subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

In the voice speed conversion processing means, section judging means judges which of a voice section and a silence section corresponds to the input sound signal. The input sound signal is subjected to compression and expansion processing or deletion processing in response to an output of the section judging means and an output of the stored data amount calculating means by signal processing means. In the signal processing means, when the input sound signal corresponds to the voice section and the ring memory is not in a state immediately before overflow, the compression and expansion processing is performed at a compression rate determined depending on the type of program set by an operator and the amount of stored data in the ring memory which is a compression rate of not less than 1/n, where n is the set factor of the reproduction speed.

In an eleventh voice speed converting system according to the present invention, an inputted analog sound signal is sampled at a sampling frequency corresponding to the set factor of the reproduction speed by A/D converting means. A sound signal outputted from the A/D converting means is inputted to a frame memory. Every time a required number of sound signals are inputted to the frame memory, the sound signals are subjected to voice speed conversion processing by voice speed conversion processing means. An output of the voice speed conversion processing means is written to a ring memory. Data written to the ring memory is read out on the basis of a read signal having a frequency equal to a sampling frequency at the time of reproduction at the standard speed. The amount of stored data in the ring memory is calculated on the basis of a write signal and the read signal for the ring memory by stored data amount calculating means.

In the voice speed conversion processing means, section judging means judges which of a voice section and a silence section corresponds to input voice corresponding to the required number of sound signals inputted to the frame memory. The required number of sound signals are subjected to compression and expansion processing or deletion processing in response to an output of the section judging means and an output of the stored data amount calculating means by signal processing means. In the signal processing means, when the input voice corresponds to the voice section and the ring memory is not in a state immediately before overflow, the compression and expansion processing is performed at a compression rate determined depending on the type of program set by an operator and the amount of stored data in the ring memory which is a compression rate of not less than 1/n, where n is the set factor of the reproduction speed.

In a twelfth voice speed converting system according to the present invention, an inputted digital sound signal is written to a frame memory at a speed corresponding to the set factor of the reproduction speed. Every time a required number of sound signals are inputted to the frame memory, the sound signals are subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

In the voice speed conversion processing means, section judging means judges which of a voice section and a silence section corresponds to input voice corresponding to the required number of sound signals inputted to the frame memory. The required number of sound signals are subjected to compression and expansion processing or deletion processing in response to an output of the section judging means and an output of the stored data amount calculating means by signal processing means. In the signal processing means, when the input voice corresponds to the voice section and the ring memory is not in a state immediately before overflow, the compression and expansion processing is performed at a compression rate determined depending on the type of program set by an operator and the amount of stored data in the ring memory which is a compression rate of not less than 1/n, where n is the set factor of the reproduction speed.

The following is an example of the signal processing means used in the tenth to twelfth voice speed converting systems according to the present invention. It is judged which of the first to sixth modes indicated by the foregoing items (a) to (f) corresponds to the present state on the basis of the output of the section judging means and the output of the stored data amount calculating means.

When it is judged that the present state corresponds to the first mode or the third mode, the compression and expansion processing is performed at a compression rate determined depending on the type of program set by an operator and the amount of stored data in the ring memory which is a compression rate of not less than 1/n, where n is the set factor of the reproduction speed, by first processing means.

When it is judged that the present state corresponds to the second mode or the fourth mode, the sound signal is deleted until the ring memory enters the state immediately before underflow by second processing means.

When it is judged that the present state corresponds to the fifth mode, the sound signal corresponding to the silence section is deleted by third processing means.

When it is judged that the present state corresponds to the sixth mode, the compression and expansion processing is performed at a compression rate of $1/n \pm \alpha$ ($\alpha$ is a value which is not less than 0 nor more than 1), where n is the set factor of the reproduction speed, by fourth processing means.

The foregoing various means can be used as the section judging means used in the tenth to twentieth voice speed converting systems according to the present invention.

In a thirteenth voice speed converting system according to the present invention, an input sound signal is subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

In the voice speed conversion processing means, section judging means judges which of a voice section and a silence section corresponds to the input sound signal. The input sound signal is subjected to compression and expansion processing or deletion processing in response to an output of the section judging means and an output of the stored data amount calculating means by signal processing means. In the signal processing means, when a compression rate fixing mode is selected in a case where the input sound signal corresponds to the voice section and the ring memory is not in a state immediately before overflow, the compression and expansion processing is performed at a compression rate determined depending on the type of program set by an operator which is a compression rate of not less than 1/n, where n is the set factor of the reproduction speed. On the other hand, when a compression rate variation mode is selected in a case where the input sound signal corresponds to the voice section and the ring memory is not in a state immediately before overflow, the compression and expansion processing is performed at a compression rate determined depending on the type of program set by an operator and the amount of stored data in the ring memory which is a compression rate of not less than 1/n, where n is the set factor of the reproduction speed.

In a fourteenth voice speed converting system according to the present invention, an inputted analog sound signal is sampled at a sampling frequency corresponding to the set factor of the reproduction speed by A/D converting means. A sound signal outputted from the A/D converting means is inputted to a frame memory. Every time a required number of sound signals are inputted to the frame memory, the sound signals are subjected to voice speed conversion processing by voice speed conversion processing means. An output of the voice speed conversion processing means is written to a ring memory. Data written to the ring memory is read out on the basis of a read signal having a frequency equal to a sampling frequency at the time of normal reproduction at the standard speed. The amount of stored data in the ring memory is calculated on the basis of a write signal and the read signal for the ring memory by stored data amount calculating means.

In the voice speed conversion processing means, section judging means judges which of a voice section and a silence section corresponds to the inputted voice corresponding to the required number of sound signals inputted to the frame memory. The required number of sound signals are subjected to compression and expansion processing or deletion processing in response to an output of the section judging means and an output of the stored data amount calculating means by signal processing means. In the signal processing means, when a compression rate fixing mode is selected in a case where the input voice corresponds to the voice section and the ring memory is not in a state immediately before overflow, the compression and expansion processing is performed at a compression rate determined depending on the type of program set by an operator which is a compression rate of not less than 1/n, where n is the set factor of the reproduction speed. On the other hand, when a compression rate variation mode is selected in a case where the input voice corresponds to the voice section and the ring memory is not in a state immediately before overflow, the compression and expansion processing is performed at a compression rate determined depending on the type of program set by an operator and the amount of stored data in the ring memory which is a compression rate of not less than 1/n, where n is the set factor of the reproduction speed.

In a fifteenth voice speed converting system according to the present invention, an inputted digital sound signal is written to a frame memory at a speed corresponding to the set factor of the reproduction speed. Every time a required number of sound signals are inputted to the frame memory, the sound signals are subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

In the voice speed conversion processing means, section judging means judges which of a voice section and a silence section corresponds to input voice corresponding to the required number of sound signals inputted to the frame memory. The required number of sound signals are subjected to compression and expansion processing or deletion processing in response to an output of the section judging means and an output of the stored data amount calculating means. In the signal processing means, when a compression rate fixing mode is selected in a case where the input voice corresponds to the voice section and the ring memory is not in a state immediately before overflow, the compression and expansion processing is performed at a compression rate determined depending on the type of program set by an operator which is a compression rate of not less than 1/n, where n is the set factor of the reproduction speed. On the other hand, when a compression rate variation mode is selected in a case where the input voice corresponds to the voice section and the ring memory is not in a state immediately before overflow, the compression and expansion processing is performed at a compression rate determined depending on the type of program set by an operator and the amount of stored data in the ring memory which is a compression rate of not less than 1/n, where n is the set factor of the reproduction speed.

The following is an example of the signal processing means used in the thirteenth to fifteenth voice speed converting systems according to the present invention. It is judged which of the first to sixth modes indicated by the foregoing items (a) to (f) corresponds to the present state on the basis of the output of the section judging means and the output of the stored data amount calculating means.

When a compression rate fixing mode is selected in a case where it is judged that the present state corresponds to the first mode or the third mode, the compression and expansion processing is performed at a compression rate determined depending on the type of program set by an operator which is a compression rate of not less than 1/n, where n is the set factor of the reproduction speed, by first processing means.

When a compression rate variation mode is selected in a case where it is judged that the present state corresponds to the first mode or the third mode, the compression and expansion processing is performed at a compression rate determined depending on the type of program set by an operator and the amount of stored data in the ring memory which is a compression rate of not less than 1/n, where n is the set factor of the reproduction speed, by the first processing means.

When it is judged that the present state corresponds to the second mode or the fourth mode, the sound signal is deleted until the ring memory enters the state immediately before underflow by second processing means.

When it is judged that the present state corresponds to the fifth mode, the sound signal corresponding to the silence section is deleted by third processing means.

When it is judged that the present state corresponds to the sixth mode, the compression and expansion processing is performed at a compression rate of $1/n \pm \alpha$ ($\alpha$ is a value of not less than 0 nor more than 1), where n is the set factor of the reproduction speed, by fourth processing means.

The foregoing various means can be used as the section judging means used in the thirteenth to fifteenth voice speed converting systems according to the present invention.

In a sixteenth voice speed converting system according to the present invention, an input sound signal is subjected to voice speed conversion processing by voice speed conversion processing means. An output of the voice speed conversion processing means is written to a ring memory. Data written to the ring memory is read out at predetermined speed. The amount of stored data in the ring memory is calculated on the basis of a write signal and a read signal for the ring memory by stored data amount calculating means.

When the input sound signal corresponds to the silence section, the input sound signal is deleted by the voice speed conversion processing means. When the input sound signal corresponds to the voice section, the input sound signal is subjected to compression and expansion processing at a compression rate determined depending on the amount of stored data in the ring memory which is a compression rate of not less than 1/n, where n is the set factor of the reproduction speed.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 15 to 17 is employed as the processing in the step 9 shown in FIG. 11*a;*

FIGS. 15 to 17 is employed as the processing in the step 9 shown in FIG. 11*a;*

DETAILED DESCRIPTION OF THE PREFERRED EMBODIMENTS

Figure 1:
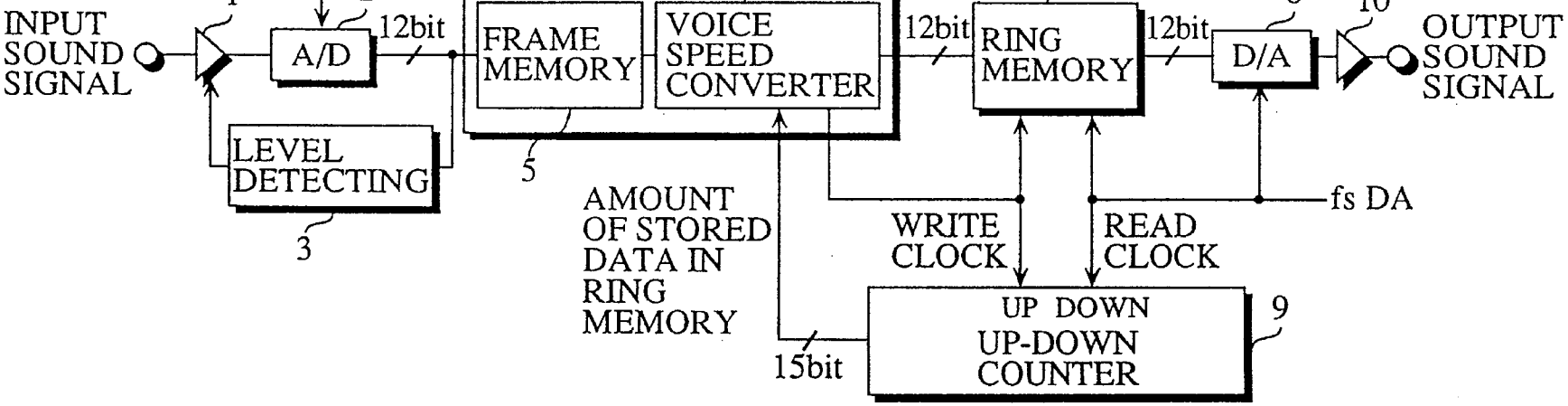
FIG. 1 is a block diagram showing the entire construction of a voice speed converting system according to a first embodiment of the present invention.

Referring now to the drawings, description is made of embodiments in a case where the present invention is applied to a VTR.

Figure 2:
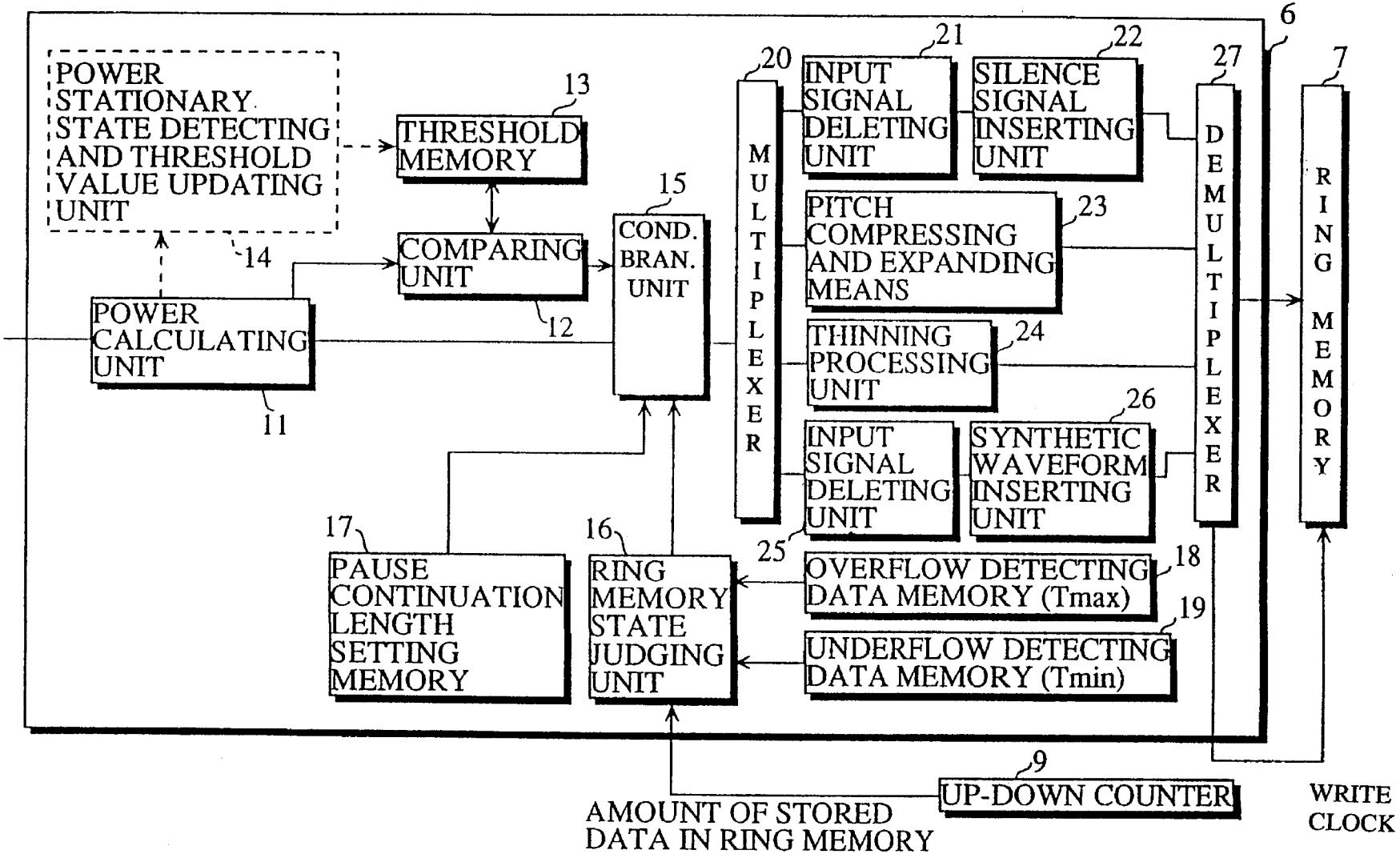
FIG. 2 is a block diagram showing the construction of a voice speed converting section.

FIGS. 1 and 2 show a first embodiment of the present invention. FIG. 1 illustrates the entire construction of a voice speed converting system.

An input sound signal is amplified by an ALC (automatic level control) amplifier 1, after which the amplified input sound signal is sent to an analog-to-digital (A/D) converter 2, in which the input sound signal is converted into a digital signal composed of 12 bits, for example. The standard sampling frequency in the A/D converter 2 is 8 KHz, for example. At the time of reproduction at twice the speed, the sampling frequency fsAD in the A/D converter 2 becomes 16 KHz.

An output of the A/D converter 2 is sent to a DSP (Digital Signal Processor) 4 and a level detecting unit 3. The level detecting unit 3 outputs an ALC signal to the ALC amplifier 1 when the digital signal obtained by A/D conversion in the A/D converter 2 becomes the maximum value of the conversion range. Consequently, the amplification gain of the ALC amplifier 1 is controlled so that the input signal of the A/D converter 2 does not exceed the maximum range.

Specifically, when the reproduction speed of the VTR is changed, the level of the input signal of the ALC amplifier 1 is also changed. Therefore, the amplification gain of the ALC amplifier 1 is automatically adjusted on the basis of the output of the level detecting unit 3 so that the input signal of the A/D converter 2 does not exceed the maximum range.

The DSP 4 comprises a frame memory 5 having a capacity capable of storing sound signals corresponding to two frames and a voice speed converter 6 for subjecting the sound signals stored in the frame memory 5 to voice speed conversion processing for each frame. One frame shall be composed of 200 sampling data.

The sound signals corresponding to one frame stored in one of a first half area and a second half area of the frame memory 5 are subjected to processing by the voice speed converter 6 and at the same time, signals from the A/D converter 2 are stored in the other area. If signals corresponding to one frame are stored in the other area, the signals in the area are subjected to processing by the voice speed converter 6 this time and at the same time, signals from the A/D converter 2 are stored in the one area in which the signals which have been already processed have been stored.

The signal outputted from the voice speed converter 6 is written into a ring memory 7 on the basis of write clocks. The signal written into the ring memory 7 is read out on the basis of read clocks. The signal read out of the ring memory 7 is converted into an analog signal by a digital-to-analog (D/A) converter 8, after which the analog signal is amplified by an amplifier 10 and is outputted as an output sound signal.

The sampling frequency fsDA in the D/A converter 8 is 8 KHz. In addition, the frequency of the read clocks for the ring memory 7 is also 8 KHz. Examples of the ring memory 7 include a ring memory composed of 21845×12 bits, that is, 1845 words. Consequently, the maximum time at which data can be stored in the ring memory 7 (the maximum delay time) is 21845×1/8000=2.73 seconds.

The write clocks for the ring memory 7 are inputted to an input terminal for up-counting (UP) of an up-down counter 9. The read clocks for the ring memory 7 are inputted to an input terminal for down-counting (DOWN) of the up-down counter 9. The up-down counter 9 counts a value obtained by subtracting the total number of inputted read clocks from the total number of inputted write clocks, and outputs the value of the count as a 15-bit digital signal. A value obtained by subtracting the total number of read clocks inputted to the ring memory 7 (the total number of words composing read data) from the total number of write clocks inputted to the ring memory 7 (the total number of words composing written data) is taken as the amount of stored data in the ring memory 7. The output of the up-down counter 9 is sent to the voice speed converter 6.

FIG. 2 illustrates the detailed construction of the voice speed converter 6.

The sound signals read out of the frame memory 5 are sent to a power calculating unit 11, in which an average power value P of the sound signals corresponding to one frame is calculated. Letting the amplitudes of the sampled sound signals in one frame be respectively $i_0, i_1, \ldots, i_{n-1}$ (where N=200), the average power value P is found by the following equation (1):

$$P = (1/N) \times \sum_{k=0}^{k=N-1} (i_k)^2 \tag{1}$$

The average power value P found in the power calculating unit 11 is sent to a comparing unit 12. A threshold value Th is sent from a threshold value memory 13 to the comparing unit 12, in which it is judged whether the average power value P is not less than the threshold value Th (P≧Th) or is less than the threshold value Th (P<Th). The comparing unit 12 respectively outputs a signal indicating that the present frame is in a voice section and a signal indicating that the present frame is in a silence section when the average power value P is not less than the threshold value Th (P≧Th) and when the average power value P is less than the threshold value Th (P<Th).

When the number of quantization bits for the A/D converter 2 is 12, the threshold value Th is set to $2^{12}$, for example. The threshold value Th may be changed in the following manner. Specifically, a power stationary state detecting and threshold value updating unit 14 is provided, as indicated by a dotted line in FIG. 2. The power stationary state detecting and threshold value updating unit 14 judges whether or not the average power value P from the power calculating unit 11 is constant over a predetermined number of frames (for example, 40 frames). When the average power value P is constant (a stationary state), the power stationary state detecting and threshold value updating unit 14 writes a value which is twice the average power value P at that time into the threshold value memory 13 to update the threshold value Th. The maximum value of the threshold value to be updated is restricted to a predetermined value, for example, $2^{14}$. In such a manner, it is possible to treat noises produced in a stationary manner as a silence section.

Furthermore, it may be judged which of a voice section and a silence section corresponds to an input signal on the basis of an accumulated power value Pa of the sound signals in each frame which is expressed by the following equation (2) and a predetermined threshold value:

$$Pa = \sum_{k=0}^{k=N-1} (i_k)^2 \tag{2}$$

An output of the comparing unit 12 is sent to a condition branching unit 15. An output of a ring memory state judging unit 16 is inputted to the condition branching unit 15. In addition, the sound signals from the frame memory 5 are sent to the condition branching unit 15 through the power calculating unit 11. Further, a pause continuation length setting memory 17 is connected to the condition branching unit 15. A pause continuation length Tdel for determining a point at which deletion of a silence section is started is set in the pause continuation length setting memory 17.

The ring memory state judging unit 16 judges that the ring memory 7 enters a state immediately before overflow and the ring memory 7 enters a state immediately before underflow on the basis of the amount of stored data sent from the up-down counter 9.

Specifically, overflow detecting data Tmax and underflow detecting data Tmin are respectively stored in an overflow detecting data memory 18 and an underflow detecting data memory 19. The overflow detecting data Tmax is set to a value 21645 which is smaller than the total number of words (TOTAL) 21845 composing the ring memory 7 by 200. The underflow detecting data Tmin is set to 200, for example.

If the amount of stored data sent from the up-down counter 9 is not less than the overflow detecting data Tmax, a signal for detecting a state immediately before overflow is outputted from the ring memory state judging unit 16. On the other hand, if the amount of stored data sent from the up-down counter 9 is not more than the underflow detecting data Tmin, a signal for detecting a state immediately before underflow is outputted from the ring memory state judging unit 16. The condition branching unit 15 judges that the ring memory 7 is in a state immediately before overflow when the signal for detecting a state immediately before overflow is inputted, while judging that the ring memory 7 is in a state immediately before underflow when the signal for detecting a state immediately before underflow is inputted.

The condition branching unit 15 divides cases into the following six modes on the basis of a signal for discriminating between a voice section and a silence section which is sent from the comparing unit 12, a signal for detecting the state of a ring memory which is sent from the ring memory state judging unit 16, and the pause continuation length Tdel which is set in the pause continuation length setting memory 17. A multiplexer 20 is controlled depending on the modes, to send the sound signals to predetermined processing units.

(1) First Mode (Mode 1)

A case where it is judged that the input sound signal corresponds to the voice section and the ring memory 7 is not in the state immediately before overflow corresponds to a first mode.

In this case, the sound signal is sent to pitch compressing and expanding means 23 through the multiplexer 20. The pitch compressing and expanding means 23 carries out variable speech control (VSC) and subjects the input signal to expansion and compression processing at a compression rate of more than 1/n, where n is the factor of the reproduction speed. Examples of an expanding and compressing method used include a PICOLA (Pointer Interval Control Overlap and Add) method using control of the amount of movement of a pointer and a TDHS (Time Domain Harmonic Scaling) method. The signal which is subjected to the expansion and compression processing in the pitch expanding and compressing means 23 is sent to the ring memory 7 through a demultiplexer 27, and is written into the ring memory 7 in accordance with the write clocks.

At the time of reproduction at twice the speed of the VTR, the sampling frequency fsAD in the A/D converter 2 is 16 KHZ, and the sampling frequency fsDA in the D/A converter 8 is 8 KHZ. Therefore, voice is outputted with the interval thereof being returned to the original one.

In the conventional general time-scale expansion and compression, an input signal is compressed at a compression rate of ½ at the time of reproduction at twice the speed of the VTR. In other words, two pitch cycles are thinned into one pitch cycle. Therefore, the speed of output voice is twice the standard voice speed. That is, the speed of output voice is twice the standard voice speed at the time of normal reproduction at twice the speed. However, the interval becomes the original one.

On the other hand, in the above described pitch expanding and compressing means 23 provided in the voice speed converter 6 shown in FIG. 2, the compression rate is set to a value more than ½. The compression rate shall be set to ⅔. In other words, three pitch cycles are thinned into two pitch cycles. Therefore, the speed of output voice is two-thirds the standard voice speed. Also in this case, the interval remains the original one. If the input signal is compressed at a compression rate of ⅔, the signal is expanded by ⅔−½=⅙, as compared with a case where it is compressed at a compression rate of ½. The amount of expansion becomes the amount of stored data in the ring memory 7.

Figure 3:
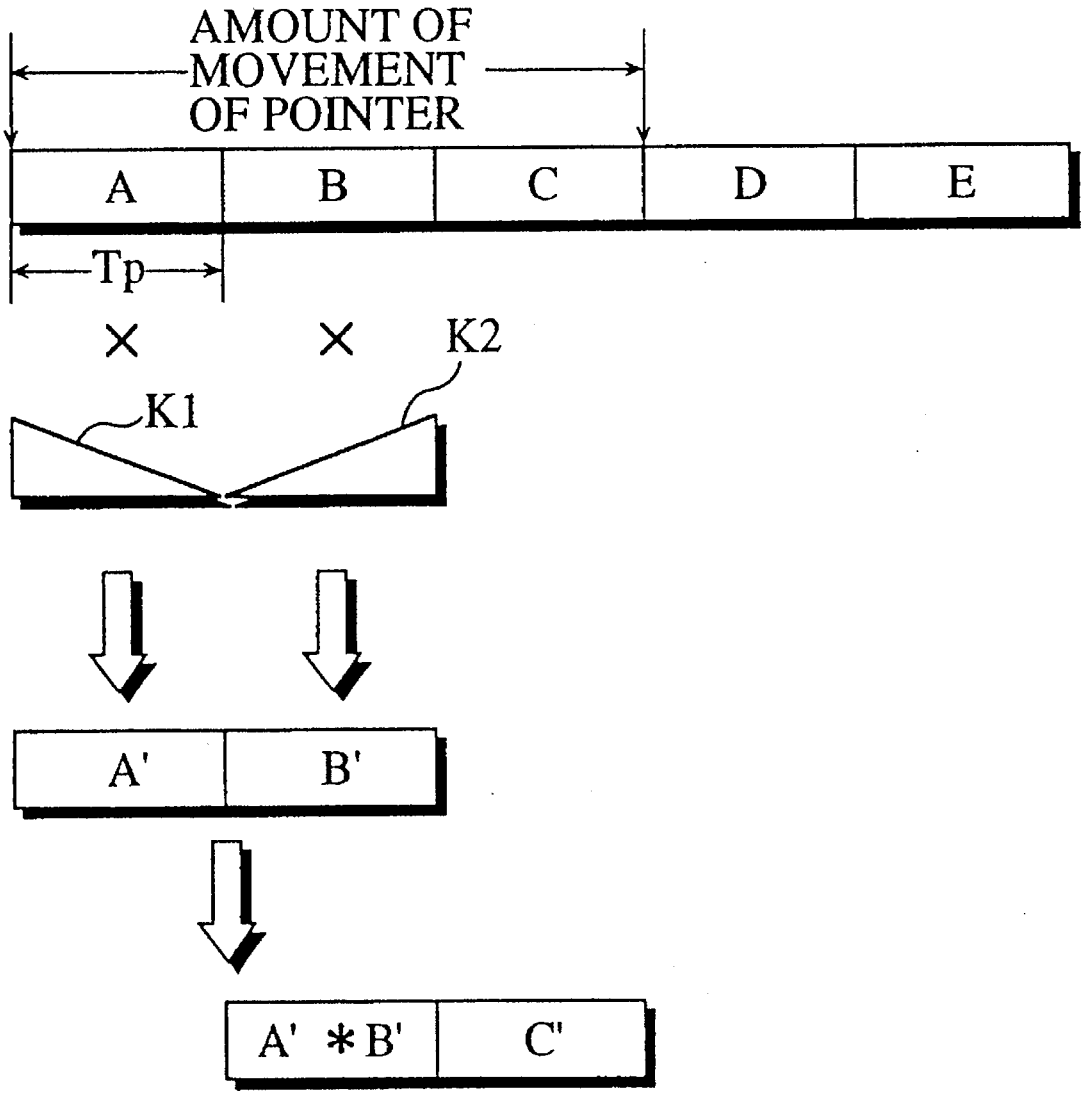
FIG. 3 is an explanatory view showing a method of compressing an input signal at a compression rate of ⅔ using PICOLA.

A method of compressing an input signal at a compression rate of ⅔ using PICOLA will be briefly described with reference to FIG. 3. A pitch cycle is extracted from the input signal. The extracted pitch cycle is taken as Tp. A waveform A is multiplied by a weight changed linearly from 1 to 0 (a weight function K1), to generate a waveform A'. A waveform B is multiplied by a weight changed from 0 to 1 (a weight function K2), to generate a waveform B'.

The waveforms A' and B' are added, to generate a waveform A'* B' having a length Tp. The waveforms A and B are respectively multiplexed by the weights so as to hold continuity in connections ahead of and behind the waveform A'* B'. A pointer is then moved by 3Tp which is a length determined on the basis of the compression rate, to perform the same operation. Therefore, two waveforms A'* B' and C are obtained from three waveforms A, B and C. In such a manner, a signal corresponding to three pitch cycles is compressed into a signal corresponding to two pitch cycles.

Figure 4:
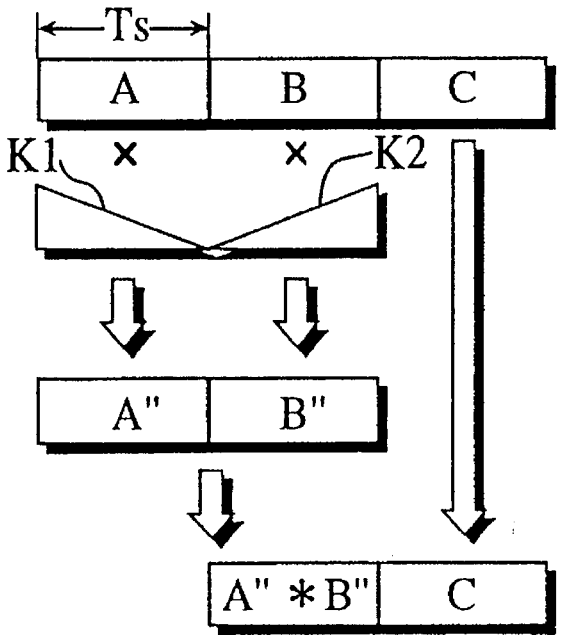
FIG. 4 is an explanatory view showing a method of compressing an input signal at a compression rate of ⅔ for each fixed frame.
Figure 5:
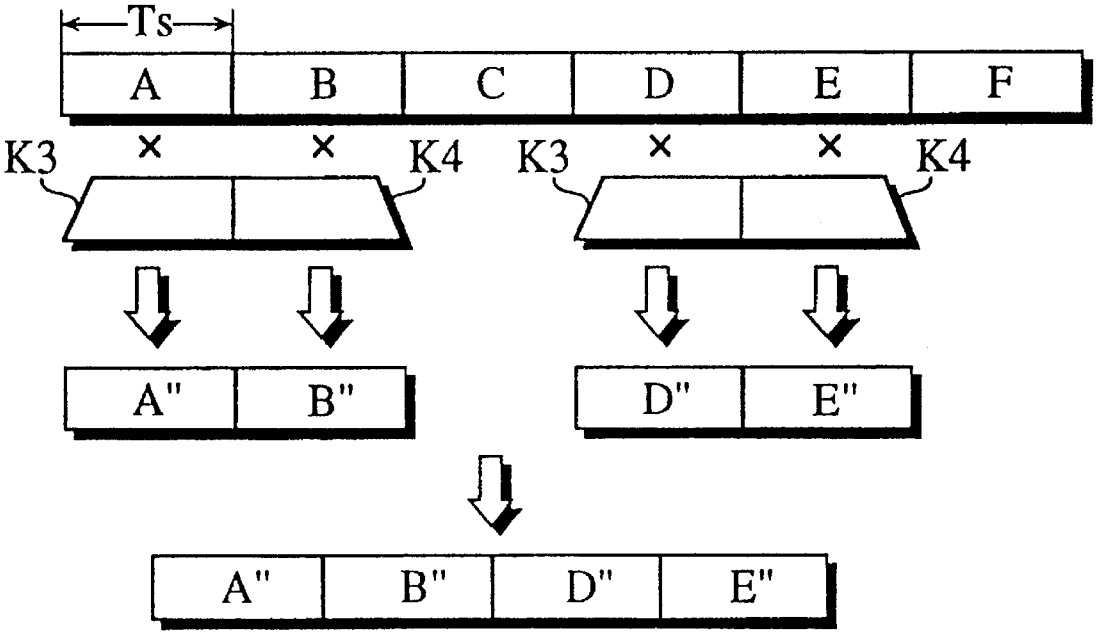
FIG. 5 is an explanatory view showing another method of compressing an input signal at a compression rate of ⅔ for each fixed frame.

As the expanding and compressing method by the pitch expanding and compressing means 23, expansion and compression processing may be performed by the fixed frame length Ts set to a predetermined length without pitch extraction, as shown in FIG. 4 or 5. The fixed frame length Ts is set to a length corresponding to 200 input data, for example. FIG. 4 or 5 illustrates an example in which 3Ts is compressed into 2Ts.

In a method shown in FIG. 4, a waveform A out of waveforms A, B and C each having a fixed frame length Ts is multiplied by a weight linearly changed from 1 to 0 (a weight function K1), to generate a waveform A". The waveform B is multiplied by a weight changed from 0 to 1 (a weight function K2), to generate a waveform B".

The waveforms A" and B" are added, to generate a waveform A"* B" having a length Ts. The waveforms A and B are respectively multiplexed by the weights so as to hold continuity at connections ahead of and behind of the waveform A"* B". The subsequent waveform C is directly outputted. Consequently, the two waveforms A"* B" and C are obtained from the three waveforms A, B and C. In such a manner, a signal corresponding to 3Ts is compressed into a signal corresponding to 2Ts.

In a method shown in FIG. 5, the first to 20-th input data, for example, in a waveform A out of waveforms A, B and C each having a fixed frame length Ts is multiplied by a weight linearly changed from 0 to 1 (a weight function K3), to obtain a waveform A". The 181-th to 200-th input data in the waveform B having a fixed frame length Ts is multiplied by a weight linearly changed from 1 to 0 (a weight function K4), to obtain a waveform B". The waveform C is deleted. The subsequent three waveforms D to F are subjected to the same processing. A signal composed of the three waveforms A to C (or D to F) is compressed into a signal composed of the two waveforms A" and B" (or D" and E"). That is, a signal corresponding to 3Ts is compressed into a signal corresponding to 2Ts.

When the expansion and compression processing for each fixed frame length is used, the amount of processing is reduced, although the quality of sound is deteriorated, as compared with a case where expansion and compression processing for each pitch cycle is used.

If the voice speed converting system is applied to a language learning machine (at the time of reproduction at the standard speed), the sampling frequency fsAD in the A/D converter 2 is 8 KHZ, and the sampling frequency fsDA in the D/A converter 8 is 8 KHZ. In this case, the sound signal is expanded at a compression rate of 3/2 so that two pitch cycles are changed into three pitch cycles, for example, by the pitch compressing and expanding means 23. That is, the voice section is expanded by a factor of 1.5. In this case, therefore, the signal is expanded by 3/2–½, as compared with the time of reproduction at the standard speed. The amount of expansion becomes the amount of stored data in the ring memory 7.

(2) Second Mode (Mode 2)

A case where it is judged that the input sound signal corresponds to the voice section and the ring memory 7 is in the state immediately before overflow corresponds to a second mode.

In this case, the sound signal is sent through the multiplexer 20 to an input signal deleting unit 21, in which the sound signal is deleted. Specifically, a writing operation to the ring memory 7 is stopped until the value of the count by the up-down counter 9 is not more than the underflow detecting data Tmin, that is, until the ring memory 7 enters the state immediately before underflow.

When the ring memory 7 enters the state immediately before underflow, 200 or less, for example, 100 silence signals (signals having a value "0") are outputted from a silence signal inserting unit 22. The silence signals are sent to the ring memory 7 through the demultiplexer 27 and are written thereto. The silence signals are thus written into the ring memory 7 so as to prevent a click sound from being produced at joints of the sound signal ahead of and behind a section in which a sound is deleted.

(3) Third Mode (Mode 3)

A case where it is judged that the input sound signal corresponds to the silence section and the continuation length of the silence section is less than the set pause continuation length Tdel, and the ring memory 7 is not in the state immediately before overflow corresponds to a third mode.

In this case, the same processing as the processing in the above described first mode is performed. In the case corresponding to the third mode, expansion and compression processing may be performed at a compression rate of 1/n, where n is the factor of the reproduction speed. That is, expansion and compression processing is performed at a compression rate of not less than 1/n in the case corresponding to the third mode.

(4) Fourth Mode (Mode 4)

A case where it is judged that the input sound signal corresponds to the silence section and the continuation length of the silence section is less than the set pause continuation length Tdel, and the ring memory 7 is in the state immediately before overflow corresponds to a fourth mode.

In this case, the same processing as the processing in the above described second mode is performed.

(5) Fifth Mode (Mode 5)

A case where it is judged that the input sound signal corresponds to the silence section and the continuation length of the silence section is not less than the set pause continuation length Tdel, and the ring memory 7 is not in the state immediately before underflow corresponds to a fifth mode.

In this case, the sound signal is sent through the multiplexer 20 to an input signal deleting unit 25, in which the sound signal is deleted. Specifically, a writing operation to the ring memory 7 is stopped. However, synthetic waveform insertion processing is performed by a synthetic waveform inserting unit 26 so as to prevent a start portion of the voice section (the voiceless section) from being dropped and prevent a click sound from being produced at joints of the sound signal ahead of and behind a section in which a sound is deleted.

The synthetic waveform insertion processing performed by the synthetic waveform inserting unit 26 will be described with reference to FIG. 6 or FIG. 7. In a method shown in FIG. 6, the synthetic waveform inserting unit 26 comprises a first memory 31 and a second memory 32. At the time of starting the input signal deletion processing performed by the input signal deleting unit 25, input signals corresponding to a predetermined length Ts which is not more than the length of one frame, for example, input signals corresponding to the length of one frame are sequentially stored in the order of addresses in the first memory 31 from a starting point of a section in which input signal deletion processing is performed. The content A of the first memory 31 is then multiplexed by a function K1 linearly changed from 1 to 0 with increasing addresses in the first memory 31. The result of the multiplication A' is written into the first memory 31 again.

Furthermore, input signals corresponding to a predetermined length Ts just short of an ending point of the section in which input signal deletion processing is performed by the input signal deleting unit 25 are sequentially stored in the order of addresses in the second memory 32. The content B of the second memory 32 is multiplexed by a function K2 linearly changed from 0 to 1 with increasing addresses in the second memory 32. The result of the multiplication B' is written into the second memory 32 again. Thereafter, the content A' of the first memory 31 and the content B' of the second memory 32 are added, to obtain data A'* B' having a predetermined length Ts. The obtained data A'* B' having a predetermined length Ts is sent to the ring memory 7 through the demultiplexer 27 and is written into the ring memory 7.

Figure 7:
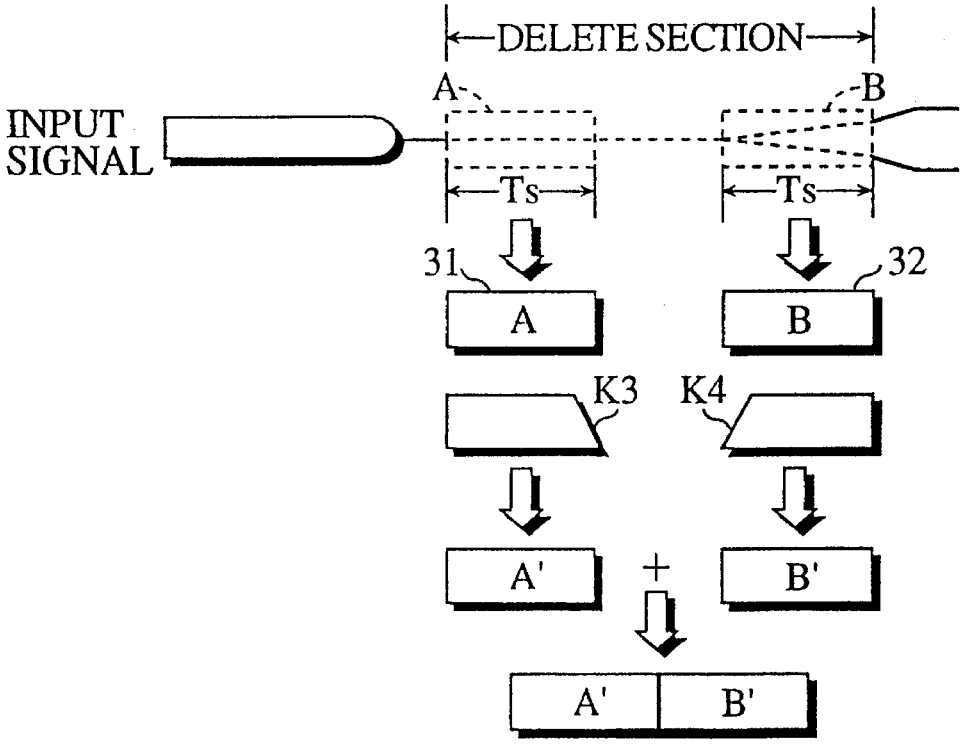
FIG. 7 is an explanatory view for explaining another example of the method of synthesizing waveforms by the synthetic waveform processing unit.

In a method shown in FIG. 7, input signals corresponding to a predetermined length Ts which is not more than the length of one frame, for example, input signals corresponding to the length of one frame are sequentially stored in the order of addresses in the first memory 31 from a starting point of a section in which input signal deletion processing is performed. The content A of the first memory 31 is then multiplexed by a function K3 with a slope linearly changed from 1 to 0 in its rear end. The result of the multiplication A' is written into the first memory 31 again.

Furthermore, input signals having a predetermined length Ts just short of an ending point of the section in which input signal deletion processing is performed by the input signal deleting unit 25 are sequentially stored in the order of addresses in the second memory 32. The content B of the second memory 32 is multiplexed by a function K4 with a slope linearly changed from 0 to 1 in its front end. The result of the multiplication B' is written into the second memory 32 again. Thereafter, the content A' of the first memory 31 and the content B' of the second memory 32 are connected, to obtain data A'+B' corresponding to 2Ts. The obtained data A'+B' corresponding to 2Ts is sent to the ring memory 7 through the demultiplexer 27 and is written into the ring memory 7. Although an example in which Ts is the length of one frame is illustrated in FIG. 7, Ts may be a length which is half of the length of one frame.

The ring memory 7 may, in some cases, enter the state immediately before underflow in a case where the input signal deletion processing performed by the input signal deleting unit 25 is repeated. In this case, input signals corresponding to a predetermined length Ts are stored in the second memory 32 from the time point where the ring memory 7 enters the state immediately before underflow. The same synthetic waveform insertion processing as described above is performed on the basis of the data stored in the first memory 31 and the data stored in the second memory 32.

(6) Sixth Mode (Mode 6)

A case where it is judged that the input sound signal corresponds to the silence section and the continuation length of the silence section is not less than the set pause continuation length Tdel, and the ring memory 7 is in the state immediately before underflow corresponds to a sixth mode.

In this case, the input signal is sent to a thinning processing unit 24 through the multiplexer 20. In the thinning processing unit 24, thinning processing is performed so that the compression rate becomes 1/n, where n is the factor of the reproduction speed of the VTR. For example, the input signal is thinned at a compression rate of ½ at the time of reproduction at twice the speed, and the input signal is thinned at a compression rate of ⅓ at the time of reproduction at three times the speed. The input signal is directly outputted at the time of reproduction at the standard speed.

As 1/n thinning processing performed by the thinning processing unit 24, the following method is used. Description is made by taking as an example the time of reproduction at twice the speed.

The pitch of the input signal is extracted using the above described time-scale compressing method such as PICOLA or TDHS, to thin a pitch data portion of the input signal so that the compression rate becomes ½.

Figure 8:
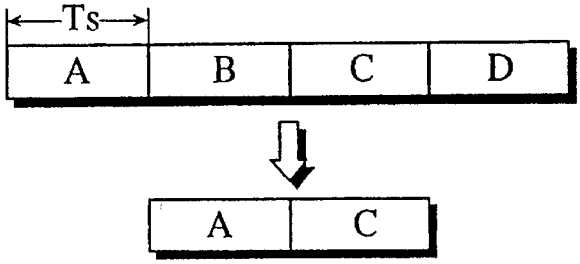
FIG. 8 is an explanatory view for explaining a method of thinning processing performed by a thinning processing unit.
Figure 9:
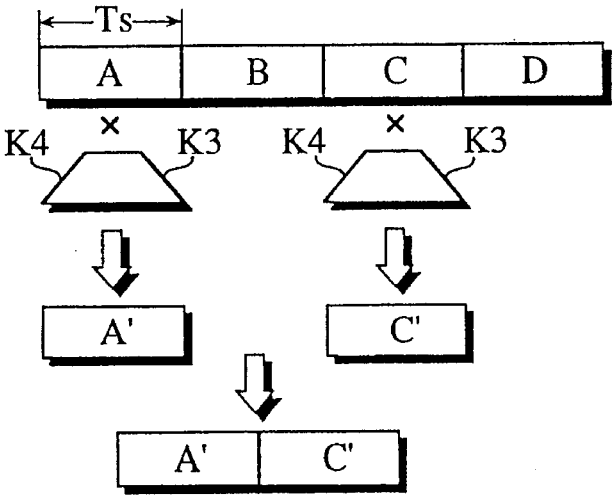
FIG. 9 is an explanatory view for explaining another example of the method of thinning processing performed by the thinning processing unit.
Figure 10:
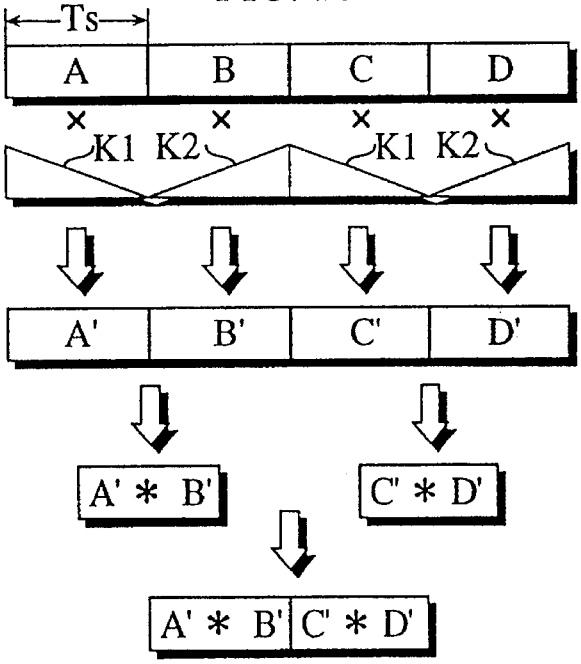
FIG. 10 is an explanatory view for explaining still another example of the method of thinning processing performed by the thinning processing unit.

As shown in FIGS. 8, 9 and 10, waveforms may be thinned for each predetermined time Ts without pitch extraction.

In a method shown in FIG. 8, a waveform B and a waveform D out of waveforms A to D are thinned, to obtain a signal composed of the waveforms A and C.

In a method shown in FIG. 9, a waveform B and a waveform D out of waveforms A to D are thinned. In addition, the waveform A is multiplexed by a function with a slope raised from 0 to 1 (a function K4) in its front end and a slope lowered from 1 to 0 (a function K3) in its rear end, to generate a waveform A'. In addition, the waveform C is multiplexed by a function with a slope raised from 0 to 1 (a function K4) in its front end and a slope lowered from 1 to 0 (a function K3) in its rear end, to generate a waveform C'. In such a manner, a signal composed of the four waveforms A to D is compressed into a signal composed of the two waveforms A' and C'.

In a method shown in FIG. 10, a waveform A is multiplied by a weight linearly changed from 1 to 0 (a weight function K1), to generate a waveform A'. A waveform B is multiplied by a weight changed from 0 to 1 (a weight function K2), to generate a waveform B'. The waveforms A' and B' are added, to generate a waveform A'* B' having a length Ts.

Similarly, a waveform C is multiplied by a weight linearly changed from 1 to 0 (a function K1), to generate a waveform C'. A waveform D is multiplied by a weight changed from 0 to 1 (a function K2), to generate a waveform D'. The waveforms C' and D' are added, to generate a waveform C'* D having a length Ts. In such a manner, a signal composed of the four waveforms A to D is compressed into a signal composed of the two waveforms A'* B' and C'* D'.

Although in the case corresponding to the sixth mode, the thinning processing is performed at a compression rate of 1/n, where n is the factor of the reproduction speed, as described above, the compression rate may be controlled in the following manner.

When the thinning processing is performed at a compression rate of 1/n, the ratio fsDA/fsAD of the sampling frequency fsDA in the D/A converter 8 to the sampling frequency fsAD in the A/D converter 2 is equal to the compression rate 1/n, the amount of stored data in the ring memory 7 is not changed. However, the ratio fsDA/fsAD may not, in some cases, be equal to the compression rate 1/n depending on the precision of operation at a compression rate 1/n and the clock precision of the sampling frequencies fsAD and fsDA.

When the ratio fsDA/fsAD is more than the compression rate 1/n (fsDA/fsAD>1/n), the compression rate is decreased by {(1/a)−(1/n)} letting fsDA/fsAD=1/a (a>0), whereby the degree of thinning is increased. Consequently, the amount of stored data in the ring memory 7 is decreased, so that the ring memory 7 is liable to underflow.

On the other hand, when the ratio fsDA/fsAD is less than the compression rate 1/n (fsDA/fsAD<1/n), the compression rate is increased by {(1/n)−(1/a)} letting fsDA/fsAD=1/a (a>0), whereby the degree of thinning is decreased. Consequently, the amount of stored data in the ring memory 7 is increased.

When the thinning processing is performed, therefore, the amount of stored data in the ring memory 7 is confirmed, to control the compression rate in the following manner. $\alpha$ satisfying the condition of $(1/n)-\alpha<1/a<(1/n)+\alpha$ is selected letting fsDA/fsAD=1/a (a>0), where $\alpha$ is a value which is not less than 0 nor more than 1, for example, a value in the range of 0.001 to 0.1.

When the ratio fsDA/fsAD is more than the compression rate 1/n, that is, the amount of stored data in the ring memory 7 is decreased, the compression rate is changed from 1/n to $\{(1/n)+\alpha\}$. That is, the compression rate is increased, to increase the amount of stored data in the ring memory 7.

When the ratio fsDA/fsAD is less than the compression rate 1/n, that is, the amount of stored data in the ring memory 7 is increased, the compression rate is changed from 1/n to $\{(1/n)-\alpha\}$. That is, the compression rate is decreased, to decrease the amount of stored data in the ring memory 7.

Although the compression rate is changed on the basis of the amount of stored data in the ring memory 7, the compression rate may be alternately changed to $\{(1/n)-\alpha\}$ and $\{(1/n)+\alpha\}$ each frame if the thinning processing is performed.

Figure 11A:
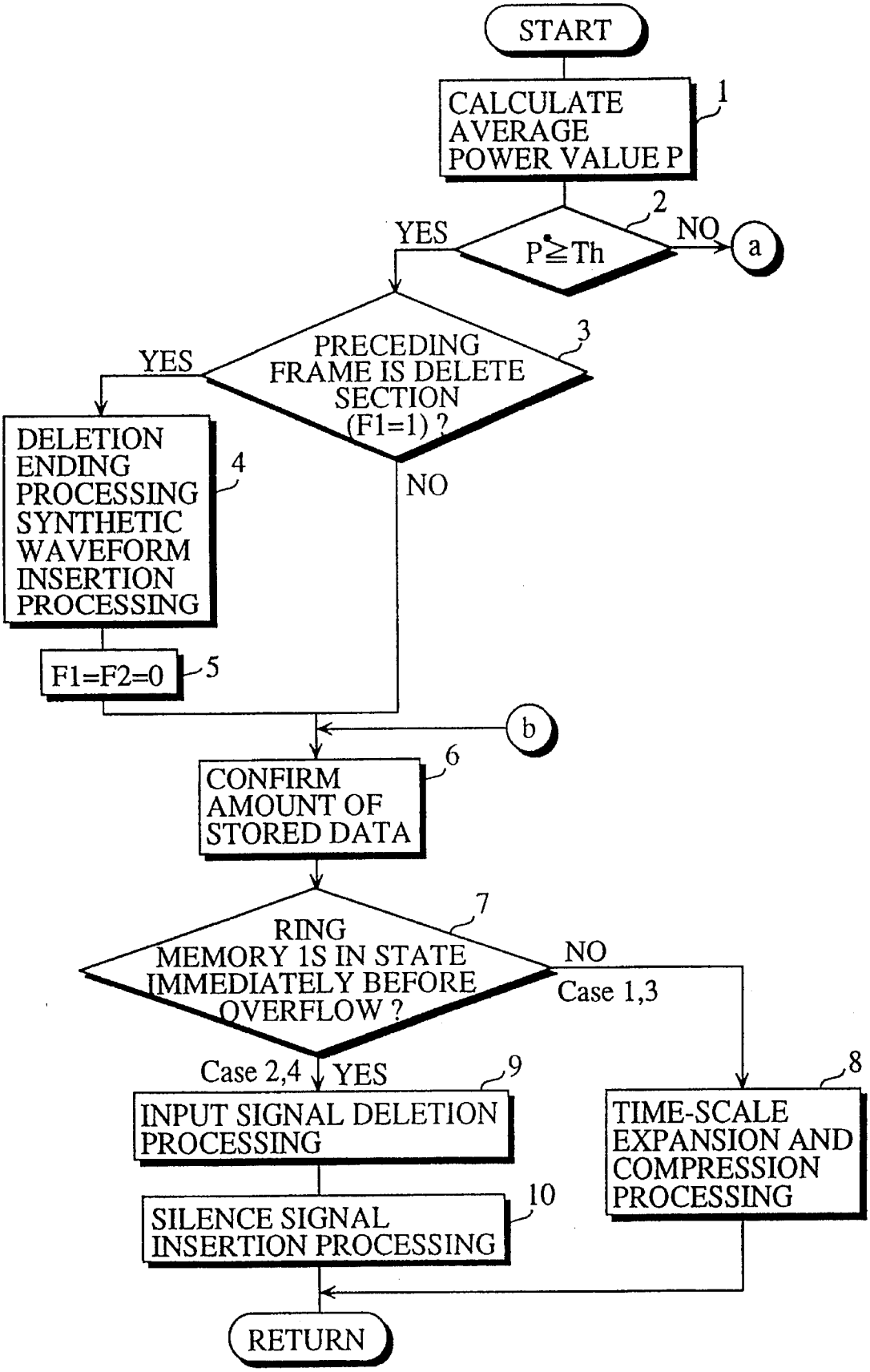
FIGS. 11*a* and 11*b* are flow charts showing the procedure for processing performed by a voice speed converter.
Figure 11B:
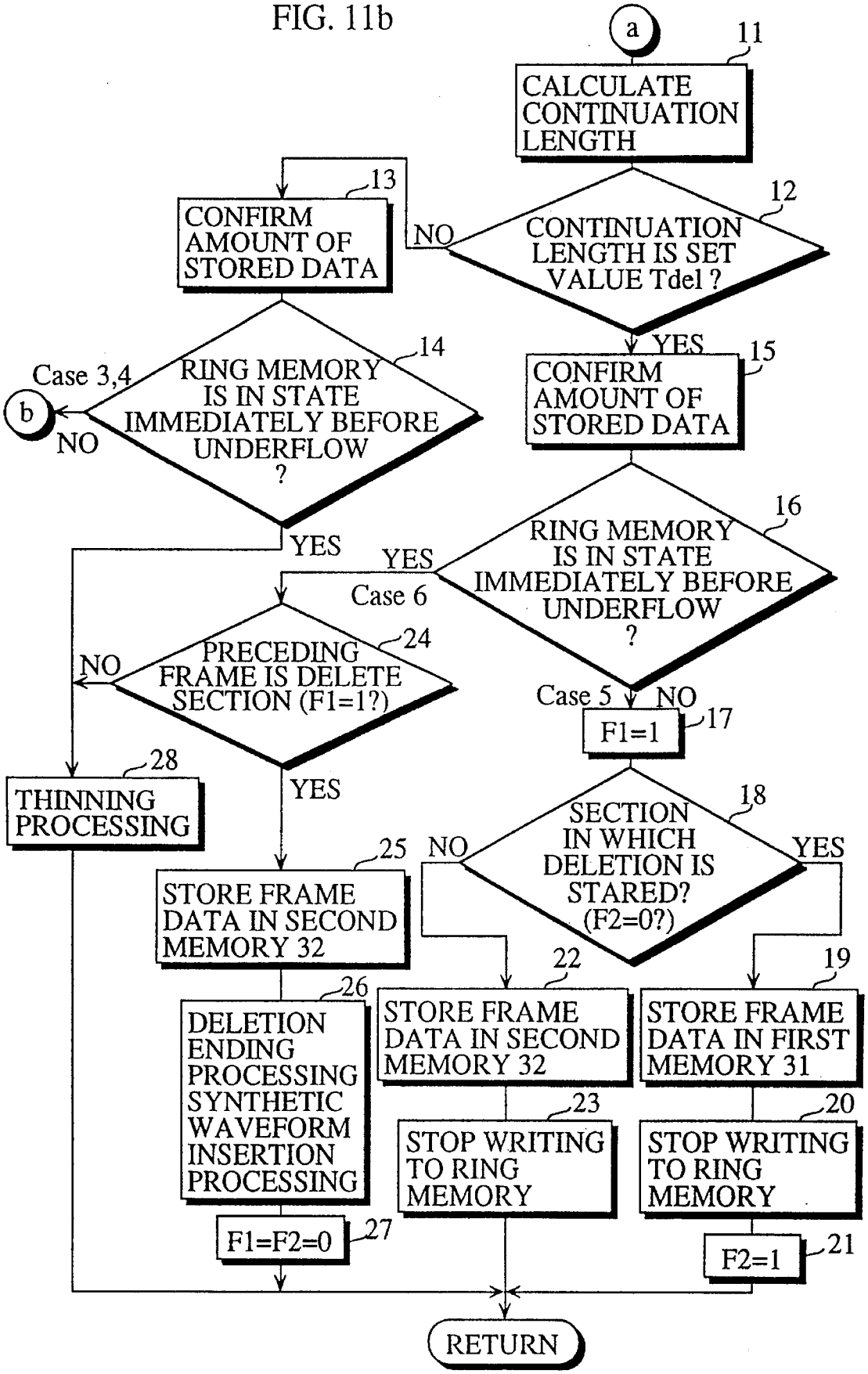

FIGS. 11*a* and 11*b* show the procedure for processing performed by the voice speed converter 6.

Description is now made of the processing performed by the voice speed converter 6 at the time of reproduction at twice the speed of the VTR.

(1) Processing at the time of starting reproduction

If the average power value P in the first frame is calculated by the power calculating unit 11 (step 1) after the start of the reproduction, it is judged whether or not the calculated average power value P is not less than the threshold value Th on the basis of the output of the comparing unit 12 (step 2).

When the input sound signal corresponds to the silence section at the time of starting the reproduction, the average power value P is less than the threshold value Th in the first frame, after which the program proceeds to the step 11. The continuation length of the silence section is calculated, to judge whether or not the calculated continuation length is not less than the pause continuation length Tdel set in the pause continuation length memory 17 (step 12). This pause continuation length Tdel is set to a length corresponding to four frames, for example.

In the processing for the first frame, the continuation length of the silence section is less than the pause continuation length Tdel, whereby it is judged whether or not the ring memory 7 is in the state immediately before underflow on the basis of the output of the ring memory state judging unit 16 (steps 13 and 14).

In the processing for the first frame, the ring memory 7 is in the state immediately before underflow, whereby frame data are thinned at a compression rate of ½ by the thinning processing unit 24 (step 28), and the compressed data after the thinning processing are written into the ring memory 7, after which the program is returned to the step 1.

(2) Description of processing in the case corresponding to the first mode

When it is judged in the step 2 that the average power value P is not less than the threshold value Th, it is judged that the present frame corresponds to the voice section, after which the program proceeds to the step 3. It is judged in the step 3 whether or not the preceding frame corresponds to the section in which input signal deletion processing is performed on the basis of the state of a first flag F1. If the preceding frame does not correspond to the section in which input signal deletion processing is performed, it is judged whether or not the ring memory 7 is in the state immediately before overflow on the basis of the output of the ring memory state judging unit 16 (steps 6 and 7). If the preceding frame corresponds to the section in which input signal deletion processing is performed, processing in the steps 4 and 5 is performed, after which it is judged whether or not the ring memory 7 is in the state immediately before overflow (steps 6 and 7). The processing in the steps 4 and 5 will be described later.

A case where it is judged in the step 7 that the ring memory 7 is not in the state immediately before overflow corresponds to the first mode, in which the present frame data are subjected to time-scale compression at a compression rate of ⅔ by the pitch compressing and expanding means 23 (step 8). The compressed data are sent to the ring memory 7 and is written thereto, after which the program is returned to the step 1.

(3) Description of processing in the case corresponding to the second mode

When it is judged in the step 2 that the average power value P is not less than the threshold value Th, it is judged that the present frame corresponds to the voice section, after which the program proceeds to the step 3. It is judged in the step 3 whether or not the preceding frame corresponds to the section in which input signal deletion processing is performed on the basis of the state of the first flag F1. If the preceding frame does not correspond to the section in which input signal deletion processing is performed, it is judged whether or not the ring memory 7 is in the state immediately before overflow on the basis of the output of the ring memory state judging unit 16 (steps 6 and 7). If the preceding frame corresponds to the section in which input signal deletion processing is performed, the processing in the steps 4 and 5 is performed, after which it is judged whether or not the ring memory 7 is in the state immediately before overflow (steps 6 and 7). The processing in the steps 4 and 5 will be described later.

A case where it is judged in the step 7 that the ring memory 7 is in the state immediately before overflow corresponds to the second mode, in which the input signal is deleted by the input signal deleting unit 21 until an underflow detecting signal is outputted from the ring memory state judging unit 16 (step 9). That is, the writing to the ring memory 7 is stopped until the ring memory 7 enters the state immediately before underflow.

If the ring memory 7 enters the state immediately before underflow, a predetermined number of (not more than 200) silence signals "0" are written into the ring memory 7 by the silence signal inserting unit 22 (step 10), after which the program is returned to the step 1.

Figure 13:
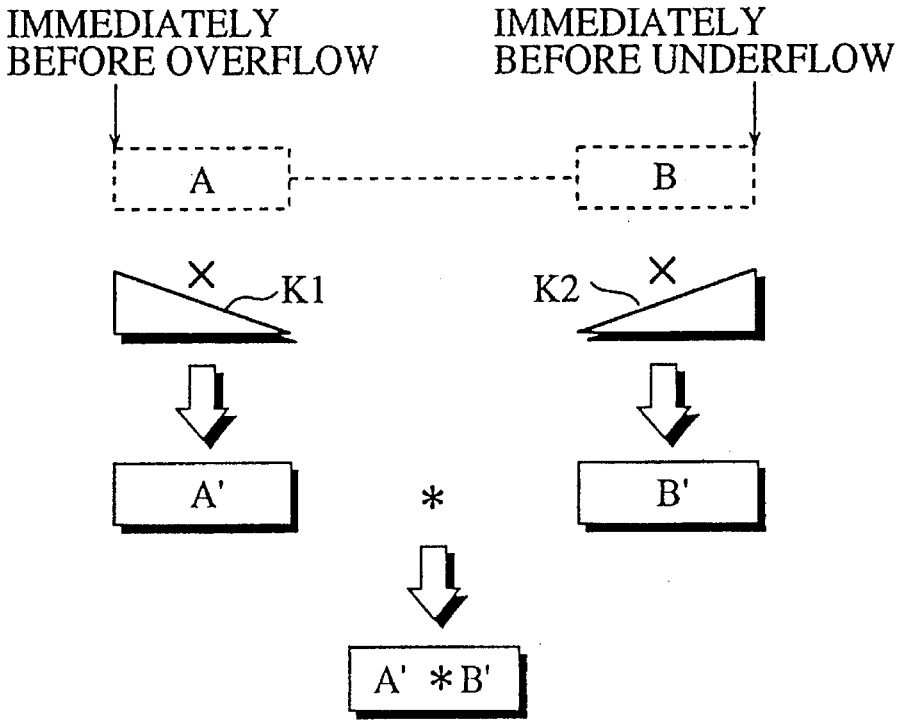
FIG. 13 is an explanatory view for explaining processing which can replace the processing in step 10 shown in FIG. 11*a;*
Figure 14:
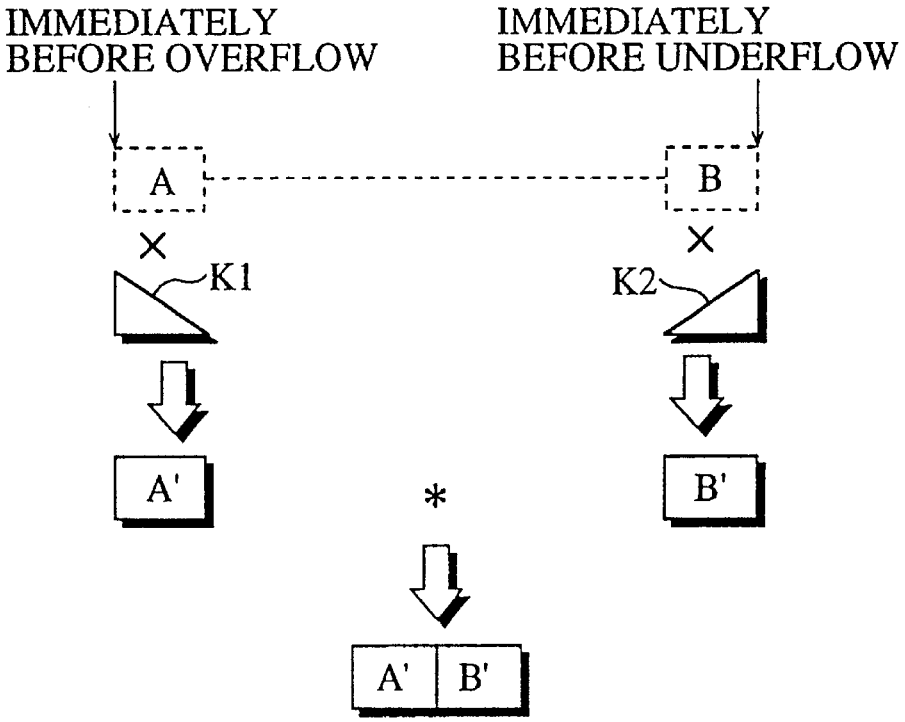
FIG. 14 is an explanatory view for explaining another example of processing which can replace the processing in the step 10 shown in FIG. 11*a;*

The processing in the step 10 is replaced with processing as shown in FIGS. 13 and 14. Description is made of a method shown in FIG. 13. A waveform A corresponding to 200 input signals, for example, from the time point where it is judged in the step 7 that the ring memory 7 is in the state immediately before overflow is multiplied by a weight linearly changed from 1 to 0 (a weight function K1), to obtain a waveform A'. In addition, a waveform B corresponding to 200 input signals short of the time point immediately before underflow is multiplied by a weight changed from 0 to 1 (a weight function K2), to obtain a waveform B'.

The two waveforms A' and B' obtained are added, to generate a waveform A'* B' having a length corresponding to 200 input signals. The 200 signals corresponding to the waveform A'* B' are written into the ring memory 7. The time point 200 input signals short of the time point immediately before underflow is detected on the basis of the value of the count by the up-down counter 9. Consequently, it is possible to effectively prevent a click sound from being produced at joints of the sound signal ahead of and behind a section in which a sound is deleted.

Description is now made of a method shown in FIG. 14. A waveform A corresponding to 100 input signals, for example, from the time point where it is judged in the step 7 that the ring memory 7 is in the state immediately before overflow is multiplied by a weight linearly changed from 1 to 0 (a weight function K1), to obtain a waveform A'. In addition, a waveform B corresponding to 100 input signals short of the time point immediately before underflow is multiplexed by a weight changed from 0 to 1 (a weight function K2), to obtain a waveform B'. The 200 signals corresponding to the obtained two waveforms A' and B' connected are written into the ring memory 7.

When it is judged that the ring memory 7 is in the state immediately before overflow, the input signals are deleted by the input signal deleting unit 21 until the underflow detecting signal is outputted from the ring memory state judging unit 16 in the foregoing step 9. However, data stored in the ring memory 7 may be deleted so that the ring memory 7 enters the state immediately before underflow.

Figure 15:
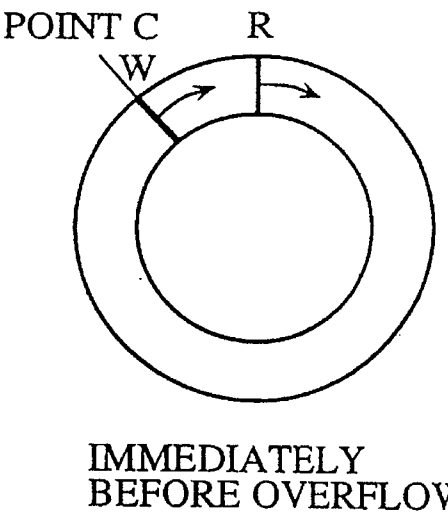
FIGS. 15 to 17 are explanatory views for explaining processing which can replace the processing in the step 9 shown in FIG. 11*a;*
Figure 16:
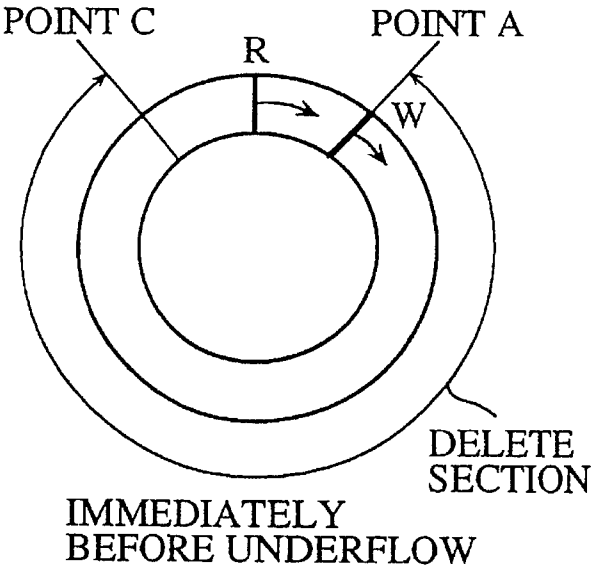
Figure 17:
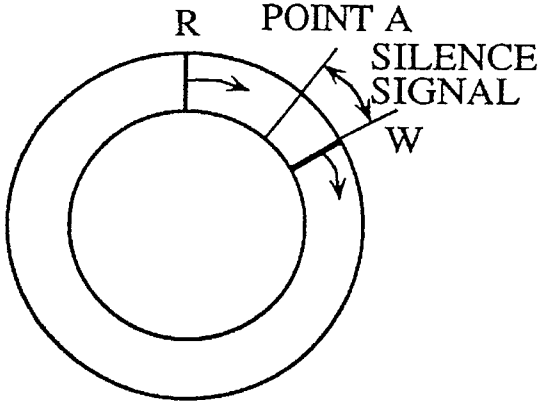

Specifically, a write start address in the ring memory 7 is jumped from an address at which the ring memory 7 is in the state immediately before overflow (point C) shown in FIG. 15 to an address at which the ring memory 7 enters the state immediately before underflow (point A) shown in FIG. 16. In the processing shown in the step 9, therefore, data stored in addresses from the point A to the point C are deleted. Thereafter, the silence signals are written into the ring memory 7 in the step 10, as shown in FIG. 17, after which input data are written thereto.

If in the step 9, the data stored in the ring memory 7 are deleted so that the ring memory 7 enters the state immediately before underflow as described above, processing as shown in FIGS. 18 and 19 may be performed instead of writing the silence signals into the ring memory 7 in the step 10.

Figure 18:
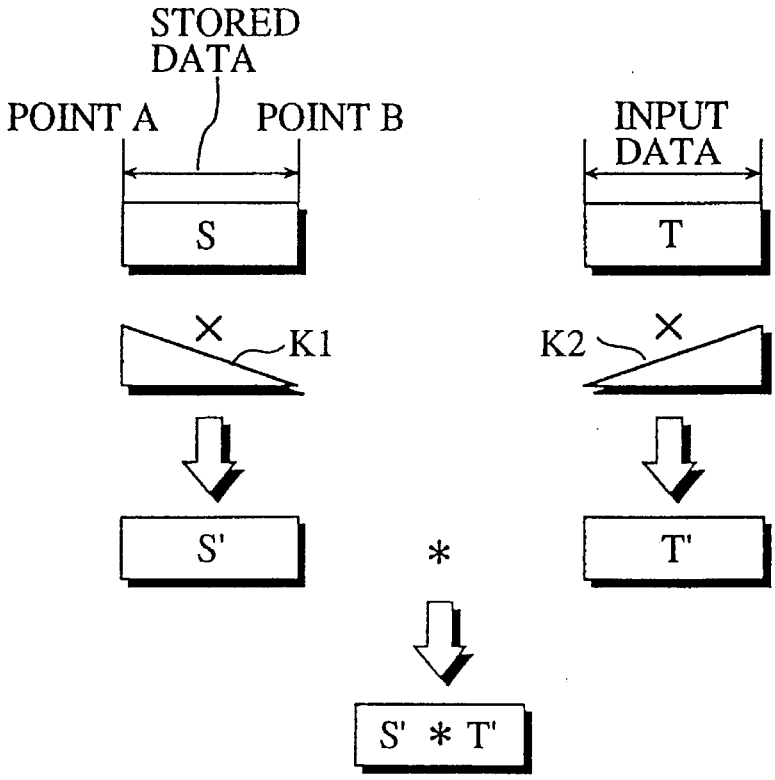
FIG. 18 is an explanatory view for explaining processing which can replace the processing in the step 10 shown in FIG. 11*a* in a case where the processing explained using

It is assumed that the write start address in the ring memory 7 is jumped from the address at which the ring memory 7 is in the state immediately before overflow (point C) shown in FIG. 15 to the address at which the ring memory 7 enters the state immediately before underflow (point A) shown in FIG. 16. Data S stored from the point A to an address a predetermined number of, for example, 200 addresses ahead of the point A (point B in FIG. 18) are multiplied by a weight linearly changed from 1 to 0 (a weight function K1), to obtain a waveform S', as shown in FIG. 18. Further, 200 input data (a waveform T) thereafter written into the ring memory 7 are multiplied by a weight changed from 0 to 1 (a weight function K2), to obtain a waveform T', as shown in FIG. 18.

The two waveforms S' and T' are added, to generate a waveform S'* T' having a length corresponding to 200 data. 200 signals corresponding to the waveform S'* T' are written into the ring memory 7 from the point A. Consequently, it is possible to effectively prevent a click sound from being produced at joints of the sound signal ahead of and behind a section in which stored data are deleted.

Figure 19:
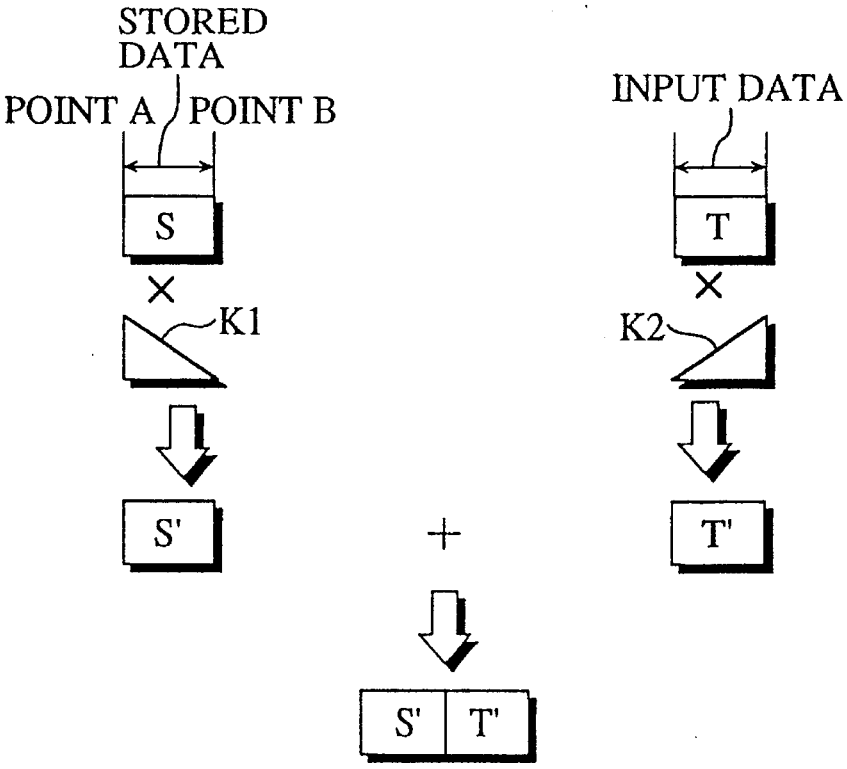
FIG. 19 is an explanatory view for explaining another example of processing which can be replaced with the processing in the step 10 shown in FIG. 11*a* in a case where the processing explained using

Description is now made of a method shown in FIG. 19. Data S stored from a point A shown in FIG. 19 to an address a predetermined number of, for example, 100 addresses ahead of the point A (point B in FIG. 19) are multiplied by a weight linearly changed from 1 to 0 (a weight function K1), to obtain a waveform S'. In addition, 100 input data (a waveform T) thereafter written into the ring memory 7 are multiplied by a weight changed from 0 to 1 (a weight function K2), to obtain a waveform T'. 200 signals corresponding to the obtained two waveforms S' and T' connected are written into the ring memory 7 from the point A.

(4) Description of processing in the case corresponding to the third mode

When it is judged in the step 2 that the average power value P is less than the threshold value Th, the continuation length of the silence section up to this time is calculated (step 11), and it is judged whether or not the calculated continuation length is not less than the pause continuation length Tdel set in the pause continuation length memory 17 (step 12). If it is judged that the continuation length of the silence section is less than the pause continuation length Tdel, it is judged whether or not the ring memory 7 is in the state immediately before underflow on the basis of the output of the ring memory state judging unit 16 (steps 13 and 14).

When the ring memory 7 is not in the state immediately before underflow, it is judged whether or not the ring memory 7 is in the state immediately before overflow on the basis of the output of the ring memory state judging unit 16 (steps 6 and 7). A case where the ring memory 7 is not in the state immediately before overflow corresponds to the third mode, in which the present frame data are subjected to time-scale compression at a compression rate of ⅔ by the pitch compressing and expanding means 23 (step 8). The compressed data are sent to the ring memory 7 and is written thereto, after which the program is returned to the step 1.

(5) Description of processing in the case corresponding to the fourth mode

When it is judged in the step 2 that the average power value P is less than the threshold value Th, the continuation length of the silence section up to the present time is calculated (step 11), and it is judged whether or not the calculated continuation length is not less than the pause continuation length Tdel set in the pause continuation length memory 17 (step 12). If it is judged that the continuation length of the silence section is less than the pause continuation length Tdel, it is judged whether or not the ring memory 7 is in the state immediately before underflow on the basis of the output of the ring memory state judging unit 16 (steps 13 and 14).

When the ring memory 7 is not in the state immediately before underflow, it is judged whether or not the ring memory 7 is in the state immediately before overflow on the basis of the output of the ring memory state judging unit 16 (steps 6 and 7). A case where the ring memory 7 is in the state immediately before overflow corresponds to the fourth mode, in which the input signal is deleted by the input signal deleting unit 21 until the underflow detecting signal is outputted from the ring memory state judging unit 16 (step 9). That is, the writing to the ring memory 7 is interrupted until the ring memory 7 enters the state immediately before underflow.

If the ring memory 7 enters the state immediately before underflow, a predetermined number of (not more than 200) silence signals "0" are written into the ring memory 7 by the silence signal inserting unit 22 (step 10), after which the program is returned to the step 1.

(6) Description of processing in the case corresponding to the fifth mode

When it is judged in the step 2 that the average power value P is less than the threshold value Th, the continuation length of the silence section up to the present time is calculated (step 11), and it is judged whether or not the calculated continuation length is not less than the pause continuation length Tdel set in the pause continuation length memory 17 (step 12). If it is judged that the continuation length of the silence section is not less than the pause continuation length Tdel, it is judged whether or not the ring memory 7 is in the state immediately before underflow on the basis of the output of the ring memory state judging unit 16 (steps 15 and 16).

A case where the ring memory 7 is not in the state immediately before underflow corresponds to the fifth mode, in which a first flag F1 indicating that the present frame is in the section in which input signal deletion processing is performed by the input signal deleting unit 25 is set (step 17). The first flag F1 is reset (F1=0) in initialization at the time of turning the power supply on. It is judged whether or not a second flag F2 indicating that the present frame is the first frame in the section in which input signal deletion processing is performed by the input signal deleting unit 25 (step 18).

The second flag F2 is reset (F2=0) in initialization at the time of turning the power supply on. The second flag F2 is set (F2=1) when processing for the first frame in the section in which input signal deletion processing is performed by the input signal deleting unit 25 is terminated. When a series of processing for the section in which input signal deletion processing is performed by the input signal deleting unit 25 is terminated, the second flag F2 is reset (F2=0).

When the present frame is the first frame in the section in which input signal deletion processing is performed by the input signal deleting unit 25, therefore, the second flag F2 is reset (F2=0). When the second flag F2 is reset, the present frame data are stored in the first memory 31 by the synthetic waveform inserting unit 26 (step 19). In addition, the writing of the present frame data to the ring memory 7 is stopped by the input signal deleting unit 25 (step 20). That is, the present frame data are deleted. The second flag F2 is set (F2=1) (step 21), after which the program is returned to the step 1.

Furthermore, when the silence section is continued, the program proceeds through the steps 2, 11, 12 and 15 to the step 16, in which it is judged whether or not the ring memory 7 is in the state immediately before underflow on the basis of the output of the ring memory state judging unit 16.

When the ring memory 7 is not in the state immediately before underflow, the first flag F1 indicating that the present frame is in the section in which input signal deletion processing is performed by the input signal deleting unit 25 is set (step 17). It is judged whether or not the second flag F2 indicating whether or not the present frame is the first frame in the section in which input signal deletion processing is performed by the input signal deleting unit 25 is reset (step 18).

In this case, the second flag F2 is set (F2=1), whereby it is judged that the present frame is not the first frame in the section in which input signal deletion processing is performed by the input signal deleting unit 25. In this case, the present frame data are stored in the second memory 32 by the synthetic waveform inserting unit 26 (step 22). In addition, the writing of the present frame data to the ring memory 7 is stopped by the input signal deleting unit 25 (step 23), after which the program is returned to the step 1.

When the silence section is further continued and the ring memory 7 is not in the state immediately before underflow, the processing in the steps 2, 11, 12, 15, 16, 17, 18, 22 and 23 is repeated. Specifically, the frame data in the second memory 32 are updated, and the writing of the frame data to the ring memory 7 is stopped.

Thereafter, when the frame data corresponding to the voice section are inputted, the average power value P is not less than the threshold value Th in the step 2, whereby it is judged whether or not the preceding frame is in the section in which input signal deletion processing is performed by the input signal deleting unit 25 on the basis of the state of the first flag F1 (step 3). In this case, the first flag F1 is set (F1=1), whereby it is judged that the preceding frame is in the section in which input signal deletion processing is performed by the input signal deleting unit 25, after which the program proceeds to the step 4. In the step 4, the deletion processing performed by the input signal deleting unit 25 is stopped, and the synthetic waveform insertion processing is performed by the synthetic waveform inserting unit 26.

Figure 6:
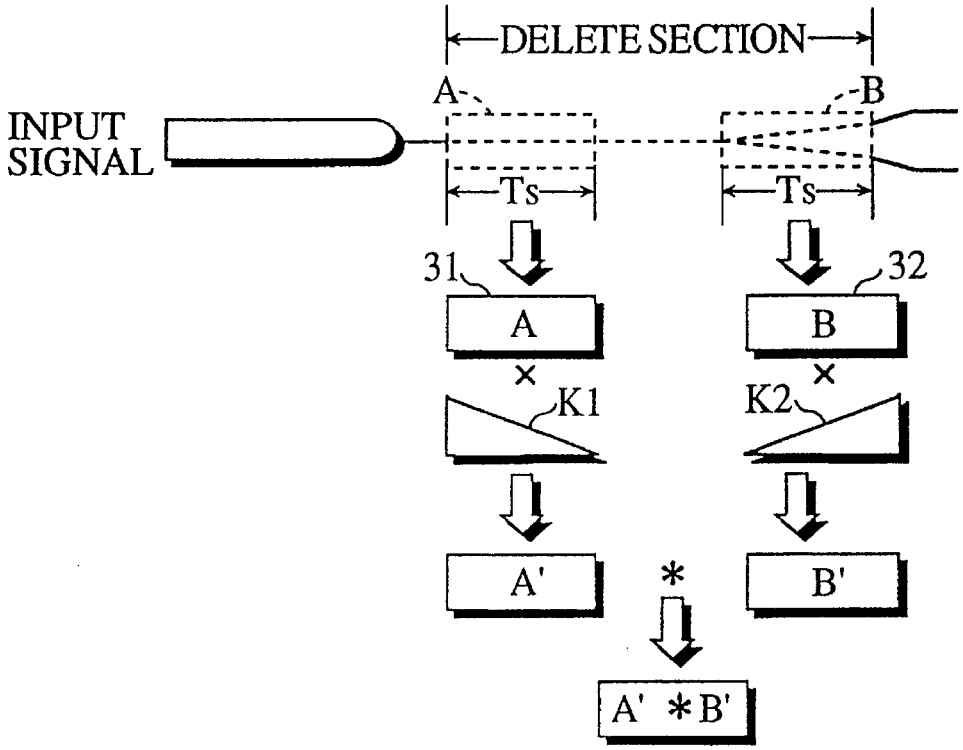
FIG. 6 is an explanatory view for explaining a method of synthesizing waveforms by a synthetic waveform processing unit.

Specifically, as already described using FIG. 6, the content of the first memory 31 is multiplexed by a function linearly changed from 1 to 0, the content of the second memory 32 is multiplexed by a function linearly changed from 0 to 1, and both the results of the multiplication are added. The result of the addition (which corresponds to A'* B' in FIG. 6) is sent to the ring memory 7 through the demultiplexer 27 and is written into the ring memory 7.

Thereafter, the first flag F1 and the second flag F2 are reset (F1=F2=0) (step 5), after which the program proceeds to the step 6.

The ring memory 7 may, in some cases, enter the state immediately before underflow in a case where the above described deletion processing performed by the input signal deleting unit 25 is repeated with respect to the continued silence section. In this case, the answer is in the affirmative in the step 16, after which the program proceeds to the step 24. In the step 24, it is judged whether or not the preceding frame is in the section in which input signal deletion processing is performed by the input signal deleting unit 25 on the basis of the state of the first flag F1.

In this case, the first flag F1 is set (F1=1), whereby the program proceeds to the step 25, in which the present frame data are stored in the second memory 32. The deletion processing performed by the input signal deleting unit 25 is stopped, and the synthetic waveform insertion processing is performed by the synthetic waveform inserting unit 26 (step 26). The first flag F1 and the second flag F2 are reset (F1=F2=0) (step 27), after which the program proceeds to the step 1.

The synthetic waveform insertion processing performed by the synthetic waveform inserting unit 26 in the step 26 is approximately the same as the synthetic waveform insertion processing described in the step 4 except that the frame data stored in the second memory 32 are frame data obtained after the ring memory 7 enters the state immediately before underflow.

The processing in the foregoing step 25 may be omitted. The is, the program may proceed to the step 26 without storing the present frame data in the second memory 32 in a case where the answer is in the affirmative in the step 24. In this case, in the synthetic waveform insertion processing performed in the step 26, frame data short of the state immediately before underflow (the preceding frame data) which are stored in the second memory 32 are used, as in the synthetic waveform insertion processing described in the step 4.

Furthermore, the processing in the step 22 may be omitted, and the step in which the frame data are stored in the second memory 32 may be added between the step 3 and the step 4. In this case, the synthetic waveform insertion processing is performed in the step 4 on the basis of the content stored in the first memory 31 in the step 19 and the content stored in the second memory 32 in the step added between the step 3 and the step 4.

(7) Description of processing in the case corresponding to the sixth mode

When it is judged in the step 2 that the average power value P is less than the threshold value Th, the continuation length of the silence section up to the present time is calculated (step 11), and it is judged whether or not the calculated continuation length is not less than the pause continuation length Tdel set in the pause continuation length memory 17 (step 12). If it is judged that the continuation length of the silence section is not less than the pause continuation length Tdel, it is judged whether or not the ring memory 7 is in the state immediately before underflow on the basis of the output of the ring memory state judging unit 16 (steps 15 and 16).

When the ring memory 7 is in the state immediately before underflow, it is judged whether or not the preceding frame is in the section in which input signal deletion processing is performed by the input signal deleting unit 25 on the basis of the state of the first flag F1 (step 24). A case where the first flag F1 is reset (F1=0), that is, the preceding frame is not in the section in which input signal deletion processing is performed by the input signal deleting unit 25 corresponds to the sixth mode, in which the program proceeds to the step 28. In the step 28, the present frame data are subjected to thinning processing at a compression rate of ½ by the thinning processing unit 24. The data which are subjected to the thinning processing are sent to the ring memory 7 and are written thereto, after which the program is returned to the step 1.

Specifically, in a case where the ring memory 7 is in the state immediately before underflow and the preceding frame is not in the section in which input signal deletion processing is performed by the input signal deleting unit 25 even if the continuation length of the silence section is not less than the pause continuation length Tdel, the frame data are subjected to thinning processing at a compression rate of ½ without being deleted, after which the frame data are written into the ring memory 7.

Although in FIG. 11*b*, it is judged in the step 12 whether or not the continuation length of the silence section is more than the pause continuation length Tdel, it may be judged (FIG. 12) whether or not the continuation length T of the silence section is less than the set first reference length T1 (T<T1), whether or not the continuation length T of the silence section is not less than the set first reference length T1 and less than the set second reference length T2 (where T1<T2) (T1≦T<T2), or whether or not the continuation length T of the silence section is not less than the second reference length T2 (T≧T2). A length corresponding to four frames, for example, and a length corresponding to 40 frames, for example, are respectively set as the first reference length and the second reference length.

Figure 12:
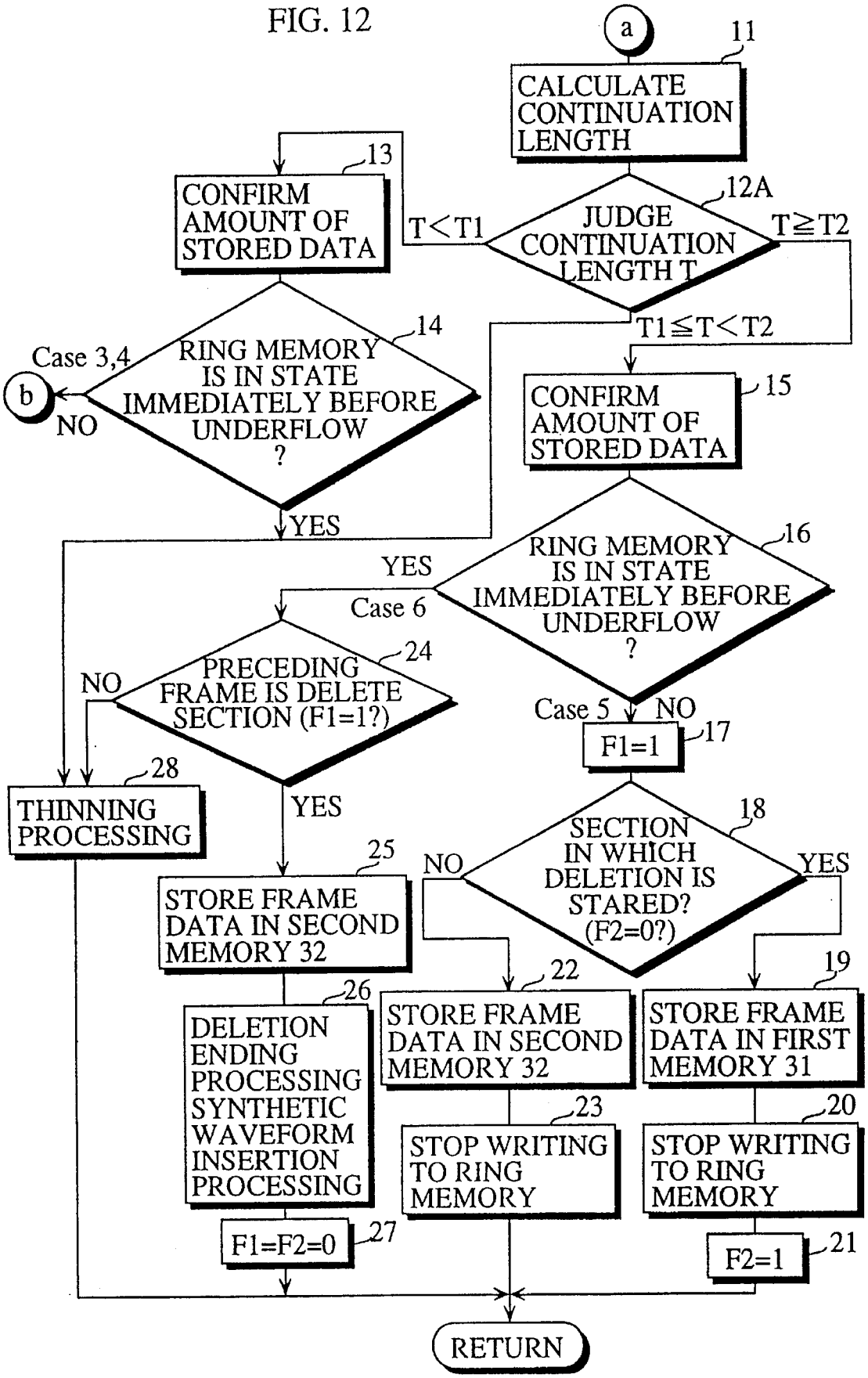
FIG. 12 is a flow chart showing a modified example of the procedure for processing performed by the voice speed converter, which corresponds to FIG. 11*b;*

As shown in FIG. 12, the program may proceed to the following steps depending on the result of each of the judgments. Specifically, if the continuation length T of the silence section is less than the set first reference length T1 (T<T1), the program proceeds to the step 13. When the continuation length T of the silence section is not less than the set first reference length T1 and less than the set second reference length T2 (T1<T2) (T1≦T<T2), the program proceeds to the step 28, in which 1/n thinning processing is performed. When the continuation length T of the silence section is not less than the set second reference length T2 (T≧T2), the program proceeds to the step 15.

Figure 20A:
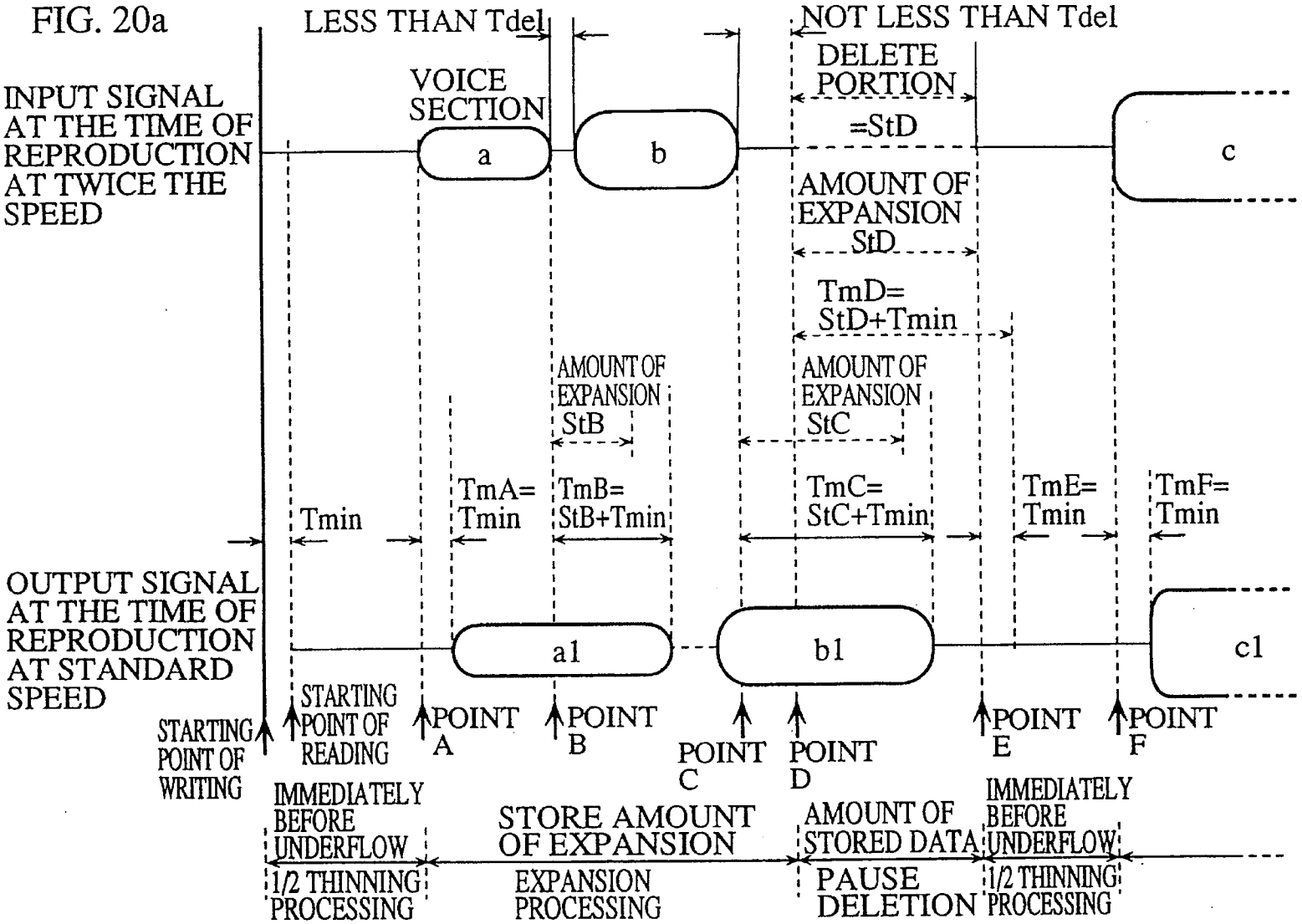
FIGS. 20*a* and 20*b* are time charts showing the relationship between an input signal and an output signal at the time of reproduction at twice the speed, which particularly shows how the input signal corresponding to a silence section is deleted.
Figure 20B:
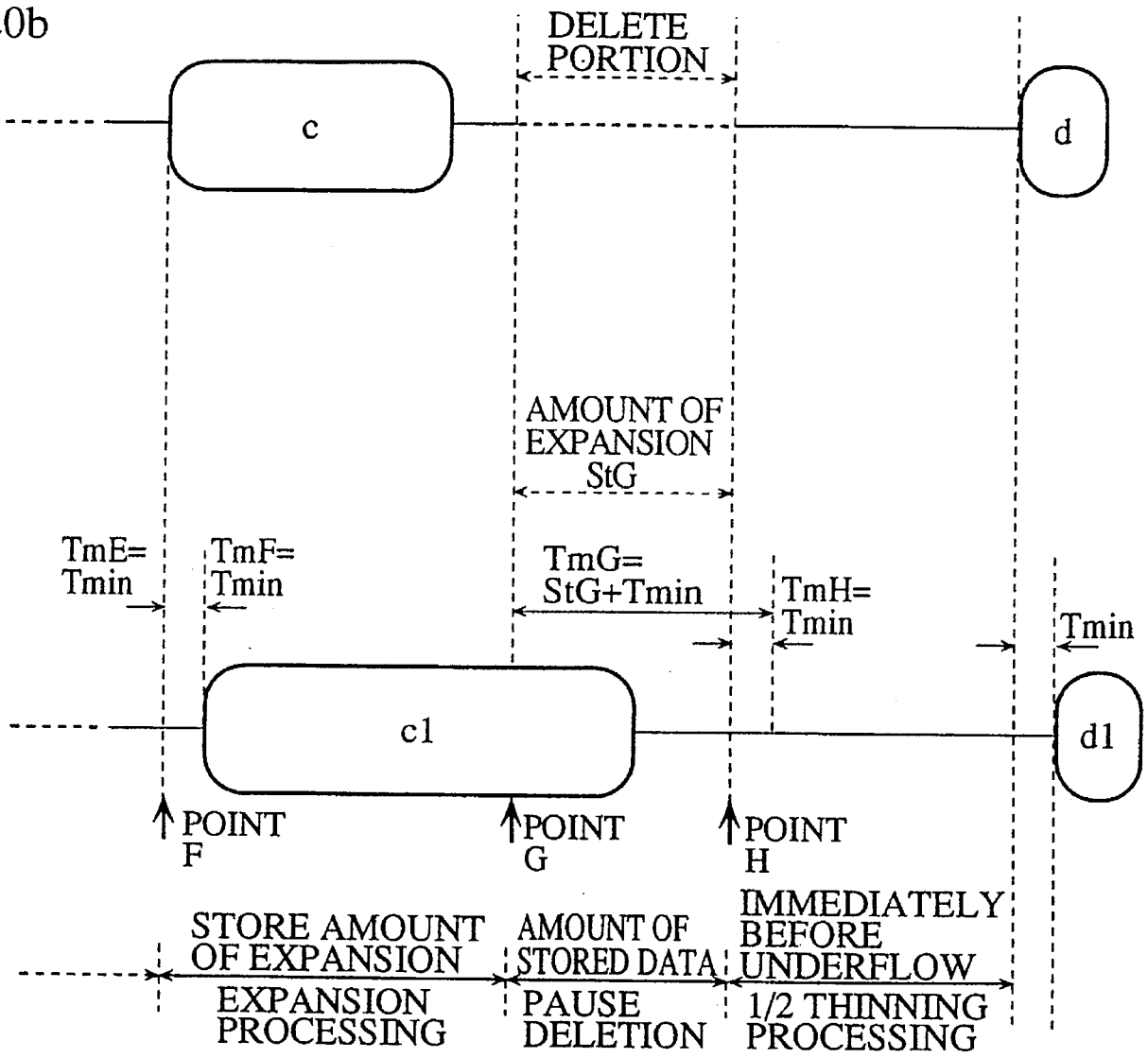

FIGS. 20*a* and 20*b* show the relationship between an input signal and an output signal at the time of reproduction at twice the speed, which particularly shows how the input signal corresponding to a silence section is deleted. FIGS. 21 to 30 show the states of the ring memory 7 at a point at which writing of data to the ring memory 7 is started, a point at which reading of data from the ring memory 7 is started, and points A to H shown in FIGS. 20*a* and 20*b*.

Figure 21:
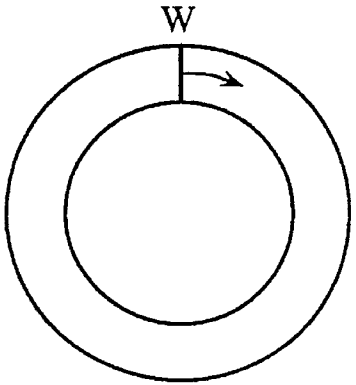
FIGS. 21 to 30 are schematic views respectively showing the states of a ring memory 7 at a point at which writing of data to the ring memory 7 is started, a point at which reading of data from the ring memory 7 is started, and points A to H shown in FIGS. 20*a* and 20*b;*

In FIG. 20*a*, the input signal corresponds to a silence section and the ring memory 7 is in an empty state at the time of starting the reproduction at twice the speed (see FIG. 21). Accordingly, frame data corresponding to the silence section are thinned at a compression rate of ½ by the thinning processing unit 24, after which the thinned frame data are written into the ring memory 7.

Figure 22:
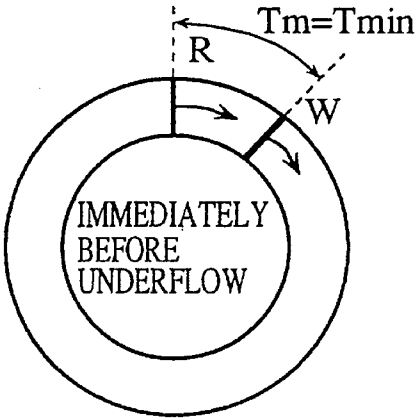

If the amount of stored data Tm in the ring memory 7 reaches underflow detecting data Tmin, the reading of the data from the ring memory 7 is started (see FIG. 22).

Figure 23:
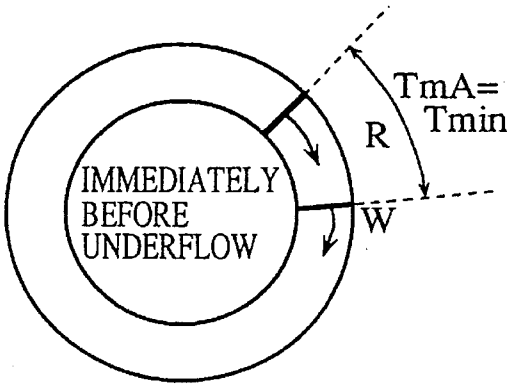

If frame data corresponding to a voice section a in the input signal are sent (point A), the frame data are compressed at a compression rate of ⅔ by the pitch compressing and expanding means 23. If compression at a compression rate of ½ in which the lengths of the input signal and the output signal coincide with each other is taken as a basis, the frame data are expanded. In this sense, this processing is described as expansion processing in FIGS. 20*a* and 20*b*. The compressed data are written into the ring memory 7. At the point A, the amount of stored data TmA is equal to Tmin, as shown in FIG. 23.

Figure 24:
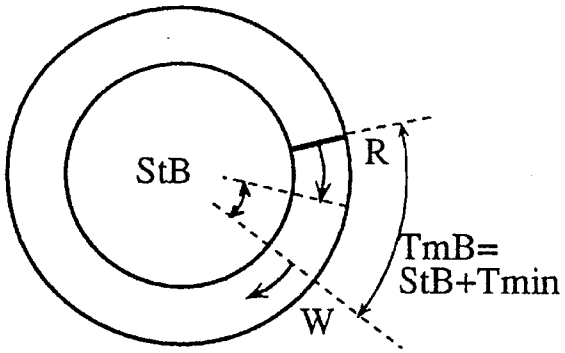

A part a1 of the output signal corresponding to the voice section a in the input signal is read out later by the amount of stored data TmA at the point A. At the time point where the voice section a in the input signal has been inputted (point B), the sum of the amount of stored data Tmin at the point A which is a starting point of a section in which the present compression processing is performed and the amount of expansion StB in the case of the compression at a compression rate of ½ of compressed data corresponding to the voice section a from the point A to the point B becomes the amount of stored data TmB (=StB+Tmin) in the ring memory 7, as shown in FIG. 24. Consequently, the part a1 of the output signal corresponding to the voice section a in the input signal has been outputted at the time point where TmB (=StB+Tmin) has elapsed from the point B.

Frame data corresponding to a silence section having a length of less than the pause continuation length Tdel subsequent to the voice section a in the input signal are also compressed at a compression rate of ⅔ by the pitch compressing and expanding means 23. If a voice section b in the input signal is inputted subsequently to the silence section, frame data corresponding to the voice section b are also compressed at a compression rate of ⅔ by the pitch compressing and expanding means 23.

Figure 25:
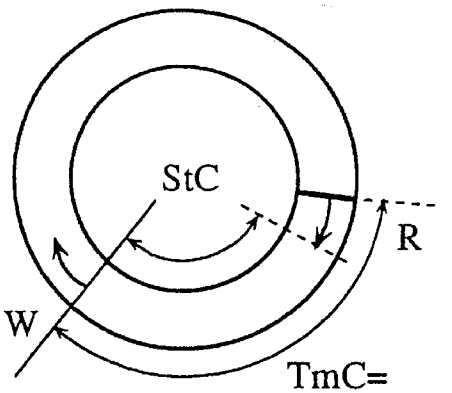

At the time point where the voice section b in the input signal has been inputted (at point C), the sum of the amount of stored data Tmin at the point A which is the starting point of the section in which the present compression processing is performed and the amount of expansion StC in the case of the compression at a compression rate of ½ of compressed data corresponding to the input signal from the point A to the point C becomes the amount of stored data TmC (=StC+Tmin) in the ring memory 7, as shown in FIG. 25. Consequently, a part b1 of the output signal corresponding to the voice section b in the input signal has been outputted at the time point where TmC (=StC+Tmin) has been elapsed from the point C.

When the input signal corresponding to a silence section having a length of not less than the pause continuation length Tdel is sent subsequently to the voice section b in the input signal, frame data corresponding to the silence section are compressed at a compression rate of ⅔ by the pitch compressing and expanding means 23 until the length of the silence section reaches the pause continuation length Tdel (point D).

Figure 26:
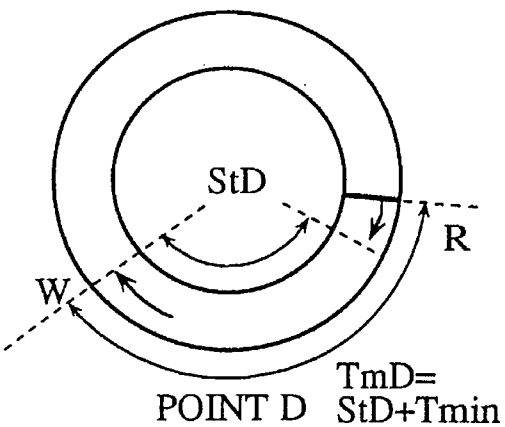

At the point D, the sum of the amount of stored data Tmin at the point A which is the starting point of the section in which the present compression processing is performed and the amount of expansion StD in the case of the compression at a compression rate of ½ of compressed data corresponding to the input signal from the point A to the point D becomes the amount of stored data TmD (=StD+Tmin) in the ring memory 7, as shown in FIG. 26. Consequently, a part of the output signal corresponding to the silence section between the voice section b in the input signal and the point D has been outputted at the time point where TmD (=StD+Tmin) has been elapsed from the point D.

The frame data corresponding to the silence section having a length of not less than the pause continuation length Tdel are deleted by the input signal deleting unit 25 until the amount of stored data in the ring memory 7 becomes not more than the underflow detecting data Tmin. The length Std of a section in which input signal deletion processing is performed becomes equal to the amount of expansion StD in the case of the compression at a compression rate of ½ of compressed data corresponding to the input signal from the point A which is the starting point of the section in which the present compression processing is performed to the point D.

After the deletion processing is performed by the input signal deleting unit 25, a synthetic waveform for preventing a click sound is inserted by the synthetic waveform inserting unit 26. However, an inserted synthetic waveform portion is omitted in FIG. 20.

Figure 27:
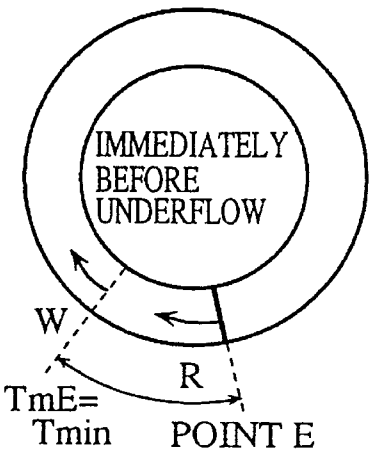

At the final point (point E) of the section in which input signal deletion processing is performed, the amount of stored data TmE in the ring memory 7 is not more than the underflow detecting data Tmin, as shown in FIG. 27. An example in which the amount of stored data TmE is equal to the underflow detecting data Tmin is illustrated.

Frame data corresponding to a silence section from the point E are thinned at a compression rate of ½ by the thinning processing unit 24, after which the thinned frame data are written into the frame memory 7. If a voice section c in the input signal is inputted (point F), frame data corresponding to the voice section c are compressed at a compression rate of ⅔ by the pitch compressing and expanding means 23. That is, a section in which new compression processing is performed is started. The compressed data are written into the ring memory 7.

Figure 28:
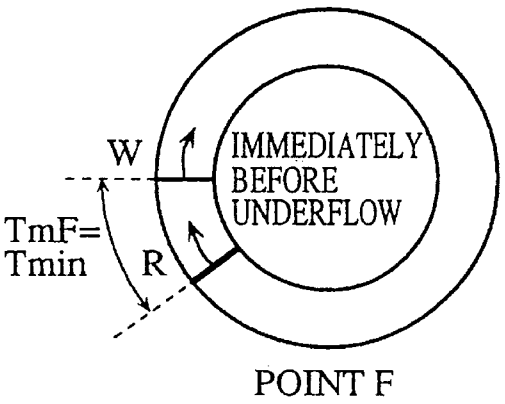

At the point F, the amount of stored data TmF in the ring memory 7 is Tmin, which is the same as that at the point E, as shown in FIG. 28.

A part c1 of the output signal corresponding to the voice section c in the input signal is outputted later by the amount of stored data Tmin at the point F. Frame data corresponding to a silence section having a length of less than the pause continuation length Tdel subsequent to the voice section c in the input signal (a silence section from the voice section c to the point G) are compressed at a compression rate of ⅔ by the pitch compressing and expanding means 23.

Figure 29:
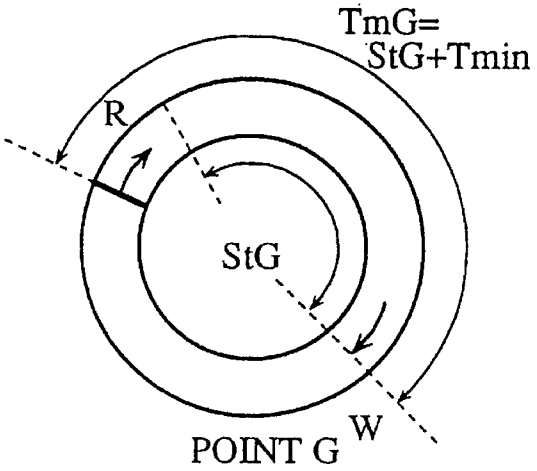

At the point G, the sum of the amount of stored data Tmin at the point F which is the starting point of the section in which the present compression section is performed and the amount of expansion StG in the case of the compression at a compression rate of ½ of compressed data corresponding to the input signal from the point F to the point G becomes the amount of stored data TmG (=StG+Tmin) in the ring memory 7, as shown in FIG. 29. Consequently, a part of the output signal corresponding to the silence section from the voice section c in the input signal to the point G has been outputted at the time point where TmG (=StG+Tmin) has elapsed from the point G.

Frame data corresponding to a silence section having a length of not less than the pause continuation length Tdel are deleted by the input signal deleting unit 25 until the amount of stored data in the ring memory 7 becomes the underflow detecting data Tmin. The length Std of a section in which input signal deletion processing is performed becomes equal to the amount of expansion StG in the case of the compression at a compression rate of ½ of compressed data corresponding to the input signal from the point F which is the starting point of the section in which the present compression processing is performed to the point G.

Figure 30:
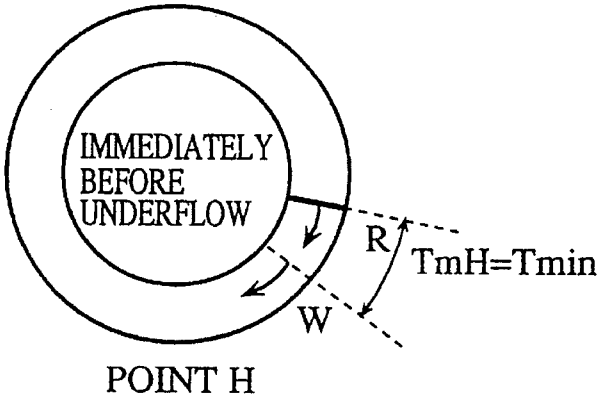

At the final point (point H) of the section in which input signal deletion processing is performed, the amount of stored data TmH in the ring memory 7 is not more than the underflow detecting data Tmin, as shown in FIG. 30. An example in which the amount of stored data TmH is equal to the underflow detecting data Tmin is illustrated.

Frame data corresponding to a silence section from the point H are thinned at a compression rate of ½ by the thinning processing unit 24, after which the thinned frame data are written into the frame memory 7. If a voice section d in the input signal is inputted (point F), frame data corresponding to the voice section d are compressed at a compression rate of ⅔ by the pitch compressing and expanding means 23. The expanded data are written into the ring memory 7.

Figure 31:
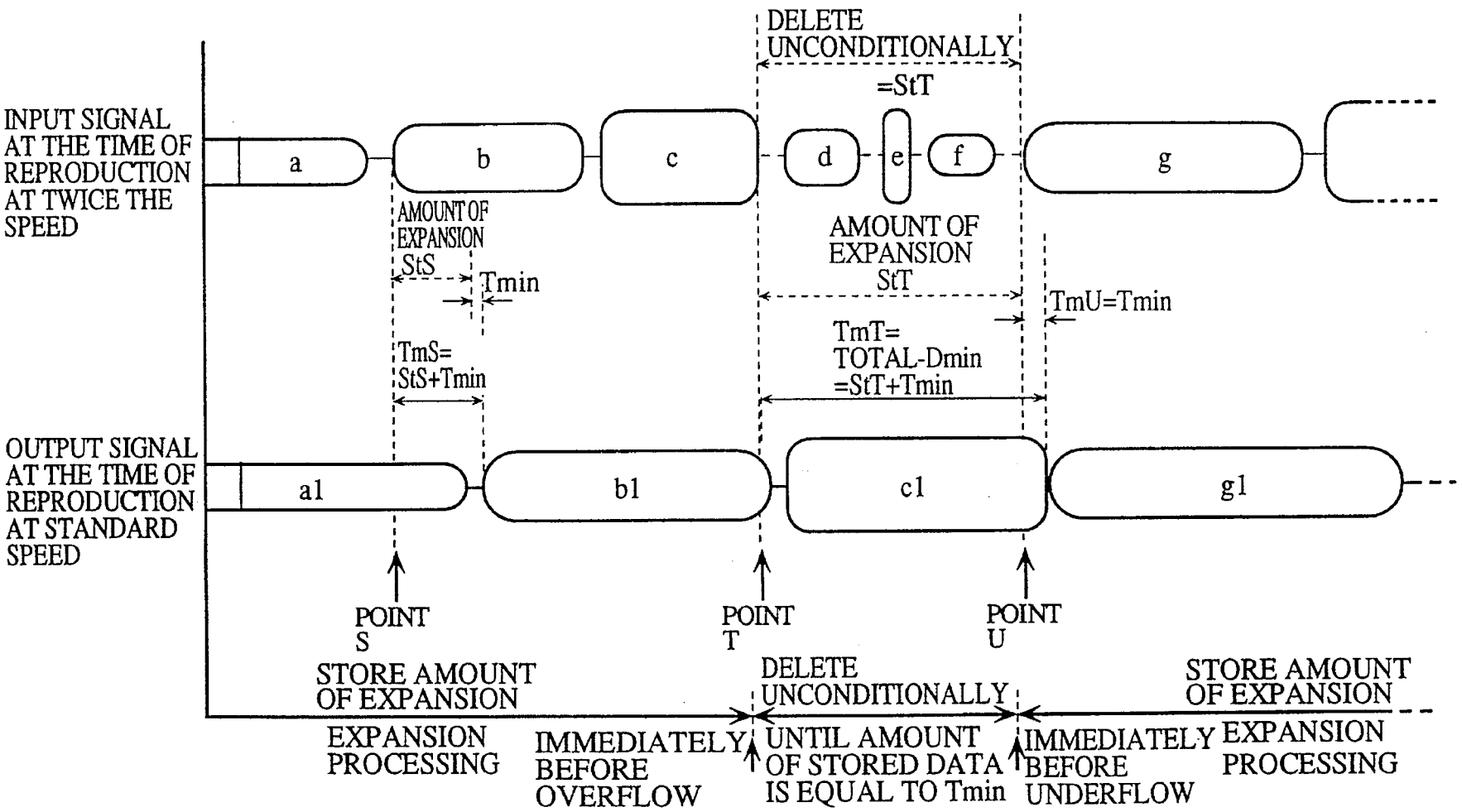
FIG. 31 is a time chart showing the relationship between an input signal and an output signal at the time of reproduction at twice the speed, which particularly shows how the input signal is deleted in a case where the ring memory 7 enters a state immediately before overflow.
Figure 32:
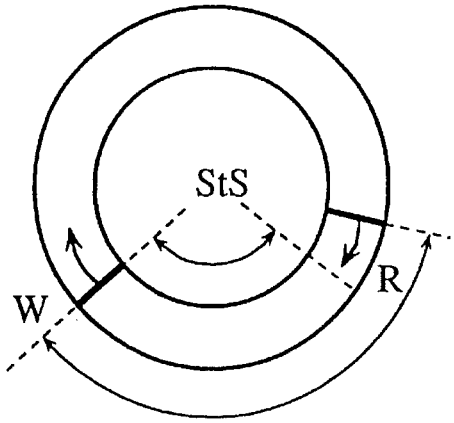
FIGS. 32 to 34 are schematic views respectively showing the states of the ring memory 7 at points S to U shown in FIG. 31.
Figure 33:
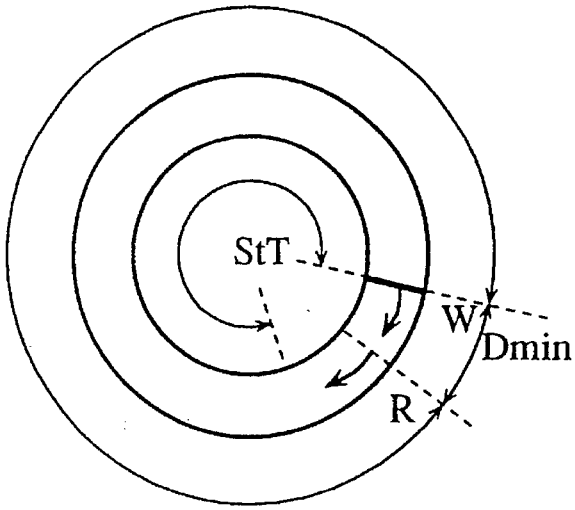
Figure 34:
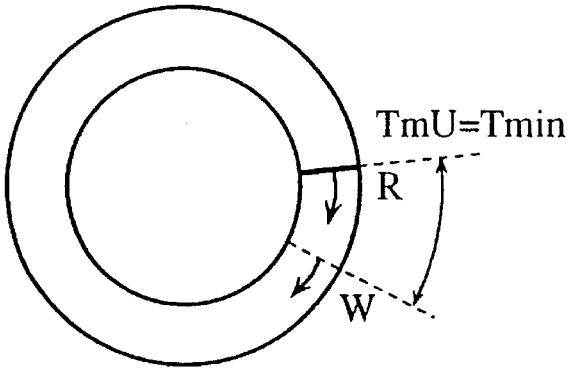

FIG. 31 illustrates the relationship between an input signal and an output signal at the time of reproduction at twice the speed, which particularly shows how the input signal is deleted when the ring memory 7 enters the state immediately before overflow. FIGS. 32 to 34 show the states of the ring memory 7 at points S to U shown in FIG. 31.

It is assumed that frame data corresponding to the input signal including voice sections a, b and c and silence sections from a certain time point to the point T are compressed at a compression rate of ⅔ by the pitch compressing and expanding means 23 (expanded in the case of compression at a compression rate of ½). In this case, the amount of expansion is stored in the ring memory 7.

At a point at which input of the voice section b is started (point S), the sum of the amount of stored data Tmin at a starting point of compression processing of the input signal and the amount of expansion StS in the case of the compression at a compression rate of ½ of compressed data corresponding to the input signal from the starting point of the compression processing to the point S becomes the amount of stored data TmS (=StS+Tmin) in the ring memory 7, as shown in FIG. 32. Consequently, a part b1 of the output signal corresponding to the voice section b is outputted at the time point where TmS (=StS+Tmin) has elapsed from the point S.

It is assumed that the ring memory 7 enters the state immediately before overflow at the time point where compressed data corresponding to the voice section c in the input signal are written into the ring memory 7 (point T). That is, it is assumed that the amount of stored data in the ring memory 7 is not less than the overflow detecting data Tmax at the point T.

At the point T, the sum of the amount of stored data Tmin at the starting point of the compression processing of the input signal and the amount of expansion StT in the case of the compression at a compression rate of ½ of compressed data corresponding to the input signal from the starting point of the compression processing to the point T becomes the amount of stored data TmT (=StT+Tmin) in the ring memory 7, as shown in FIG. 33. In other words, letting the total number of words composing the ring memory 7 be TOTAL, the overflow detecting data be Tmax, and the difference between TOTAL and Tmax be Dmin, the amount of stored data Tmt at the point T is equal to Tmax, so that TOTAL–Dmin.

Consequently, a part of the output signal corresponding to the input signal has been outputted at the time point where the amount of stored data TmT (=StT+Tmin) has been elapsed from the point T.

If the ring memory 7 enters the state immediately before overflow at the point T, the subsequent input signal is deleted unconditionally by the input signal deleting unit 21 until the ring memory 7 enters the state immediately before underflow. After the deletion processing is performed by the input signal deleting unit 21, a silence signal is inserted by the silence signal inserting unit 22. However, an inserted silence signal portion is omitted in FIG. 31. It is assumed that frame data are deleted after the ring memory 7 enters the state immediately before overflow (point T), and the ring memory 7 enters the state immediately before underflow at the point U (the amount of stored data TmU=Tmin) as shown in FIG. 34. In this case, the input signal composed of four silence sections and three voice sections d, e and f from the point T to the point U is deleted. Consequently, the input signal from the point T to the point U does not appear as the output signal.

If a voice section g in the input signal is inputted from the point U, frame data corresponding to the voice section g are compressed at a compression rate of ⅔ by the pitch compressing and expanding means 23 (expanded in the case of the compression at a compression rate of ½), after which the compressed frame data are written into the ring memory 7. A part g1 of the output signal corresponding to the voice section g is outputted later by the amount of stored data Tmin in the ring memory 7 at the point U.

Figure 35:
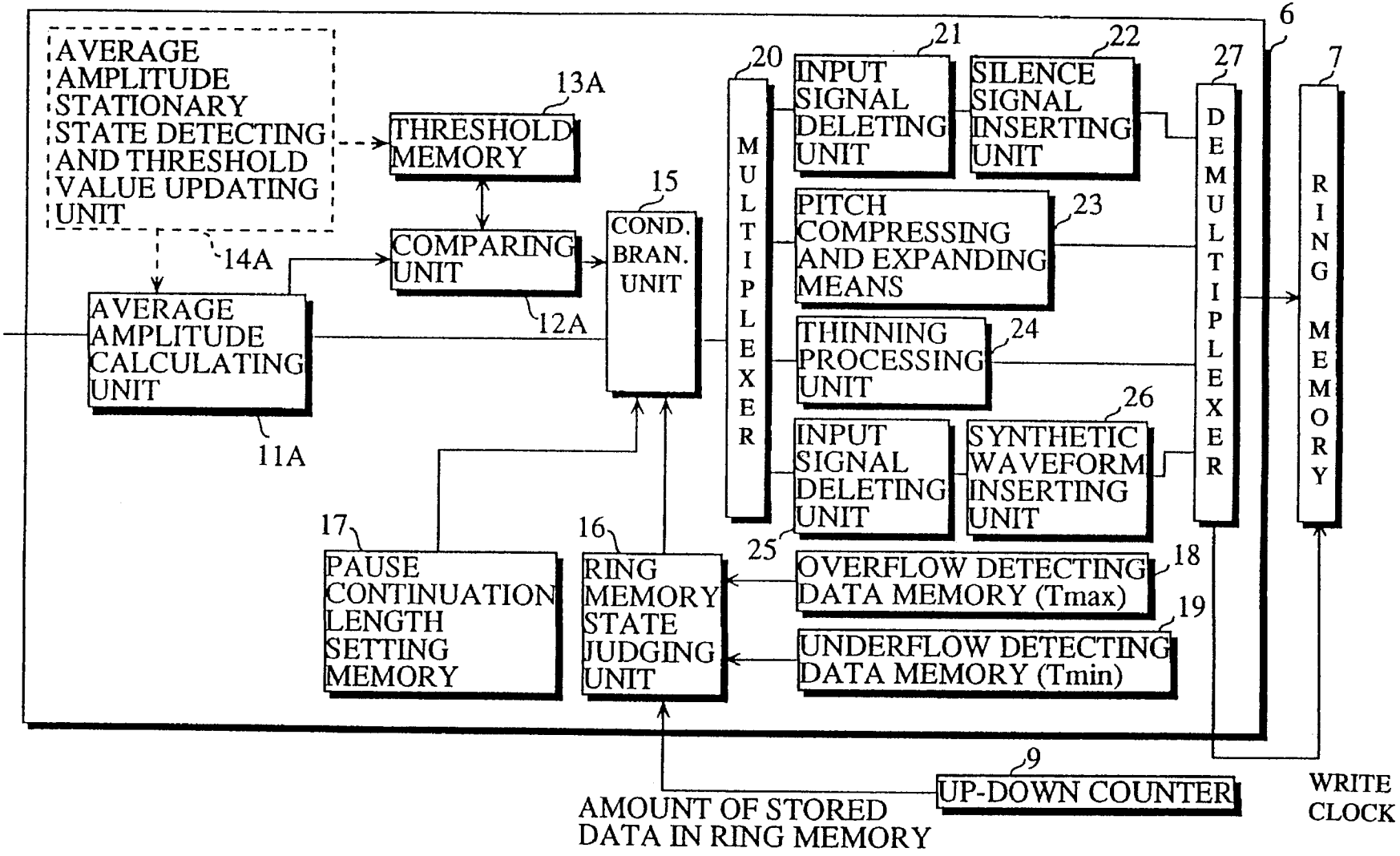
FIG. 35 is a block diagram showing a modified example of a circuit for judging which of a voice section and a silence section corresponds to an input signal, which corresponds to FIG. 2.

Although in the above described embodiment, it is judged which of the voice section and the silence section corresponds to the input signal on the basis of an average power value P in each frame, it may be judged on the basis of an average amplitude value in each frame. In this case, as shown in FIG. 35, an average amplitude calculating unit 11A for calculating an average amplitude value for each frame is provided in place of the power calculating unit 11 shown in FIG. 2. A threshold value of $2^6$, for example is set in a threshold value memory 13A when the number of quantization bits for an A/D converter 2 is 12. The average amplitude value calculated by the average amplitude calculating unit 11A and the threshold value in the threshold value memory 13A are compared with each other by a comparing unit 12A, thereby to judge which of the voice section and the silence section corresponds to the input signal.

Specifically, it is judged that the input signal corresponds to the voice section if the average amplitude value is not less than the threshold value, while corresponding to the silence section if the average amplitude value is less than the threshold value. Letting the amplitudes of sampled sound signals within one frame be respectively $i_0, i_1, \ldots i_{N-1}$ (where N=200), an average amplitude value W for each frame is calculated on the basis of the following equation (3):

$$W = (1/N) \times \sum_{k=0}^{k=N-1} |i_k| \quad (3)$$

Also in this case, the threshold value may be changed in the following manner. Specifically, as indicated by a dotted line in FIG. 35, there is provided an average amplitude stationary state detecting and threshold value updating unit 14A. The average amplitude stationary state detecting and threshold value updating unit 14A judges whether or not the average amplitude value W from the average amplitude calculating unit 11A is constant over a predetermined number of frames. When the average amplitude value W is constant (a stationary state), a value which is twice the average amplitude value W at that time is written into the threshold value memory 13A, to update the threshold value. However, the maximum value of the threshold value to be updated is restricted to a predetermined value, for example, $2^8$.

Furthermore, it may be judged which of the voice section and the silence section corresponds to the input signal on the basis of an accumulated amplitude value Wa of sound signals in each frame which is expressed by the following equation (4) and a predetermined threshold value:

$$Wa = \sum_{k=0}^{k=N-1} |i_k| \quad (4)$$

Furthermore, it may be judged which of the voice section and the silence section corresponds to the input signal by detecting the periodity of sound signals in each frame. Specifically, it may be judged that the input signal corresponds to the voice section if the detected period is within the range of a predetermined pitch cycle of the sound signals, while corresponding to the silence section if the detected period is outside the range of the predetermined pitch cycle of the sound signals.

Figure 36:
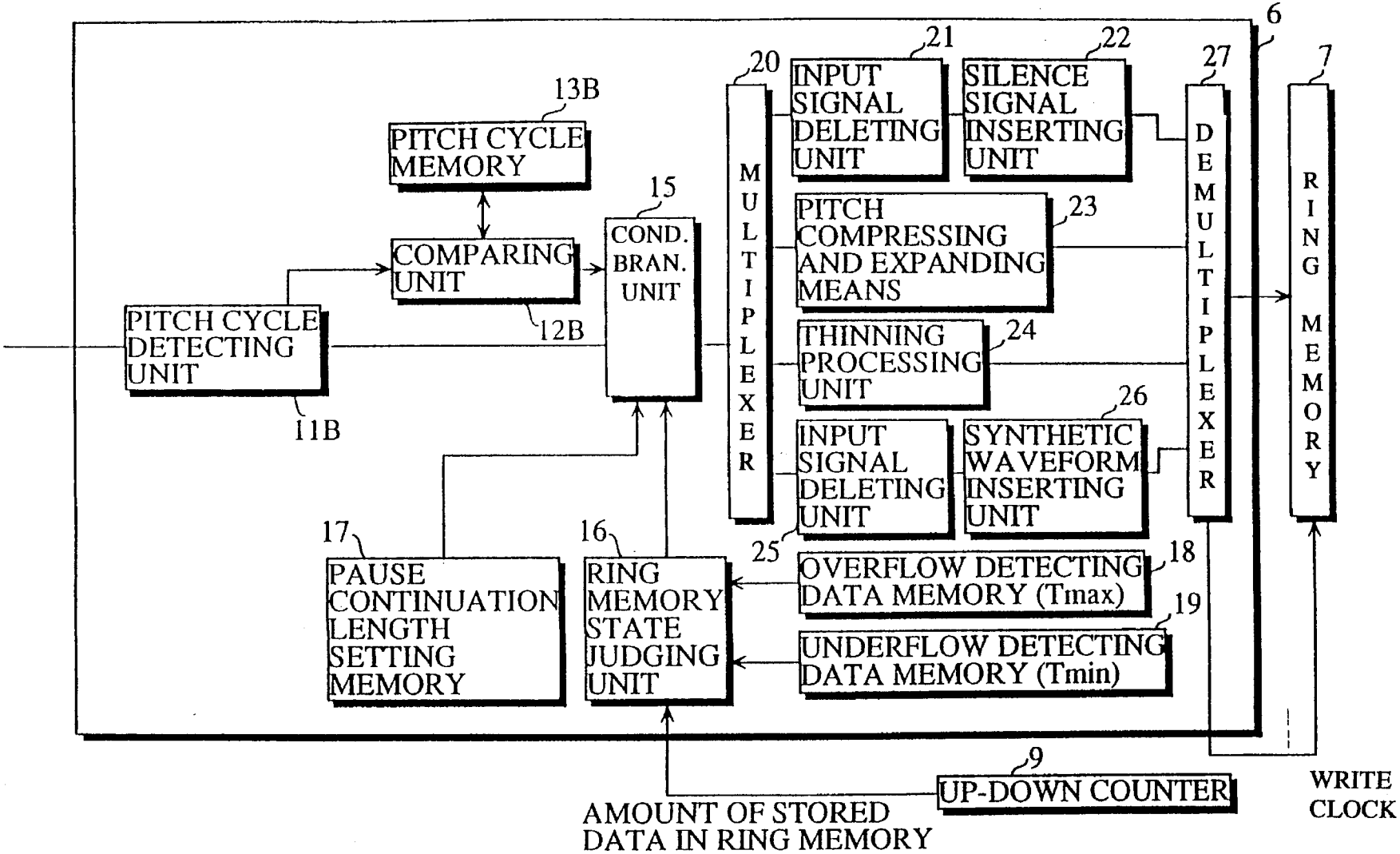
FIG. 36 is a block diagram showing another modified example of a circuit for judging which of a voice section and a silence section corresponds to an input signal, which corresponds to FIG. 2.

In this case, a pitch cycle detecting unit 11B for detecting the periodicity for each frame on the basis of the autocorrelating method is provided in place of the power calculating unit 11 shown in FIG. 2, and the range of the pitch cycle of the sound signals is set in a pitch cycle memory 13B, as shown in FIG. 36. The period detected by the pitch cycle detecting unit 11B and the range of the pitch cycle of the sound signals set in the pitch cycle memory 13 are compared with each other by a comparing unit 12B.

The range of the pitch cycle of the sound signals differs depending on the reproduction speed, which is set in the range of 66×n (Hz)–320×n (Hz), for example, at the time of reproduction at n times the speed. Consequently, the range of the pitch cycle of the sound signals is set in the range of 132 Hz to 640 Hz at the time of reproduction at twice the speed.

Furthermore, it may be judged which of the voice section and the silence section corresponds to the input signal by comparing power spectrums of signals in each frame and power spectrums in a stationary state.

Figure 37:
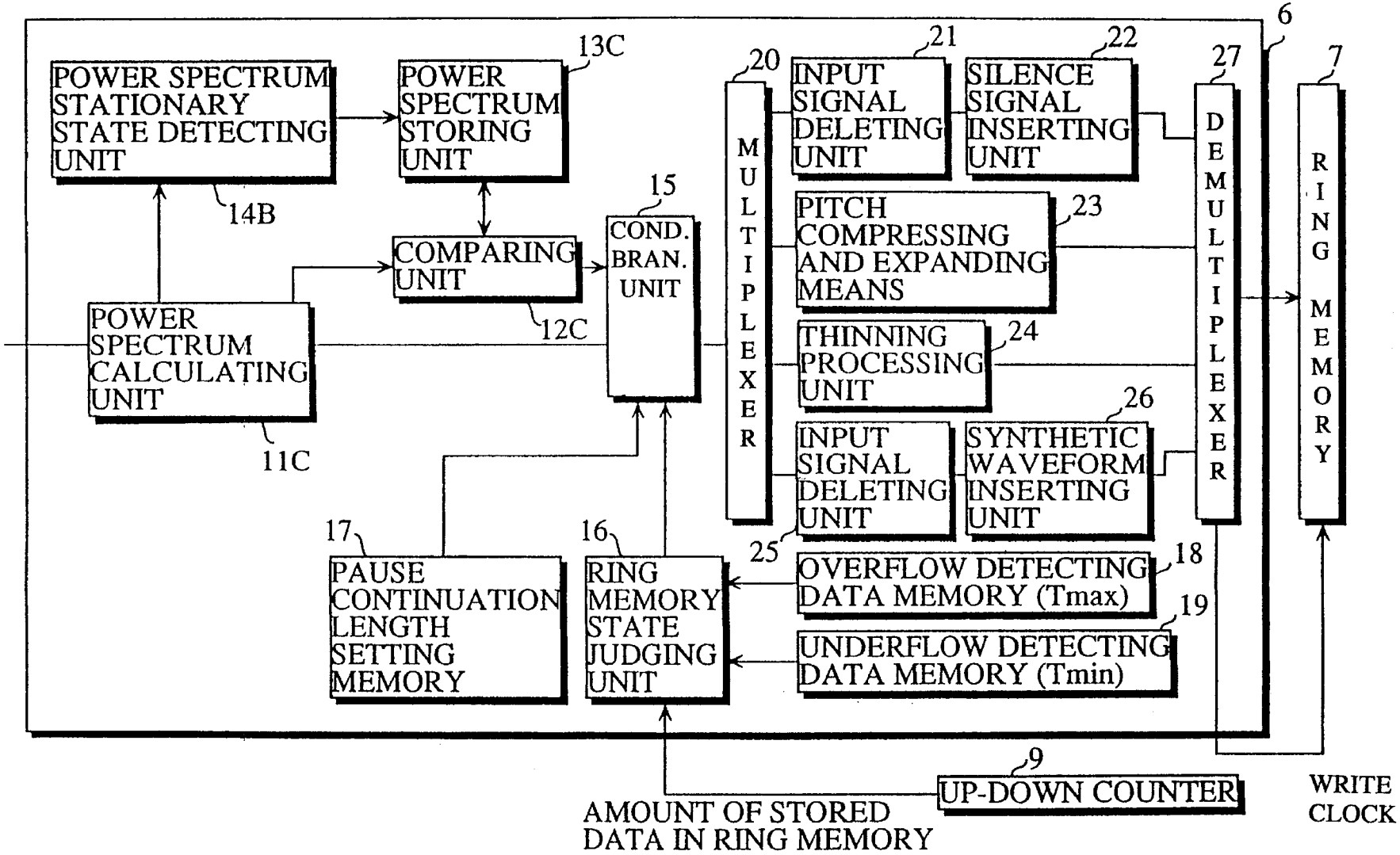
FIG. 37 is a block diagram showing a further modified example of a circuit for judging which of a voice section and a silence section corresponds to an input signal, which corresponds to FIG. 2.

In this case, a power spectrum calculating unit 11C for calculating power spectrums corresponding to predetermined one or a plurality of frequency bands for each frame is provided in place of the power calculating unit 11 shown in FIG. 2, as shown in FIG. 37. In addition, power spectrums in a stationary state corresponding to the predetermined one or the plurality of frequency bands are stored in a power spectrum storing unit 13C.

When a power spectrum stationary state detecting unit 14B detects a stationary state on the basis of the change in the state of the power spectrums calculated by the power spectrum calculating unit 11C, the content of the power spectrum storing unit 13C is changed into power spectrums in the detected stationary state.

If the input signal is sent to the power spectrum calculating unit 11C, power spectrums corresponding to predetermined one or a plurality of frequency bands are calculated for each frame. The calculated power spectrums and the power spectrums in the stationary state which are stored in the power spectrum storing unit 13C are compared with each other by a comparing unit 12C.

If the calculated power spectrums vary from the power spectrums in the stationary state, it is judged that the frame is in the voice section. Conversely, if the calculated power spectrums do not vary from the power spectrums in the stationary state, it is judged that the frame is in the silence section.

More specifically, a threshold value corresponding to the predetermined one or the plurality of frequency bands is stored in the power spectrum storing unit 13C on the basis of the power spectrums in the stationary state corresponding to the predetermined one or the plurality of frequency bands. The power spectrums corresponding to the predetermined one or the plurality of frequency bands which are calculated by the power spectrum calculating unit 11C and a corresponding threshold value which is stored in the power spectrum storing unit 13C are compared with each other, thereby to judge which of the voice section and the silence section corresponds to the input signal.

Figure 38:
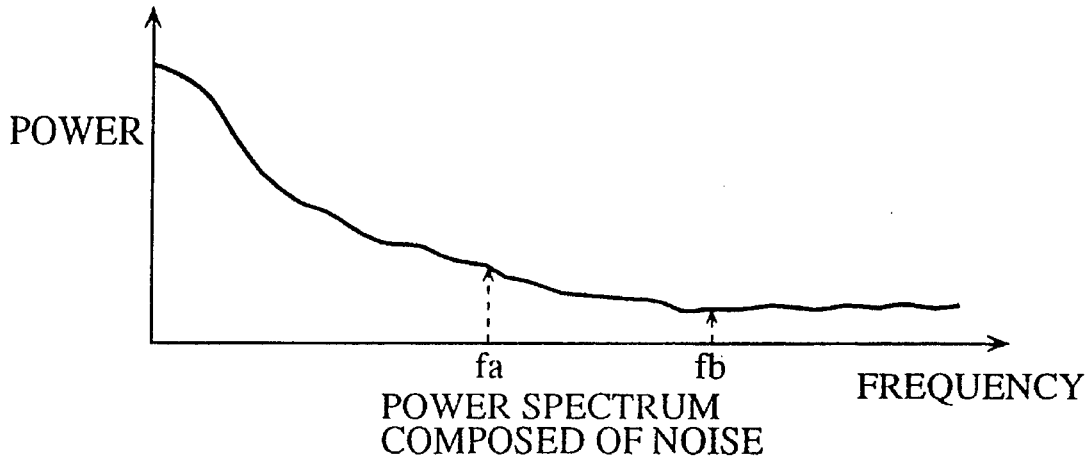
FIG. 38 is a graph showing power spectrums in a stationary state.
Figure 39:
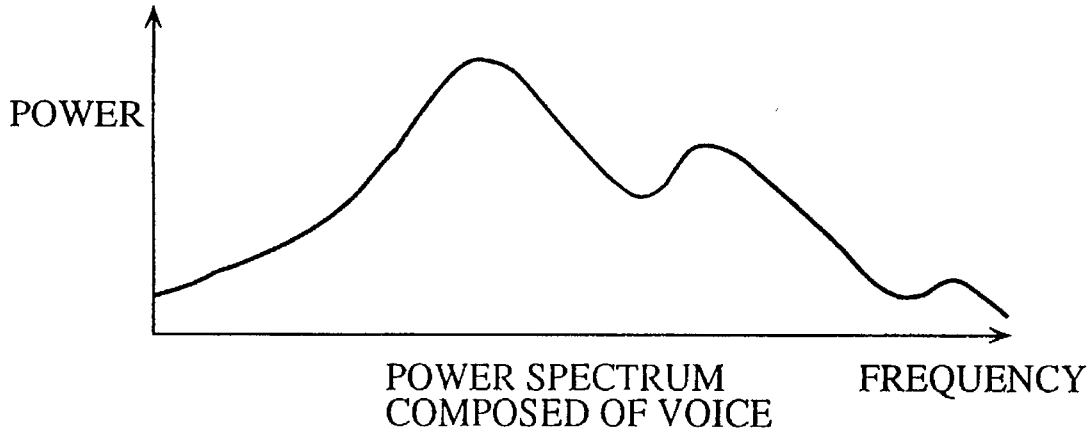
FIG. 39 is a graph showing power spectrums of voice including no noises.
Figure 40:
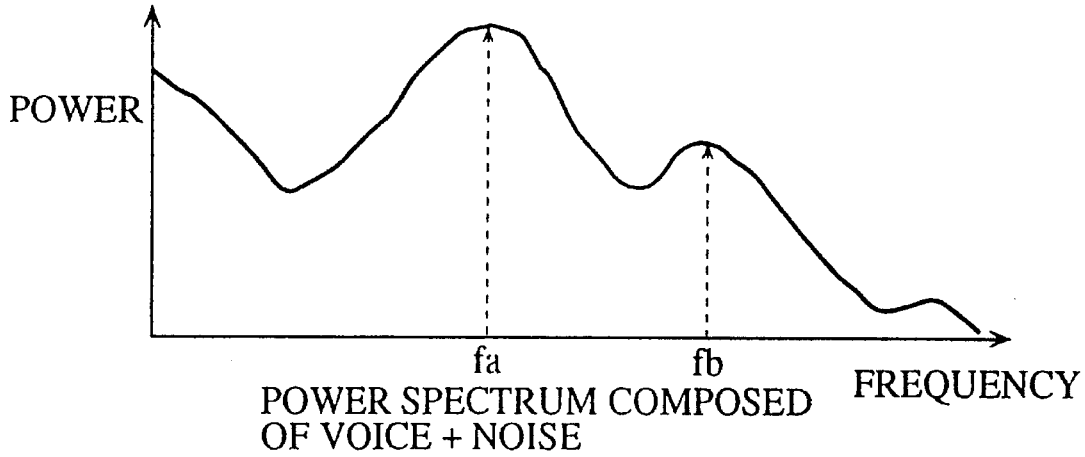
FIG. 40 is a graph showing power spectrums corresponding to a voice section.

For example, it is assumed that the power spectrums in the stationary state are power spectrums of noises, as shown in FIG. 38. In addition, it is assumed that power spectrums of voice including no noises are indicated in FIG. 39. If a sound signal having the power spectrum shown in FIG. 39 is inputted in a case where the noises indicated by the power spectrums shown in FIG. 38 exist in the stationary state, the power spectrums corresponding to a voice section become synthesis of both the power spectrums, as shown in FIG. 40.

Consequently, power relative to frequency bands fa and fb which are relatively low in the power spectrums in the stationary state, for example, is significantly increased in the power spectrums corresponding to the voice section. Specifically, the power in the stationary state in the one or the plurality of frequency bands which is relatively low in the power spectrums in the stationary state and the power in the one or the plurality of frequency bands in the power spectrums corresponding to the voice section are compared with each other, thereby to make it possible to judge which of the voice section and the silence section corresponds to the input signal.

If it is judged that noises in the stationary state are noises in a high frequency band, it is also possible to calculate power spectrums corresponding to a low frequency band (for example, a frequency band having frequencies of not more than 4 KHz) which is hardly affected by noises and judge which of the voice section and the silence section corresponds to the input signal depending on whether or not the calculated power spectrums are not less than a predetermined threshold value.

Furthermore, when the average power value P in each frame and the threshold value Th are compared with each other to judge which of the voice section and the silence section corresponds to the input signal, the threshold value Th may be changed on the basis of the amount of stored data in the ring memory 7. Specifically, the threshold value Th is decreased so that the smaller the amount of stored data in the ring memory 7 is, that is, the larger an empty area of the ring memory 7 is, the smaller a sound dropped portion in the voice section is. Consequently, output voice comes closer to natural voice.

Figure 41:
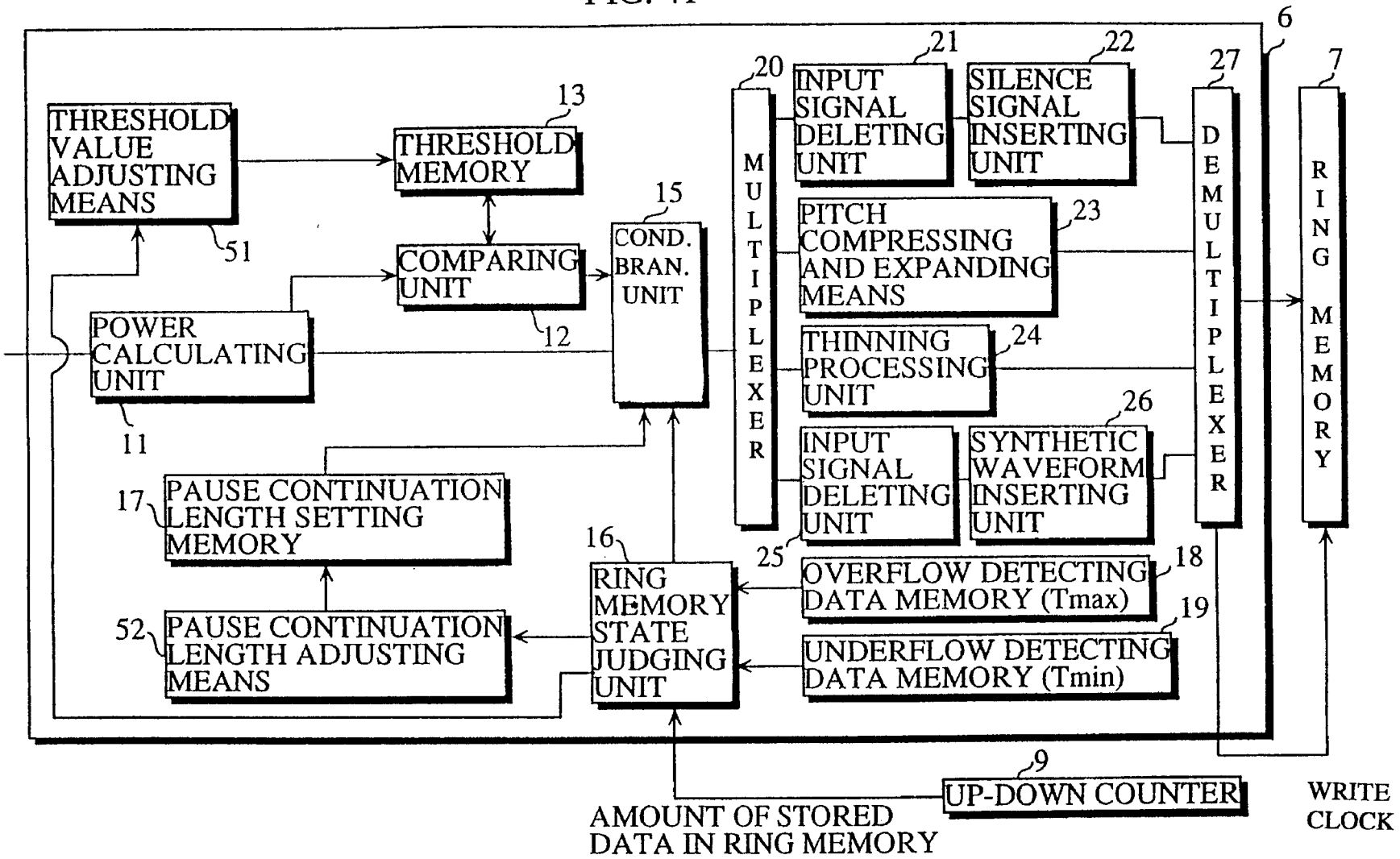
FIG. 41 is a block diagram showing a voice speed converter to which threshold value adjusting means and pause continuation length adjusting means are added.

Specifically, threshold value adjusting means 51 is provided, as shown in FIG. 41. The threshold value adjusting means 51 obtains the amount of stored data in the ring memory 7 from a ring memory state judging unit 16. The obtained amount of stored data in the ring memory 7 is divided by the sampling frequency in a D/A converter 8, thereby to calculate storage time Tm. A threshold value Th is determined on the basis of the calculated storage time Tm, to update the content of a threshold value memory 13.

More specifically, the amount of stored data in the ring memory 7 obtained from the ring memory state judging unit 16 is divided by 8000 which is the sampling frequency in the D/A converter 8, thereby to find storage time Tm. A threshold value Th relative to the storage time Tm is found on the basis of previously produced data representing a threshold value Th relative to storage time Tm.

The following table shows one example of data representing a threshold value Th relative to storage time Tm in a case where the number of quantization bits for an A/D converter 2 is 12:

TABLE 1

| Tm | 0.25~0.5 sec | 0.5~0.75 sec | 0.75~1.0 sec | 1.0~1.25 sec | 1.25~1.5 sec | 1.5~1.75 sec | 1.75~2.5 sec | 2.5 sec or more |
|---|---|---|---|---|---|---|---|---|
| Th | $2^7$ | $2^8$ | $2^9$ | $2^{10}$ | $2^{11}$ | $2^{12}$ | $2^{13}$ | $2^{14}$ |

Furthermore, the threshold value may be changed on the basis of the amount of stored data in the ring memory 7 in the same manner as described above even in a case where it is judged which of the voice section and the silence section corresponds to the input signal by comparing the accumulated power value Pa in each frame and the threshold value, it is judged which of the voice section and the silence section corresponds to the input signal by comparing the average amplitude value W in each frame and the threshold value, and it is judged which of the voice section and the silence section corresponds to the input signal by comparing the accumulated amplitude value Wa in each frame and the threshold value, and it is judged which of the voice section and the silence section corresponds to the input signal by comparing the power spectrums in each frame and the threshold value.

Additionally, the pause continuation length Tdel for determining a point at which deletion of a silence section is started may be changed on the basis of the amount of stored data in the ring memory 7. Specifically, the pause continuation length Tdel is increased so that the smaller the amount of stored data in the ring memory 7 is, that is, the larger an empty area of the ring memory 7 is, the smaller a deleted portion of the silence section is. Consequently, output voice comes closer to natural voice.

Specifically, as shown in FIG. 41, a pause continuation length adjusting means 52 is provided. The pause continuation length adjusting means 52 obtains the amount of stored data in a ring memory 7 from a ring memory state judging unit 16. The obtained amount of stored data in the ring memory 7 is divided by the sampling frequency in a D/A converter 8, thereby to calculate storage time Tm. The pause continuation length Tdel is determined on the basis of the calculated storage time Tm, to update the content of a pause continuation length setting memory 17.

More specifically, the amount of stored data in the ring memory 7 obtained from the ring memory state judging unit 16 is divided by 8000 which is the sampling frequency in the D/A converter 8, thereby to find storage time Tm. A pause continuation length Tdel relative to the storage time Tm is found on the basis of previously produced data representing a pause continuation length Tdel relative to storage time Tm.

The following table shows one example of data representing a pause continuation length relative to storage time Tm at the time of reproduction at twice the speed of the VTR.

TABLE 2

| Tm | 0.25~0.5 sec | 0.5~0.75 sec | 0.75~1.0 sec | 1.0~1.25 sec | 1.25~1.5 sec | 1.5~1.75 sec | 1.75~2.5 sec | 2.5 sec or more |
|---|---|---|---|---|---|---|---|---|
| Tdel | 0.350 sec | 0.300 sec | 0.250 sec | 0.200 sec | 0.150 sec | 0.100 sec | 0.050 sec | 0.025 sec |

Figure 42:
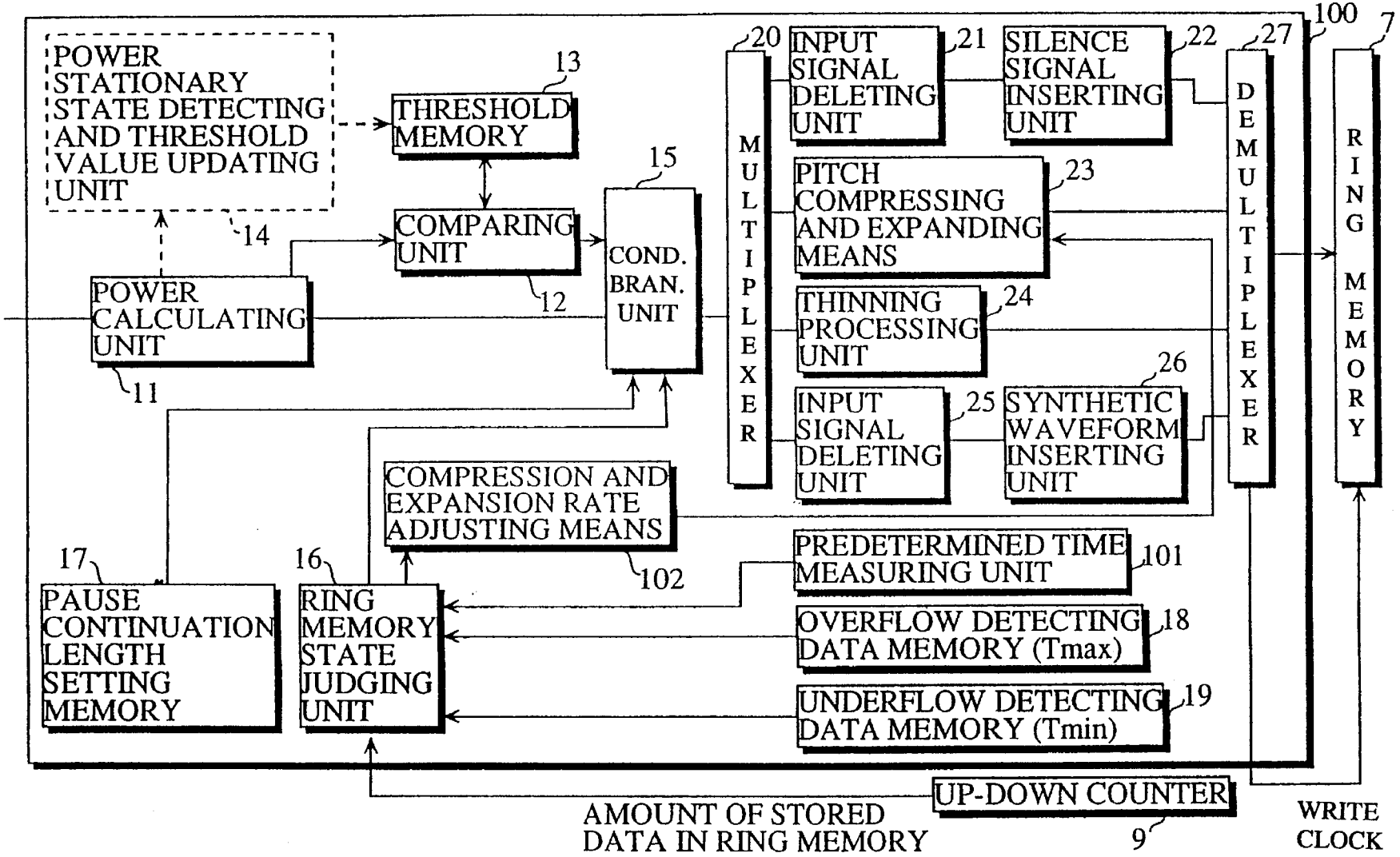
FIG. 42 is a block diagram showing another example of the voice speed converter.

FIG. 42 shows another example of the voice speed converter. In FIG. 42, the same units as those shown in FIG. 2 are assigned the same reference numerals and hence, the description thereof is not repeated.

In a voice speed converter 100, processing in the case corresponding to the first mode and the third mode differs from the processing performed by the voice speed converter 6 shown in FIG. 2. Specifically, when it is judged that the input signal corresponds to the voice section and the ring memory 7 is not in the state immediately before overflow (first mode) or when it is judged that the input signal corresponds to the silence section and the continuation length of the silence section is less than the set pause continuation length Tdel, and the ring memory 7 is not in the state immediately before overflow (third mode), the following processing is performed.

In the case corresponding to the first mode and the third mode, the sound signal is sent to pitch compressing and expanding means 23 through a multiplexer 20. The pitch compressing and expanding means 23 carries out variable speech control (VSC) and subjects the input signal to expansion and compression processing at a compression rate of a which is not less than a compression rate of 1/n, where n is the factor of the reproduction speed of the VTR. The compression rate α is determined by a compression and expansion rate adjusting means 102. Examples of an expanding and compressing method used include a PICOLA (Pointer Interval Control Overlap and Add) method using control of the amount of movement of a pointer and a TDHS (Time Domain Harmonic Scaling) method. A signal which is subjected to expansion and compression processing in the pitch expanding and compressing means 23 is sent to the ring memory 7 through a demultiplexer 27, and is written into the ring memory 7 in accordance with write clocks.

At the time of reproduction at twice the speed of the VTR, the sampling frequency fsAD in an A/D converter 2 is 16 KHZ, and the sampling frequency fsDA in a D/A converter 8 is 8 KHZ. Therefore, voice is outputted with the interval thereof being returned to the original one.

In the conventional general time-scale expansion and compression, the input signal is compressed at a compression rate of ½ at the time of reproduction at twice the speed. In other words, two pitch cycles are thinned into one pitch cycle. Therefore, the speed of output voice is twice the standard voice speed. That is, the speed of the output voice is twice the standard voice speed at the time of normal reproduction at twice the speed. However, the interval becomes the original one.

On the other hand, in the above described pitch expanding and compressing means 23 provided in the voice speed converter 100 shown in FIG. 42, expansion and compression processing is performed at a compression rate α of not less than ½ found by compression and expansion rate adjusting means 102. The compression and expansion rate adjusting means 102 determines the compression rate α so that the smaller the amount of writing to the ring memory 7 is than the amount of reading therefrom, the larger the compression rate is, that is, the lower the voice reproduction speed is, and the larger the amount of writing to the ring memory 7 is than the amount of reading therefrom, the smaller the compression rate is, that is, the higher the voice reproduction speed is on the basis of the amount of change in the amount of stored data for each unit time in the ring memory 7.

Specifically, a ring memory state judging unit 16 sends to the compression and expansion rate adjusting means 102 the amount of stored data in the ring memory 7 sent from an up-down counter 9 for each predetermined time measured by predetermined time measuring means 101 such as a timer. The compression and expansion rate adjusting means 102 subtracts the amount of stored data sent last time from the amount of stored data sent this time, thereby to find the amount of stored data per unit time. The found amount of change in the amount of stored data per unit time is divided by the sampling frequency in the D/A converter 8, thereby to calculate the amount of change ΔT in the expansion time per unit time. The compression rate α is determined on the basis of the calculated amount of change ΔT in the expansion time per unit time.

More specifically, the amount of stored data in the ring memory 7 is sent for each 2.0 second, for example, to the compression and expansion rate adjusting means 102. The amount of stored data sent last time is subtracted from the amount of stored data sent this time, thereby to find the amount of change per unit time. The amount of change in the amount of stored data per unit time is divided by 8000 which is the sampling frequency in the D/A converter 8, thereby to find the amount of change in expansion time ΔT. The compression rate α relative to the amount of change in the expansion time ΔT is found on the basis of previously produced data representing a compression rate relative to the amount of change in expansion time.

The following table shows one example of data representing a compression rate α relative to the amount of change in expansion time ΔT at the time of reproduction at twice the speed of the VTR. In this table, V represents a voice reproduction speed corresponding to the compression rate.

TABLE 3

| ΔT | 0.25 sec or less | 0.25~0.5 sec | 0.5~0.75 sec | 0.75~1.0 sec | 1.0~1.25 sec | 1.25~1.5 sec | 1.5~1.75 sec | 1.75~2.0 sec |
|---|---|---|---|---|---|---|---|---|
| α | 0.95 | 0.91 | 0.833 | 0.71 | 0.625 | 0.56 | 0.52 | 0.5 |
| V | 1.05 | 1.1 | 1.2 | 1.4 | 1.6 | 1.8 | 1.9 | 2.0 |

As can be seen from the table, the smaller the amount of change ΔT in the expansion time is, that is, the smaller the amount of change in the amount of stored data in the ring memory 7 per unit time (the amount of writing relative to the amount of reading) is, the larger the compression rate α is and the lower the voice reproduction speed is. Conversely, the larger the amount of writing relative to the amount of reading is, the smaller the compression rate α is and the higher the voice reproduction speed is. Consequently, it is possible to decrease the voice reproduction speed in the voice section while making a sound dropped portion in the voice section as small as possible.

It is assumed for convenience of illustration that the compression rate α is determined as not less than ½, for example, ⅔, which is not described in the foregoing table 3. In this case, three pitch cycles are thinned to two pitch cycles. Therefore, the speed of output voice becomes two-thirds the standard voice speed. Also in this case, the interval becomes the original one. If the input signal is compressed at a compression rate of ⅔, therefore, the signal is expanded by ⅔−½=⅙, as compared with a case where it is compressed at a compression rate of ½. The amount of expansion becomes the amount of stored data in the ring memory 7.

Even when the voice speed converter 100 shown in FIG. 42 is used, the above described various methods can be used as a method of judging which of the silence section and the voice section corresponds to the input signal.

Figure 43:
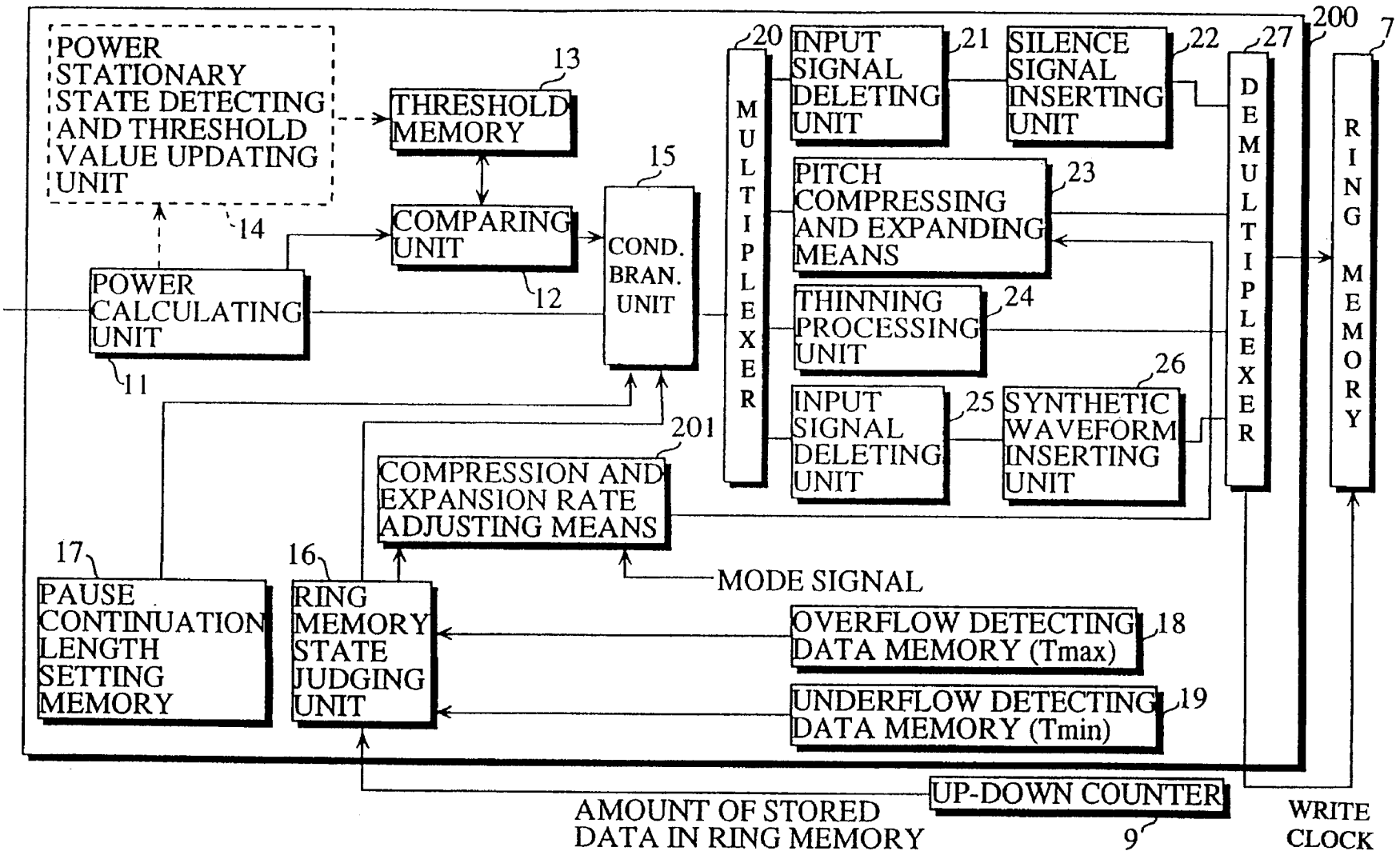
FIG. 43 is a block diagram showing still another example of the voice speed converter.

FIG. 43 illustrates still another example of the voice speed converter. In FIG. 43, the same units as those in FIG. 2 are assigned the same reference numerals and hence, the description thereof is not repeated.

In a voice speed converter 200, processing in the case corresponding to the first mode and the third mode differs from the processing performed by the voice speed converter 6 shown in FIG. 2.

In the case corresponding to the first mode or the third mode, an input sound signal is sent to pitch compressing and expanding means 23 through a multiplexer 20. The pitch compressing and expanding means 23 carries out variable speech control (VSC) and subjects the input signal to expansion and compression processing at a compression rate α of not less than 1/n, where n is the factor of the reproduction speed. The compression rate α is determined by compression and expansion rate adjusting means 201. Examples of an expanding and compressing method used include a PICOLA (Pointer Interval Control Overlap and Add) method using control of the amount of movement of a pointer and a TDHS (Time Domain Harmonic Scaling) method. The signal which is subjected to expansion and compression processing in the pitch expanding and compressing means 23 is sent to a ring memory 7 through a demultiplexer 27, and is written into the ring memory 7 in accordance with write clocks.

At the time of reproduction at twice the speed of the VTR, the sampling frequency fsAD in an A/D converter 2 is 16 KHZ, and the sampling frequency fsDA in a D/A converter 8 is 8 KHZ. Therefore, voice is outputted with the interval thereof being returned to the original one.

In the conventional general time-scale expansion and compression, the input signal is compressed at a compression rate of ½ at the time of reproduction at twice the speed of the VTR. In other words, two pitch cycles are thinned into one pitch cycle. Therefore, the speed of output voice is twice the standard voice speed. That is, the speed of output voice is twice the standard voice speed at the time of normal reproduction at twice the speed. However, the interval becomes the original one.

On the other hand, in the above described pitch expanding and compressing means 23 provided in the voice speed converter 200 shown in FIG. 43, the compression rate α is determined by the compression and expansion rate adjusting means 201 on the basis of a mode set using an operating unit (not shown) by a user and the change in the amount of stored data in the ring memory 7. The compression rate α is a value of not less than ½.

Types of modes set by the operating unit include a program setting mode for selecting a program and a fixing or variation setting mode for determining whether the compression rate α is fixed or varied with respect to a program set by the program setting mode.

The following table respectively show examples of programs set in the program setting mode at the time of reproduction at twice the speed of the VTR, the voice reproduction speeds (the compression rates) for the respective programs in a case where the fixing mode is set with respect to the programs, and the variation ranges of the voice reproduction speeds (the compression rates) for the respective programs in a case where the variation mode is set with respect to the programs.

TABLE 4

| | voice reproduction speed (fixing mode) | voice reproduction speed (variation mode) |
|---|---|---|
| F1 relay | 1.6 times the speed | 1.4 times the speed~ 2.0 times the speed |
| news | 1.4 times the speed | 1.25 times the speed~ 1.6 times the speed |
| dram | 1.25 times the speed | 1.0 times the speed~ 1.4 times the speed |
| game of shogi | 1.15 times the speed | 1.0 times the speed~ 1.2 times the speed |

The voice reproduction speed in the fixing mode and the range of the voice reproduction speed in the variation mode with respect to each program are set on the basis of the following idea. Specifically, the voice production speed differs depending on the content of the program. For example, the voice production speed of the F1 relay is the highest of the dram, the news, the F1 relay and the game of shogi, and the voice production speed is decreased in the order of the F1 relay, the news, the drum and the game of shogi. The difference in the voice production speed is caused by the number of moras per unit time. The mora means the relative length of a sound which is a unit of accent and intonation in a meter sound, and one mora corresponds to the length of one syllable including a monophthong.

The average value of the number of moras per unit time with respect to each program is as follows, although it is varied depending on a speaker:

| | |
|---|---|
| F1 relay | 12 moras/sec |
| news | 8 moras/sec |
| dram | 5 moras/sec |
| game of shogi | 3 moras/sec |

When the fixing mode is set, a compression rate corresponding to the voice reproduction speed in the fixing mode with respect to a set program is determined as the compression rate α. For example, a news program is set and the fixing mode is set, the compression rate α is determined as a compression rate corresponding to 1.4 times the speed, for example, 0.714. Thus, the higher the voice production speed of a program is, the smaller the compression rate is (the higher the voice reproduction speed is). Accordingly, the following advantages are obtained.

Specifically, the higher the voice production speed of a program is, the more easily the ring memory 7 enters the state immediately before overflow. Accordingly, in a program with high voice production speed, the compression rate is determined so that the voice reproduction speed comes closer to twice the speed. Conversely, in a program with low voice production speed, the compression rate is determined so that the voice reproduction speed becomes closer to the standard speed. Consequently, the voice reproduction speed becomes a speed which is not more than twice the speed and a speed depending on the original voice production speed, thereby to obtain more natural reproduced voice.

When the variation mode is set, the compression rate is determined in the following manner within the range of a compression rate corresponding to the voice reproduction speed in the variation mode with respect to the set program. The compression and expansion rate adjusting means 201 determines the compression rate α so that the smaller the amount of stored data in the ring memory 7 is, the larger the compression rate is, that is, the lower the voice reproduction speed is. The larger the amount of stored data in the ring memory 7 is, the smaller the compression rate is, that is, the higher the voice reproduction speed is.

Specifically, when it is judged that the case corresponds to the first mode or the third mode, the compression and expansion rate adjusting means 201 obtains the amount of stored data in the ring memory 7 from a ring memory state judging unit 16. The obtained amount of storage of the ring memory 7 is divided by the sampling frequency in a D/A converter 8, thereby to calculate storage time Tm. A compression rate α is determined on the basis of the calculated storage time Tm.

More specifically, the amount of stored data in the ring memory 7 obtained from the ring memory state judging unit 16 is divided by 8000 which is the sampling frequency in the D/A converter 8, thereby to find storage time Tm. A compression rate α relative to the storage time Tm is found on the basis of data representing a compression rate relative to storage time which is previously produced for each program.

The following table shows examples of data representing a compression rate α relative to storage time Tm with respect to an F1 relay program at the time of reproduction at twice the speed of the VTR. In this table, V represents a voice reproduction speed corresponding to the compression rate.

TABLE 5

| Tm | 0.25~0.5 sec | 0.5~0.75 sec | 0.75~1.0 sec | 1.0~1.25 sec | 1.25~1.5 sec | 1.5~1.75 sec | 1.75~2.5 sec | 2.5 sec or more |
|---|---|---|---|---|---|---|---|---|
| V | 1.4 | 1.5 | 1.6 | 1.7 | 1.8 | 1.9 | 1.95 | 2.0 |
| α | 0.714 | 0.667 | 0.625 | 0.588 | 0.555 | 0.526 | 0.513 | 0.5 |

As can be seen from the table, the smaller the amount of storage time Tm in the ring memory 7 is, the larger the compression rate α is, and the lower the voice reproduction speed is. Conversely, the larger the storage time Tm of the ring memory 7 is, the smaller the compression rate α is, and the higher the voice reproduction speed is. If the variation mode is set, therefore, a sound dropped portion in the voice section in the input signal can be made as small as possible in addition to the foregoing advantage described in the case where the fixing mode is set.

Although in the above described method, the sound dropped portion is made as small as possible. However, an F1 relay and a news spoken fast cannot be caught by the aged. In such a case, the sound dropped portion may be made larger, and the range of the voice reproduction speed relative to the storage time may be 1.0 times the speed to 1.3 times the speed, for example, to decrease the speed of voice. As a result, the sound dropped portion becomes larger, while the voice reproduction speed is decreased, so that the voice is easily caught also by the aged.

It is assumed that the compression rate α is determined as not less than ½, for example, ⅔ for convenience of illustration, which is not described in the foregoing table 5. In this case, three pitch cycles are thinned into two pitch cycles. Therefore, the speed of output voice becomes two-thirds the standard voice speed. Also in this case, the interval remains the original one. If the signal is compressed at a compression rate of ⅔, therefore, the signal is expanded by ⅔−½=⅙, as compared with a case where the signal is compressed at a compression rate of ½. The amount of expansion becomes the amount of stored data in the ring memory 7.

Even when the voice speed converter 200 shown in FIG. 43 is used, the above described various methods can be used as a method of judging which of the silence section and the voice section corresponds to the input signal.

Although description was made of a case where the input signal is an analog signal, the present invention is also applicable to a case where the input signal is a digital signal. For example, if a compressed digital sound signal is sent from an IC memory, a magnetic disk, a digital communication line or the like, the compressed digital sound signal is expanded and is converted into a PCM sound signal, after which the obtained PCM sound signal is stored once in a buffer. Thereafter, the PCM sound signal is read out of the buffer at a speed corresponding to the set factor of the reproduction speed and is sent to the frame memory 5 shown in FIG. 1.

Figure 44:
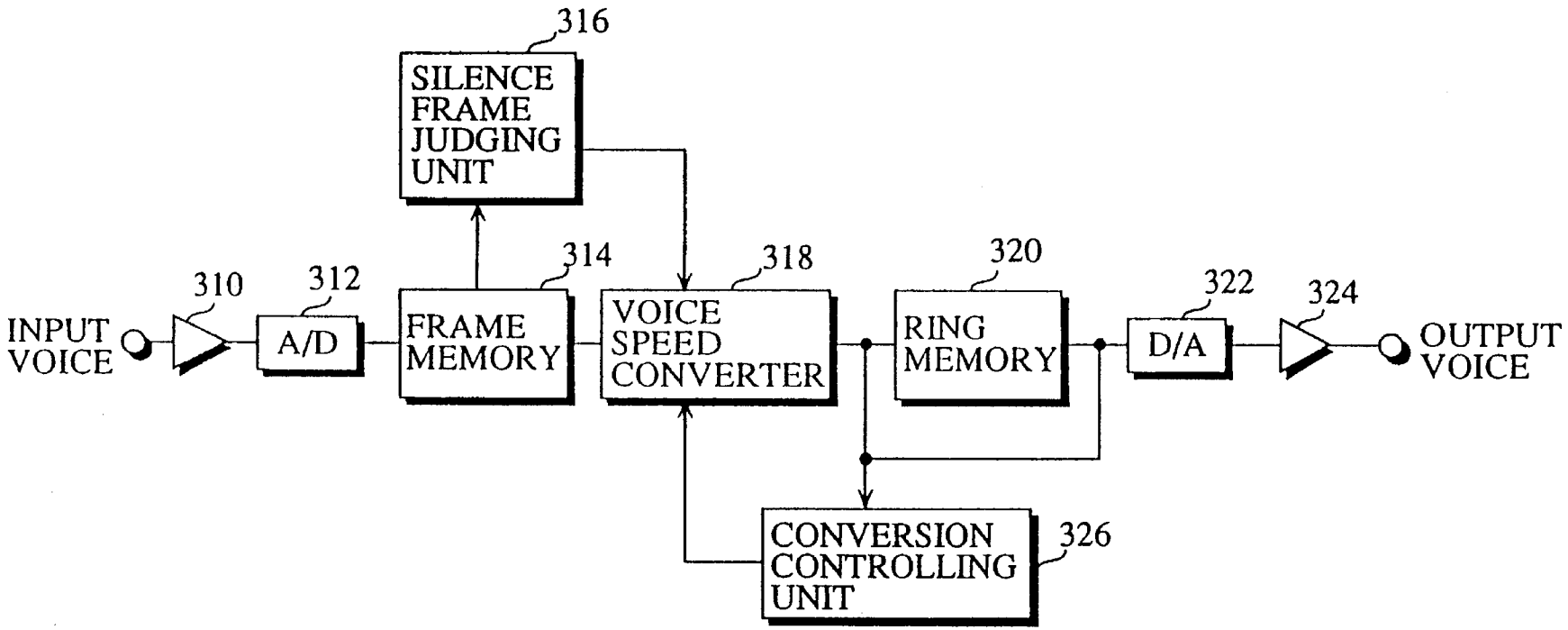
FIG. 44 is a block diagram showing the entire construction of a voice speed converting system according to a second embodiment of the present invention.

FIG. 44 shows a second embodiment of the present invention.

FIG. 44 illustrates the entire construction of a voice speed converting system.

A sound signal read out of a video tape is inputted to a filter amplifier 310. The filter amplifier 310 removes unnecessary high-frequency components and noises in the sound signal, and outputs the sound signal as a signal having predetermined intensity. An output of the filter amplifier 310 is inputted to an A/D converter 312. The A/D converter 312 samples an inputted analog sound signal at a predetermined sampling frequency (for example, 8 KHz to 72 KHz), and converts the analog sound signal into a digital sound signal composed of predetermined quantization bits (for example, 11 bits).

The digital sound signal is stored in a frame memory 314. A silence frame judging unit 316 is connected to the frame memory 314. The silence frame judging unit 316 calculates the average power for each frame with respect to sound signals stored in the frame memory 314. The calculated average power is compared with a predetermined threshold value, to judge that the frame corresponds to a silence frame if the average power is not more than the threshold value. One frame is composed of 200 sampling data (25 msec).

Sound data read out of the frame memory 314 are inputted to a voice speed converter 318. The voice speed converter 318 performs processing such as judgment processing of a silence section based on the result of the judgment by the silence frame judging unit 316, deletion procession of the silence section, and compression processing of a sound signal corresponding to a voice section (voice speed conversion processing) depending on the time difference between voice reproduction and image reproduction.

Serial sound data outputted from the voice speed converter 318 are sent to a ring memory 320 and are stored therein. Specifically, sound data inputted to the ring memory 320 are sequentially written into the ring memory 320 while write addresses in the ring memory 320 are sequentially incremented. The final write address is returned to the first write address. A DRAM composed of 256K bits, for example, is used as the ring memory 320.

It is assumed that the capacity of the ring memory 320 is 256K bits, and the frequency of read clocks for the ring memory 320 and the sampling frequency in a D/A converter 322 are 8 KHz. Assuming that the number of quantization bits for the A/D converter 312 is 11, it is possible to store sound data corresponding to approximately 2.9 seconds in the ring memory 320 by the following equation (5):

$$255000/(11\times8000)\approx2.9 \quad (5)$$

Data read out of the ring memory 320 are supplied as parallel data to the D/A converter 322, in which the data are converted into an analog signal. An output of the D/A converter 322 is supplied to a speaker or the like through a filter amplifier 324. Consequently, a sound signal is reproduced.

A conversion controlling unit 326 monitors write addresses of sound data to the ring memory 320 and read addresses of sound data from the ring memory 320. The time difference between a reproduced image and reproduced voice is presumed, to control the compression rate used for the compression processing performed by the voice speed converter 318.

Each of the frame memory 314, the silence frame judging unit 316 and the conversion controlling unit 326 is composed of one DSP (a digital signal processor).

Figure 45:
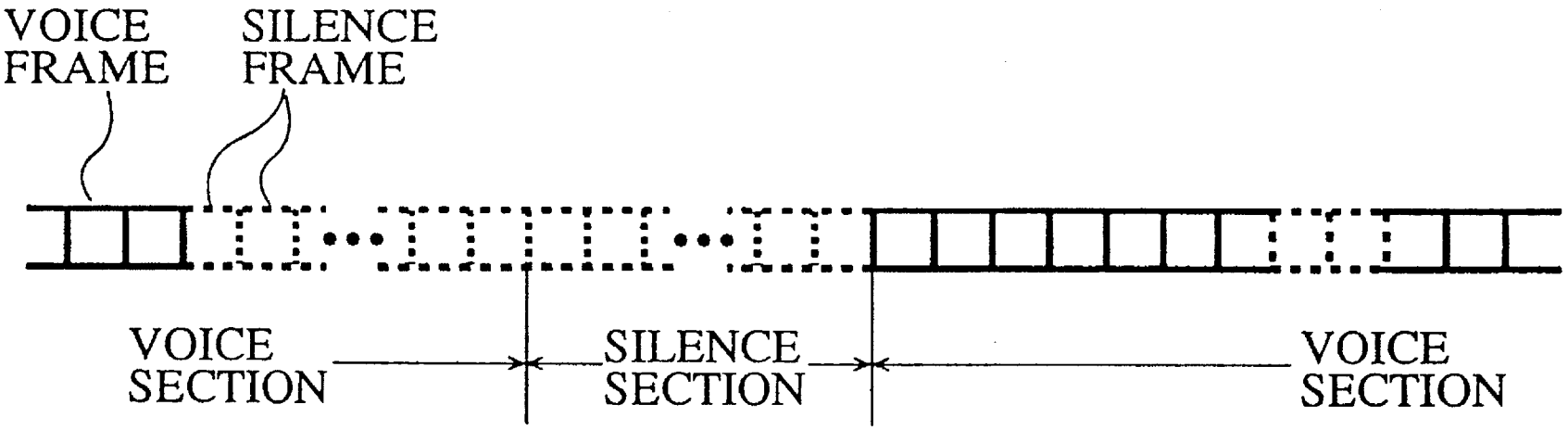
FIG. 45 is a schematic view showing the relationship between silence frames and a silence section.

Silence section judgment processing is performed in the following manner by the voice speed converter 318. If 40 or more silence frames which are judged by the silence frame judging unit 316 are continued as shown in FIG. 45, a section from a starting point of the 40-th silence frame to a starting point of the first voice frame subsequently coming shall be a silence section. Sound data which are judged to correspond to the silence section are deleted.

The reason why the section from the starting point of the 40-th silence frame is a silence section in a case where 40 or more silence frames are continued is that voice is difficult to hear if a pause of not more than one second in the voice is omitted, and voice is not difficult to hear if a pause of not less than one second in the voice is reduced to a pause of one second. In the silence frame judging unit 316, judgment processing of the silence section may be performed.

Description is made of the voice speed conversion processing performed by the voice speed converter 318. Since voice reproduced at twice the speed not only increases in speed but also doubles in frequency, it is difficult to identify a vowel. In order to return the interval to the standard interval, therefore, the frequency of sound data outputted is returned to the standard frequency. If the frequency of the sound data outputted at the time of reproduction at twice the speed is returned to the standard frequency, it is basically necessary to compress an input sound signal at a compression rate of ½. That is, it is necessary to divide the input sound signal into pitch cycles (5 to 20 ms) and thin two pitch cycles to one pitch cycle. Although the interval of voice obtained is returned to the original one in such a manner, the speed of the voice is doubled.

In the present embodiment, a silence section is deleted by the voice speed converter 318. Consequently, a signal corresponding to a voice section can be reproduced in a time period caused by deleting the silence section, thereby to make it possible to decrease the rate of thinning. That is, it is possible to increase the compression rate.

Figure 46:
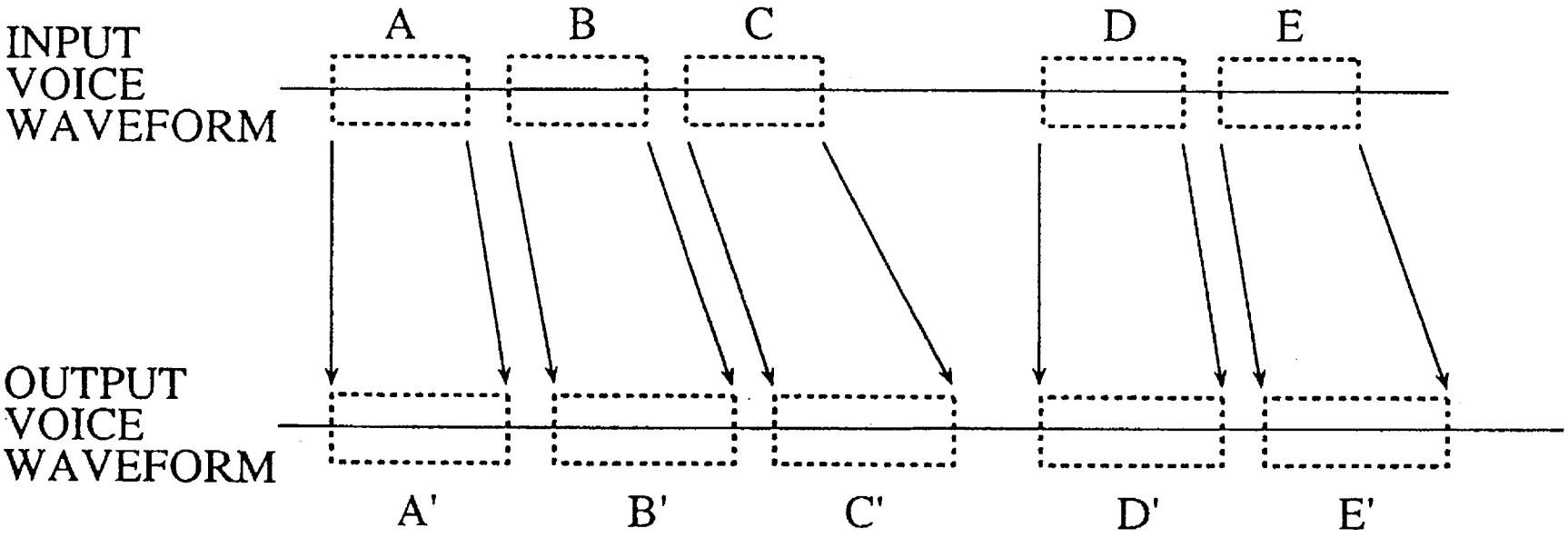
FIG. 46 is a schematic view for explaining input voice waveforms and output voice waveforms.

Specifically, it is assumed that a sound signal having a doubled frequency obtained by reproduction at twice the speed is reproduced in the same manner as waveforms A, B, C, D and E, as shown in FIG. 46. In the voice speed converter 316, a silence section can be deleted, whereby input sound data corresponding to a voice section are subjected to compression processing at a compression rate of ⅔ to ¾ which is more than ½. Consequently, waveforms outputted from the voice speed converter 318, for example, waveforms A', B', C', D' and E' are made longer, as compared with the input waveforms. The frequency in the output waveform is returned to the original standard frequency.

Consequently, it is possible to suppress the speed of output voice at the time of reproduction at twice the speed to approximately 1.3 to 1.5 times the standard voice speed, to obtain output voice which is easily caught also at the time of reproduction at twice the speed.

Description is made of a compression rate employed in the compression processing performed by the voice speed converter 318.

Generally it is impossible to previously know what percentage of the input sound signal includes the silence section. For example, the silence section is relatively small in a program such as the news and the weather forecast, while being relatively large in relays of a dram and an event. Consequently, the most suitable compression rate cannot be uniformly determined. It is desirable to select a suitable value as the compression rate depending on the contents.

In the present embodiment, the conversion controlling unit 326 controls the compression rate on the basis of the margin of the ring memory 320. The ring memory 320 sequentially increments addresses. The final address is returned to the first address, to write and read data. After data are written into all the addresses in the ring memory 320, inputted sound signals are written in place of the data already written, whereby sound signals corresponding to a predetermined time period are always recorded on the ring memory 320.

If a value obtained by subtracting the total amount of reading from the total amount of writing (the amount of stored data in the ring memory 320) is within the capacity of the ring memory 320, no problem arises. If the amount of stored data in the ring memory 320 exceeds the capacity of the ring memory 320, however, the position for writing is beyond the position for reading, so that a portion which is not read out in the sound data stored in the ring memory 320 arises.

Figure 47:
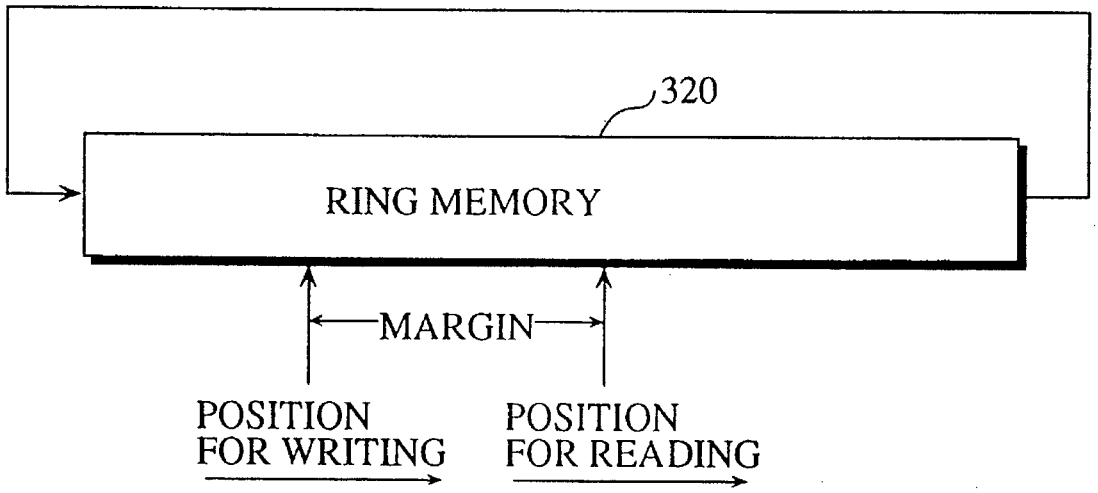
FIG. 47 is a schematic view for explaining the margin of a ring memory.

Specifically, in FIG. 47, the position for writing and the position for reading of the ring memory 320 are moved rightward. However, the moving speeds of both the positions do not necessarily coincide with each other. The reason for this is that the reading speed from the ring memory 320 is constant, while the writing speed to the ring memory 320 varies depending on the ratio of the voice section to the silence section and the compression rate.

Immediately after reproduction is started, written data are instantly read out, whereby the position for reading is just behind the position for writing. The larger the silence section is and the larger the compression rate is, the lower the writing speed is. Conversely, the smaller the silence section is and the smaller the compression rate is, the higher the writing speed is. If the writing speed is increased and the amount of writing is larger than the amount of reading by the capacity of the ring memory 320, the position for wiring is beyond the position for reading. Consequently, a portion which is not read out in the sound data stored in the ring memory 320 arises.

In the present embodiment, therefore, the compression rate is controlled depending on the margin of the ring memory 320 found on the basis of the amount of stored data in the ring memory 320, as shown in FIG. 47, so as to prevent such circumstances from occurring.

Specifically, the compression rate is changed into eight stages depending on the margin so that the factor of the output voice speed relative to the standard voice speed is changed into 8 stages in the range of 1 to 2 at the time of reproduction at twice the speed. The compression rate is changed into eight stages depending on the margin so that the factor of the output voice speed relative to the standard voice speed is changed into 8 stages in the range of 1 to 3 at the time of reproduction at three times the speed.

TABLE 6

| margin | 4.0 or more | 3.5 or more | 3.0 or more | 2.5 or more | 2.0 or more | 1.5 or more | 1.0 or more | 0..5 or more |
|---|---|---|---|---|---|---|---|---|
| factor of speed | 1 | 1.1 | 1.2 | 1.3 | 1.4 | 1.6 | 1.8 | 2.0 |

Therefore, if the silence section is large, the margin can be increased by deleting the silence section, whereby the output voice speed comes closer to the standard voice speed. On the other hand, when the silence section is small, the output voice speed becomes twice the standard voice speed so that no voice section is deleted.

Means for subjecting the sound data to compression processing and means for deleting the silence section may be provided in the succeeding stage of the ring memory 320. In this case, the reading speed from the ring memory 320 is controlled.

At the time of reproduction at the standard speed, the sound data corresponding to the silence section are deleted and the sound data corresponding to the voice section are expanded, thereby to make it possible to convert voice with high speed into voice with low speed. Consequently, voice with high speed can be changed into voice which is easily caught by the aged.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A voice speed converting system comprising:

setting means for setting a set factor for a reproduction speed;

voice speed conversion processing means for subjecting an input sound signal to voice speed conversion processing;

a ring memory to which an output of the voice speed conversion processing means is written;

reading means for reading out data from the ring memory at predetermined speed; and stored data amount calculating means for calculating an amount of stored data in the ring memory on the basis of a write signal and a read signal for the ring memory, the voice speed conversion processing means including section judging means for judging which of a voice section and a silence section corresponds to the input sound signal, and signal processing means for subjecting the input sound signal to compression and expansion processing according to the set factor of the reproduction speed or deletion processing, in response to an output of the section judging means and an output of the stored data amount calculating means, and the signal processing means including means for deleting the input sound signal until the ring memory enters a state immediately before underflow when the ring memory enters a state immediately before overflow.

2. The voice speed converting system according to claim 1, wherein the signal processing means includes mode judging means for judging which of the following modes corresponds to a present state on the basis of output of the section judging means and output of the stored data amount calculating means:

(a) a first mode in which the input sound signal corresponds to the voice section and the ring memory is not in a state immediately before overflow, (b) a second mode in which the input sound signal corresponds to the voice section and the ring memory is in the state immediately before overflow, (c) a third mode in which the input sound signal corresponds to the silence section and a continuation length of the silence section is less than a predetermined value, and the ring memory is not in the state immediately before overflow, (d) a fourth mode in which the input sound signal corresponds to the silence section and the continuation length of the silence section is less than the predetermined value, and the ring memory is in the state immediately before overflow, (e) a fifth mode in which the input sound signal corresponds to the silence section and the continuation length of the silence section is not less than the predetermined value, and the ring memory is not in a state immediately before underflow, (f) a sixth mode in which the input sound signal corresponds to the silence section and the continuation length of the silence section is not less than the predetermined value, and the ring memory is in the state immediately before underflow, first processing means for subjecting the sound signal to the compression and expansion processing at a compression rate of more than 1/n, where n is a set factor for reproduction speed, when it is judged that the present state corresponds to the first mode or the third mode, second processing means for deleting the sound signal until the ring memory enters the state immediately before underflow when it is judged that the present state corresponds to the second mode or the fourth mode, third processing means for deleting the sound signal corresponding to the silence section when it is judged that the present state corresponds to the fifth mode, and fourth processing means for performing the compression and expansion processing at a compression rate of $1/n \pm \alpha$ ($\alpha$ is a value which is not less than 0 nor more than 1), where n is the set factor of the reproduction speed, when it is judged that the present state corresponds to the sixth mode.

3. The voice speed converting system according to claim 1, wherein the section judging means comprises means for calculating an average power value of a required number of sound signals inputted to a frame memory, and judging means for judging which of the voice section and the silence section corresponds to the input voice on the basis of the calculated average power value and a predetermined threshold value.

4. The voice speed converting system according to claim 1, wherein the section judging means comprises means for calculating an accumulated power value of a required number of sound signals inputted to a frame memory, and judging means for judging which of the voice section and the silence section corresponds to the input voice on the basis of the calculated accumulated power value and a predetermined threshold value.

5. The voice speed converting system according to claim 1, wherein the section judging means comprises means for calculating an average amplitude value of the required number of sound signals inputted to a frame memory, and judging means for judging which of the voice section and the silence section corresponds to the input voice on the basis of the calculated average amplitude value and a predetermined threshold value.

6. The voice speed converting system according to claim 1, wherein the section judging means comprises means for calculating an accumulated amplitude value of a required number of sound signals inputted to a frame memory, and judging means for judging which of the voice section and the silence section corresponds to the input voice on the basis of the calculated accumulated amplitude value and a predetermined threshold value.

7. The voice speed converting system according to claim 1, wherein the section judging means comprises detecting means for detecting the periodicity of a required number of sound signals inputted to a frame memory, and judging means for judging which of the voice section and the silence section corresponds to the input voice on the basis of the detected periodity.

8. The voice speed converting system according to claim 1, wherein the section judging means comprises calculating means for calculating power spectrums corresponding to a predetermined one or a plurality of frequency bands of the required number of sound signals inputted to a frame memory, and judging means for judging which of the voice section and the silence section corresponds to the input voice on the basis of the calculated power spectrums and a predetermined threshold value.

9. A voice speed converting system comprising:

analog-to-digital converting means for sampling an inputted analog sound signal at a sampling frequency corresponding to a set factor of a reproduction speed;

a frame memory to which a sound signal outputted from the analog-to-digital converting means is inputted;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory on the basis of a read signal having a frequency equal to a sampling frequency at the time of reproduction at a standard speed; and stored data amount calculating means for calculating the amount of stored data in the ring memory on the basis of a write signal and the read signal for the ring memory, the voice speed conversion processing means including section judging means for judging which of a voice section and a silence section corresponds to input voice corresponding to the required number of sound signals inputted to the frame memory, and signal processing means for subjecting said required number of sound signals to compression and expansion processing or deletion processing in response to an output of the section judging means and an output of the stored data amount calculating means, the signal processing means including means for deleting the input sound signal until the ring memory enters a state immediately before underflow when the ring memory enters a state immediately before overflow.

10. A voice speed converting system comprising:

a frame memory to which an inputted digital sound signal is written at a speed corresponding to a set factor of a reproduction speed;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory at predetermined speed; and stored data amount calculating means for calculating the amount of stored data in the ring memory on the basis of a write signal and a read signal for the ring memory, the voice speed conversion processing means including section judging means for judging which of a voice section and a silent section corresponds to input voice corresponds to the required number of sound signals inputted to the frame memory, and signal processing means for subjecting said required number of sound signals to compression and expansion processing or deletion processing in response to an output of the section judging means and an output of the stored data amount calculating means, the signal processing means including means for deleting the input sound signal until the ring memory enters a state immediately before underflow when the ring memory enters a state immediately before overflow.

11. A voice speed converting system comprising:

voice speed conversion processing means for subjecting an input sound signal to voice speed conversion processing;

a ring memory to which an output of the voice speed conversion processing means is written;

reading means for reading out data from the ring memory at predetermined speed; and stored data amount calculating means for calculating the amount of stored data in the ring memory on the basis of a write signal and a read signal for the ring memory, the voice speed conversion processing means comprising section judging means for judging which of a voice section and a silence section corresponds to the input sound signal, and signal processing means for subjecting the input sound signal to compression and expansion processing or deletion processing in response to an output of the section judging means and an output of the stored data amount calculating means, signal processing means comprising means for performing the compression and expansion processing at a compression rate determined depending on the amount of change per unit time of the amount of stored data in the ring memory which is a compression rate of not less than 1/n, where n is a set factor for a reproduction speed, when the input sound signal corresponds to the voice section and the ring memory is not in a state immediately before overflow.

12. The voice speed converting system according to claim 11, wherein signal processing means comprises mode judging means for judging which of the following modes corresponds to a present state on the basis of the output of the section judging means and the output of the stored data amount calculating means:

(a) a first mode in which the input sound signal corresponds to the voice section and the ring memory is not in the state immediately before overflow, (b) a second mode in which the input sound signal corresponds to the voice section and the ring memory is in the state immediately before overflow, (c) a third mode in which the input sound signal corresponds to the silence section and a continuation length of the silence section is less than a predetermined value, and the ring memory is not in the state immediately before overflow, (d) a fourth mode in which the input sound signal corresponds to the silence section and the continuation length of the silence section is less than a predetermined value, and the ring memory is in the state immediately before overflow, (e) a fifth mode in which the input sound signal corresponds to the silence section and the continuation length of the silence section is not less than a predetermined value, and the ring memory is not in a state immediately before underflow, and (f) a sixth mode in which the input sound signal corresponds to the silence section and the continuation length of the silence section is not less than a predetermined value, and the ring memory is in a state immediately before underflow, first processing means for performing the compression and expansion processing at a compression rate determined depending on the amount of change per unit time of the amount of stored data in the ring memory which is a compression rate of not less than 1/n, where n is the set factor of the reproduction speed, when it is judged that the present state corresponds to the first mode or the third mode, second processing means for deleting the sound signal until the ring memory enters the state immediately before underflow when it is judged that the present state corresponds to the second mode or the fourth mode, third processing means for deleting the sound signal corresponding to the silence section when it is judged that the present state corresponds to the fifth mode, and fourth processing means for performing the compression and expansion processing at a compression rate of $1/n \pm \alpha$ ($\alpha$ is a value which is not less than 0 nor more than 1), where n is the set factor of the reproduction speed, when it is judged that the present state corresponds to the sixth mode.

13. A voice speed converting system comprising:

analog-to-digital converting means for sampling an inputted analog sound signal at a sampling frequency corresponding to a set factor of a reproduction speed;

a frame memory to which a sound signal outputted from the analog-to-digital converting means is inputted;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory on the basis of a read signal having a frequency equal to a sampling frequency at the time of reproduction at a standard speed; and stored data amount calculating means for calculating the amount of stored data in the ring memory on the basis of a write signal and the read signal for the ring memory, the voice speed conversion processing means comprising section judging means for judging which of a voice section and a silence section corresponds to input voice corresponding to the required number of sound signals inputted to the frame memory, and signal processing means for subjecting said required number of sound signals to compression and expansion processing or deletion processing in response to an output of the section judging means and an output of the stored data amount calculating means, the signal processing means comprising means for performing the compression and expansion processing at a compression rate determined depending on the amount of change per unit time of the amount of stored data in the ring memory which is a compression rate of not less than 1/n, where n is the set factor of the reproduction speed, when the input voice corresponds to the voice section and the ring memory is not in a state immediately before overflow.

14. A voice speed converting system comprising:

a frame memory to which an inputted digital sound signal is written at a speed corresponding to a set factor of a reproduction speed;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory at predetermined speed; and stored data amount calculating means for calculating the amount of stored data in the ring memory on the basis of a write signal and a read signal for the ring memory, the voice speed conversion processing means comprising section judging means for judging which of a voice section and a silence section corresponds to input voice corresponding to the required number of sound signals inputted to the frame memory, and signal processing means for subjecting said required number of sound signals to compression and expansion processing or deletion processing in response to an output of the section judging means and an output of the stored data amount calculating means, signal processing means comprising means for performing the compression and expansion processing at a compression rate determined depending on the amount of change per unit time of the amount of stored data in the ring memory which is a compression rate of not less than 1/n, where n is the set factor of the reproduction speed, when the input voice corresponds to the voice section and the ring memory is not in a state immediately before overflow.

15. A voice speed converting system comprising:

voice speed conversion processing means for subjecting an input sound signal to voice speed conversion processing;

a ring memory to which an output of the voice speed conversion processing means is written;

reading means for reading out data from the ring memory at predetermined speed; and stored data amount calculating means for calculating the amount of stored data in the ring memory on the basis of a write signal and a read signal for the ring memory, the voice speed conversion processing means comprising section judging means for judging which of a voice section and a silence section corresponds to the input sound signal, and signal processing means for subjecting the input sound signal to compression and expansion processing or deletion processing in response to an output of the section judging means and an output of the stored data amount calculating means, the signal processing means comprising means for performing the compression and expansion processing at a compression rate determined depending on the type of program set by an operator which is a compression rate of not less than 1/n, where n is a set factor of a reproduction speed, when the input sound signal corresponds to the voice section and the ring memory is not in a state immediately before overflow.

16. The voice speed converting system according to claim 15, wherein the signal processing means comprises mode judging means for judging which of the following modes corresponds to a present state on a basis of a output of the section judging means and the output of the stored data amount calculating means:

(a) a first mode in which the input sound signal corresponds to the voice section and the ring memory is not in the state immediately before overflow, (b) a second mode in which the input sound signal corresponds to the voice section and the ring memory is in the state immediately before overflow, (c) a third mode in which the input sound signal corresponds to a silence section and a continuation length of the silence section is less than a predetermined value, and the ring memory is not in the state immediately before overflow, (d) a fourth mode in which the input sound signal corresponds to the silence section and the continuation length of the silence section is less than a predetermined value, and the ring memory is in the state immediately before overflow, (e) a fifth mode in which the input sound signal corresponds to the silence section and the continuation length of the silence section is not less than a predetermined value, and the ring memory is not in a state immediately before underflow, and (f) a sixth mode in which the input sound signal corresponds to the silence section and the continuation length of the silence section is not less than a predetermined value, and the ring memory is in a state immediately before underflow, first processing means for performing the compression and expansion processing at a compression rate determined depending on the type of program set by an operator which is a compression rate of not less than 1/n, where n is the set factor of the reproduction speed, when it is judged that the present state corresponds to the first mode or the third mode, second processing means for deleting the sound signal until the ring memory enters the state immediately before underflow when it is judged that the present state corresponds to the second mode or the fourth mode, third processing means for deleting the sound signal corresponding to the silence section when it is judged that the present state corresponds to the fifth mode, and fourth processing means for performing the compression and expansion processing at a compression rate of $1/n \pm \alpha$ ($\alpha$ is a value which is not less than 0 nor more than 1), where n is the set factor of the reproduction speed, when it is judged that the present state corresponds to the sixth mode.

17. A voice speed converting system comprising:

analog-to-digital converting means for sampling an inputted analog sound signal at a sampling frequency corresponding to a set factor of a reproduction speed;

a frame memory to which a sound signal outputted from the analog-to-digital converting means is inputted;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory on the basis of a read signal having a frequency equal to a sampling frequency at a time of reproduction at a standard speed; and stored data amount calculating means for calculating the amount of stored data in the ring memory on the basis of a write signal and the read signal for the ring memory, the voice speed conversion processing means comprising section judging means for Judging which of a voice section and a silence section corresponds to input voice corresponding to the required number of sound signals inputted to the frame memory, and signal processing means for subjecting said required number of sound signals to compression and expansion processing or deletion processing in response to an output of the section judging means and an output of the stored data amount calculating means, the signal processing means comprising means for performing the compression and expansion processing at a compression rate determined depending on the type of program set by an operator which is a compression rate of not less than 1/n, where n is the set factor of the reproduction speed, when the input voice corresponds to the voice section and the ring memory is not in a state immediately before overflow.

18. A voice speed converting system comprising:

a frame memory to which an inputted digital sound signal is written at a speed corresponding to a set factor of a reproduction speed;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory at predetermined speed; and stored data amount calculating means for calculating the amount of stored data in the ring memory on the basis of a write signal and a read signal for the ring memory, the voice speed conversion processing means comprising section judging means for judging which of a voice section and a silence section corresponds to input voice corresponding to the required number of sound signals inputted to the frame memory, and signal processing means for subjecting said required number of sound signals to compression and expansion processing or deletion processing in response to an output of the section judging means and an output of the stored data amount calculating means, the signal processing means comprising means for performing the compression and expansion processing at a compression rate determined depending on the type of program set by an operator which is a compression rate of not less than 1/n, where n is the set factor of the reproduction speed, when the input voice corresponds to the voice section and the ring memory is not in a state immediately before overflow.

19. A voice speed converting system comprising:

voice speed conversion processing means for subjecting an input sound signal to voice speed conversion processing;

a ring memory to which an output of the voice speed conversion processing means is written;

reading means for reading out data from the ring memory at predetermined speed; and stored data amount calculating means for calculating the amount of stored data in the ring memory on the basis of a write signal and a read signal for the ring memory, the voice speed conversion processing means comprising section judging means for judging which of a voice section and a silence section corresponds to the input sound signal, and signal processing means for subjecting the input sound signal to compression and expansion processing or deletion processing in response to an output of the section judging means and an output of the stored data amount calculating means, the signal processing means comprising means for performing the compression and expansion processing at a compression rate determined depending on the type of program set by an operator and the amount of stored data in the ring memory which is a compression rate of not less than 1/n, where n is a set factor of a reproduction speed, when the input sound signal corresponds to the voice section and the ring memory is not in a state immediately before overflow.

20. The voice speed converting system according to claim 19, wherein the signal processing means comprises mode judging means for judging which of the following modes corresponds to a present state on the basis of the output of the section judging means and the output of the stored data amount calculating means:

(a) a first mode in which the input sound signal corresponds to the voice section and the ring memory is not in the state immediately before overflow, (b) a second mode in which the input sound signal corresponds to the voice section and the ring memory is in the state immediately before overflow, (c) a third mode in which the input sound signal corresponds to the silence section and a continuation length of the silence section is less than a predetermined value, and the ring memory is not in the state immediately before overflow, (d) a fourth mode in which the input sound signal corresponds to the silence section and the continuation length of the silence section is less than a predetermined value, and the ring memory is in the state immediately before overflow, (e) a fifth mode in which the input sound signal corresponds to the silence section and the continuation length of the silence section is not less than a predetermined value, and the ring memory is not in a state immediately before underflow, and (f) a sixth mode in which the input sound signal corresponds to the silence section and the continuation length of the silence section is not less than a predetermined value, and the ring memory is in a state immediately before underflow, first processing means for performing the compression and expansion processing at a compression rate determined depending on the type of program set by an operator and the amount of stored data in the ring memory which is a compression rate of not less than 1/n, where n is the set factor of the reproduction speed, when it is judged that the present state corresponds to the first mode or the third mode, second processing means for deleting the sound signal until the ring memory enters the state immediately before underflow when it is judged that the present state corresponds to the second mode or the fourth mode, third processing means for deleting the sound signal corresponding to the silence section when it is judged that the present state corresponds to the fifth mode, and fourth processing means for performing the compression and expansion processing at a compression rate of $1/n\pm\alpha$ ($\alpha$ is a value which is not less than 0 nor more than 1), where n is the set factor of the reproduction speed, when it is judged that the present state corresponds to the sixth mode.

21. A voice speed converting system comprising:

analog-to-digital converting means for sampling an inputted analog sound signal at a sampling frequency corresponding to the a factor of a reproduction speed;

a frame memory to which a sound signal outputted from the analog-to-digital converting means is inputted;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory on the basis of a read signal having a frequency equal to a sampling frequency at the time of reproduction at a standard speed; and stored data amount calculating means for calculating the amount of stored data in the ring memory on the basis of a write signal and the read signal for the ring memory, the voice speed conversion processing means comprising section judging means for judging which of a voice section and a silence section corresponds to input voice corresponding to the required number of sound signals inputted to the frame memory, and signal processing means for subjecting said required number of sound signals to compression and expansion processing or deletion processing in response to an output of the section judging means and an output of the stored data amount calculating means, the signal processing means comprising means for performing the compression and expansion processing at a compression rate determined based on the type of program set by an operator and the amount of stored data in the ring memory which is a compression rate of not less than 1/n, where n is a set factor of the reproduction speed, when the input voice corresponds to the voice section and the ring memory is not in a state immediately before overflow.

22. A voice speed converting system comprising:

a frame memory to which an inputted digital sound signal is written at a speed corresponding to a set factor of a reproduction speed;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory at predetermined speed; and stored data amount calculating means for calculating the amount of stored data in the ring memory on the basis of a write signal and a read signal for the ring memory, the voice speed conversion processing means comprising section judging means for judging which of a voice section and a silence section corresponds to input voice corresponding to the required number of sound signals inputted to the frame memory, and signal processing means for subjecting said required number of sound signals to compression and expansion processing or deletion processing in response to an output of the section judging means and an output of the stored data amount calculating means, the signal processing means comprising means for performing the compression and expansion processing at a compression rate determined based on the type of program set by an operator and the amount of stored data in the ring memory which is a compression rate of not less than 1/n, where n is the set factor of the reproduction speed, when the input voice corresponds to the voice section and the ring memory is not in a state immediately before overflow.

23. A voice speed converting system comprising:

voice speed conversion processing means for subjecting an input sound signal to voice speed conversion processing;

a ring memory to which an output of the voice speed conversion processing means is written;

reading means for reading out data from the ring memory at predetermined speed;

stored data amount calculating means for calculating the amount of stored data in the ring memory on the basis of a write signal and a read signal for the ring memory, the voice speed conversion processing means comprising section judging means for judging which of a voice section and a silence section corresponds to the input sound signal, and signal processing means for subjecting the input sound signal to compression and expansion processing or deletion processing in response to an output of the section judging means and an output of the stored data amount calculating means, the signal processing means comprising means for performing the compression and expansion processing at a compression rate determined depending on the type of program set by an operator which is a compression rate of not less than 1/n, where n is a set factor of a reproduction speed, when a compression rate fixing mode is selected in a case where the input sound signal corresponds to the voice section and the ring memory is not in a state immediately before overflow, while performing the compression and expansion processing at a compression rate determined based on the type of program set by an operator and the amount of stored data in the ring memory which is a compression rate of not less than 1/n, where n is the set factor of the reproduction speed, when a compression rate variation mode is selected in a case where the input sound signal corresponds to the voice section and the ring memory is not in a state immediately before overflow.

24. The voice speed converting system according to claim 23, wherein the signal processing means comprises mode judging means for judging which of the following modes corresponds to a present state on the basis of the output of the section judging means and the output of the stored data amount calculating means:

(a) a first mode in which the input sound signal corresponds to the voice section and the ring memory is not in the state immediately before overflow, (b) a second mode in which the input sound signal corresponds to the voice section and the ring memory is in the state immediately before overflow, (c) a third mode in which the input sound signal corresponds to the silence section and a continuation length of the silence section is less than a predetermined value, and the ring memory is not in the state immediately before overflow, (d) a fourth mode in which the input sound signal corresponds to the silence section and the continuation length of the silence section is less than a predetermined value, and the ring memory is in the state immediately before overflow, (e) a fifth mode in which the input sound signal corresponds to the silence section and the continuation length of the silence section is not less than a predetermined value, and the ring memory is not in a state immediately before underflow, (f) a sixth mode in which the input sound signal corresponds to the silence section and the continuation length of the silence section is not less than a predetermined value, and the ring memory is in the state immediately before underflow, first processing means for performing the compression and expansion processing at a compression rate determined based on the type of program set by an operator which is a compression rate of not less than 1/n, where n is the set factor of the reproduction speed, when a compression rate fixing mode is selected in a case where it is judged that the present state corresponds to the first mode or the third mode, while performing the compression and expansion processing at a compression rate determined based on the type of program set by an operator and the amount of stored data in the ring memory which is a compression rate of not less than 1/n, where n is the set factor of the reproduction speed, when a compression rate variation mode is selected in a case where it is judged that the present state corresponds to the first mode or the third mode, second processing means for deleting the sound signal until the ring memory enters the state immediately before underflow when it is judged that the present state corresponds to the second mode or the fourth mode, third processing means for deleting the sound signal corresponding to the silence section when it is judged that the present state corresponds to the fifth mode, and fourth processing means for performing the compression and expansion processing at a compression rate of $1/n \pm \alpha$ ($\alpha$ is a value which is not less than 0 nor more than 1), where n is the set factor of the reproduction speed, when it is judged that the present state corresponds to the sixth mode.

25. A voice speed converting system comprising:

analog-to-digital converting means for sampling an inputted analog sound signal at a sampling frequency corresponding to a set factor of a reproduction speed;

a frame memory to which a sound signal outputted from the analog-to-digital converting means is inputted;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory on the basis of a read signal having a frequency equal to a sampling frequency at a time of reproduction at a standard speed; and stored data amount calculating means for calculating the amount of stored data in the ring memory on the basis of a write signal and the read signal for the ring memory, the voice speed conversion processing means comprising section judging means for judging which of a voice section and a silence section corresponds to input voice corresponding to the required number of sound signals inputted to the frame memory, and signal processing means for subjecting said required number of sound signals to compression and expansion processing or deletion processing in response to an output of the section judging means and an output of the stored data amount calculating means, the signal processing means comprising means for performing the compression and expansion processing at a compression rate determined based on the type of program set by an operator which is a compression rate of not less than 1/n, where n is the set factor of the reproduction speed, when a compression rate fixing mode is selected in a case where the input voice corresponds to the voice section and the ring memory is not in a state immediately before overflow, while performing the compression and expansion processing at a compression rate determined based on the type of program set by an operator and the amount of stored data in the ring memory which is a compression rate of not less than 1/n, where n is the set factor of the reproduction speed, when a compression rate variation mode is selected in a case where the input voice corresponds to the voice section and the ring memory is not in a state immediately before overflow.

26. A voice speed converting system comprising:

a frame memory to which an inputted digital sound signal is written at a speed corresponding to a set factor of a reproduction speed;

voice speed conversion processing means for subjecting, every time a required number of sound signals are inputted to the frame memory, the sound signals to voice speed conversion processing;

a ring memory to which an output of the voice speed conversion processing means is written;

reading means for reading out data from the ring memory at predetermined speed; and stored data amount calculating means for calculating the amount of stored data in the ring memory on the basis of a write signal and a read signal for the ring memory, the voice speed conversion processing means comprising section judging means for judging which of a voice section and a silence section corresponds to input voice corresponding to the required number of sound signals inputted to the frame memory, and signal processing means for subjecting said required number of sound signals to compression and expansion processing or deletion processing in response to an output of the section judging means and an output of the stored data amount calculating means, the signal processing means comprising means for performing the compression and expansion processing at a compression rate determined based on the type of program set by an operator which is a compression rate of not less than 1/n, where n is the set factor of the reproduction speed, when a compression rate fixing mode is selected in a case where the input voice corresponds to the voice section and the ring memory is not in a state immediately before overflow, while performing the compression and expansion processing at a compression rate determined based on the type of program set by an operator and the amount of stored data in the ring memory which is a compression rate of not less than 1/n, where n is the set factor of the reproduction speed, when a compression rate variation mode is selected in a case where the input voice corresponds to the voice section and the ring memory is not in a state immediately before overflow.

27. A voice speed converting system comprising:

voice speed conversion processing means for subjecting an input sound signal to voice speed conversion processing;

a ring memory to which an output of the voice speed conversion processing means-is written;

reading means for reading out data from the ring memory at predetermined speed; and stored data amount calculating means for calculating the amount of stored data in the ring memory on the basis of a write signal and a read signal for the ring memory, the voice speed conversion processing means comprising section judging means for judging which of a voice section and a silence section corresponds to the input sound signal, and means for deleting the input sound signal when the input sound signal corresponds to the silence section, and means for subjecting the input sound signal to compression and expansion processing or deletion processing at a compression rate determined depending on the amount of stored data in the ring memory which is a compression rate of not less than 1/n, where n is the set factor of the reproduction speed, when the input sound signal corresponds to the voice section.

28. The voice speed converting system according to claim 27, wherein said section judging means judges, when i (i is a predetermined integer) or more silence frames are continued, that a section from a starting point of the i-th silence frame to a starting point of a voice frame subsequently coming is a silence section.

* * * * *